US007132227B2

(12) United States Patent
Morita et al.

(10) Patent No.: US 7,132,227 B2
(45) Date of Patent: Nov. 7, 2006

(54) SILVER SALT PHOTOTHERMOGRAPHIC DRY IMAGING MATERIAL AND IMAGE RECORDING METHOD

(75) Inventors: Kiyokazu Morita, Kokubunji (JP); Kenji Ohnuma, Hino (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 11/152,378

(22) Filed: Jun. 15, 2005

(65) Prior Publication Data

US 2005/0282095 A1 Dec. 22, 2005

(30) Foreign Application Priority Data

Jun. 18, 2004 (JP) ..... 2004-180854

(51) Int. Cl.

| | |
|---|---|
| ***G03C 1/00*** | (2006.01) |
| ***G03C 1/005*** | (2006.01) |
| ***G03C 1/494*** | (2006.01) |

(52) U.S. Cl. ..... 430/617; 430/618; 430/619; 430/620; 430/348; 430/350; 430/627; 430/631

(58) Field of Classification Search ..... 430/617–620, 430/348, 350, 627, 631

See application file for complete search history.

(56) References Cited

U.S. PATENT DOCUMENTS

| | | | | |
|---|---|---|---|---|
| 6,913,876 | B1 * | 7/2005 | Kobayashi | 430/619 |
| 2003/0207218 | A1 * | 11/2003 | Sasaki et al. | 430/619 |
| 2004/0058281 | A1 * | 3/2004 | Yamane et al. | 430/350 |

* cited by examiner

*Primary Examiner*—Geraldine Letscher
(74) *Attorney, Agent, or Firm*—Finnegan, Henderson, Farabow, Garrett & Dunner, L.L.P.

(57) ABSTRACT

A silver salt photothermographic dry imaging material including a support provided thereon a light-sensitive layer containing an organic silver salt, light-sensitive silver halide particles and a reducing agent, wherein the dry imaging material contains organic solid lubricant particles having an average particle diameter of 1 to 30 μm.

11 Claims, No Drawings

SILVER SALT PHOTOTHERMOGRAPHIC DRY IMAGING MATERIAL AND IMAGE RECORDING METHOD

This application is based on Japanese Patent Application No. 2004-180854 filed on Jun. 18, 2004, in Japanese Patent Office, the entire content of which is hereby incorporated by reference.

FIELD OF THE INVENTION

The present invention relates to a new silver salt photothermographic dry imaging material and an image recording method, and particularly to a silver salt photothermographic dry imaging material, which exhibits excellent photographic performance and abrasion resistance as well as an improved transporting property and an image recording method utilizing the same.

BACKGROUND OF THE INVENTION

Heretofore, in the printing plate making and medical fields, effluent resulting from wet processing of image forming materials has become problematic in terms of workability, and in recent years, also from the view point of environmental protection as well as storage space requirements, so that a decrease in processing effluent has been increasingly demanded. Accordingly, it has been sought to achieve a technology, of employing in photographic techniques via photothermographic dry imaging materials, on which efficient exposure can be performed utilizing laser image setters and laser imagers, resulting in clear black-and-white images at high resolution.

Silver salt photothermographic dry imaging materials, which produce photographic images employing a thermal development processing method as the technique to meet the demand, are disclosed, for example, in U.S. Pat. Nos. 3,152,904 and 3,457,075, and D. Morgan and B. Shely, "Thermally Processed Silver Systems" (Imaging Processes and Materials, Neblette, 8th Edition, edited by J. M. Sturge, V. Walworth and A. Shepp, page 2, 1969).

These silver salt photothermographic dry imaging materials are generally comprised of various constituent layers of a photothermographic dry imaging material, such as a light-sensitive layer and appropriate intermediate layers, a protective layer, a backing layer, an anti-halation layer and an antistatic layer which are coated in combination on a support, comprised of such as plastic. Silver salt photothermographic dry imaging materials often suffer undesirable effects due to contact between a silver salt photothermographic dry imaging material and various apparatus surfaces or among the silver salt photothermographic dry imaging materials, between the coated surfaces of a light-sensitive layer and the backing side, during winding, rewinding and transporting during the manufacturing processes such as coating, drying and processing. For example, generated may be scratches or abrasion on the surface of the silver salt photothermographic dry imaging material and deterioration of the transporting capability of silver salt photothermographic dry imaging material in the developing apparatus.

As possible countermeasures to these problems, disclosed are: a method in which improvement is carried out utilizing an alkyl silane compound incorporating more than 8 carbon atoms (please refer, for example, to patent document 1), and a method in which a sulfur type or ester type lubricant is utilized (please refer, for example, to patent document 2), however, each of these methods exhibits adverse effects on photographic performance and poses a problem of tone deterioration in addition to problems of contamination within the thermal developing apparatus which function in a high temperature environment, or the mean is not being capable of providing sufficient slippage at high temperature. In view of this, disclosed is a method which utilizes an inorganic lubricant as an improved method (for example, refer to patent document 3).

The convey rate within the developing apparatus, and the processing rate within automatic developing apparatuses have further increased recently, and in the present state, further improvement of a slippage is required.

Patent document 1: U.S. Pat. No. 6,020,117

Patent document 2: Unexamined Japanese Patent Application Publication (hereinafter, referred to as JP-A) 2001-5137

Patent document 3: JP-A 2002-116520

SUMMARY OF THE INVENTION

Problems to be Solved by the Present Invention

This invention has been achieved in view of the above drawbacks, and a first object of the present invention is to provide a silver salt photothermographic dry imaging material in which abrasion resistance during thermal development has been significantly improved without adversely adversely affecting photographic performance, and a second object is to provide a silver salt photothermographic dry imaging material which features sufficient slippage without adversely adversely affecting the coating property.

Means to Solve the Problems

The above objects of this invention can be achieved by the following constitutions.

(Item 1)

A silver salt photothermographic dry imaging material comprising a support, providing thereon a light-sensitive layer containing an organic silver salt, light-sensitive silver halide particles and a reducing agent, wherein the dry imaging material contains organic solid lubricant particles having an average particle diameter of 1–30 μm.

(Item 2)

The silver salt photothermographic dry imaging material of item 1, wherein a melting point of the organic solid lubricant particles is at least 110° C. and at most 200° C.

(Item 3)

A silver salt photothermographic dry imaging material comprising a support providing thereon a light-sensitive layer incorporating an organic silver salt, light-sensitive silver halide particles and a reducing agent, wherein at least one layer on the support contains a compound represented by following Formula (1):

$$(R_1)_p—X_1—L—X_2—(R_2)_q \qquad \text{Formula (1)}$$

wherein, $R_1$ and $R_2$ are each a substituted or unsubstituted alkyl group, alkenyl group, aralkyl group or aryl group, having 6–60 carbon atoms, and a plural number of $R_1$ and $R_2$ may be same or different from each other when p or q is an integer of 2 or more, $X_1$ and $X_2$ are each a divalent connecting group containing a nitrogen atom, and L is an unsubstituted alkyl group, alkenyl group aralkyl group or aryl group, having a valence of p plus q.

(Item 4)

The silver salt photothermographic dry imaging material of item 3, wherein the melting point of the compound represented by Formula (1) is not less than 80° C. and not more than 200° C.

(Item 5)

The silver salt photothermographic dry imaging material of item 3 or 4, wherein the compound represented by Formula (1) has a solubility in a solvent, of not more than 0.5 weight % and the compound represented by Formula (1) forms particles at an average particle diameter of 1–30 μm.

(Item 6)

The silver salt photothermographic dry imaging material of Item 3, wherein at least one layer provided on the support contains a nonionic fluorine-containing surfactant and an anionic fluorine-containing surfactant, in addition to the compound represented by Formula (1).

(Item 7)

The silver salt photothermographic dry imaging material of any one of items 1–6, wherein the light-sensitive layer is obtained by coating a composition containing at least an organic silver salt, a light-sensitive emulsion containing light-sensitive silver halide particles, a solvent, a reducing agent and a binder, and the light-sensitive layer or a non-light-sensitive layer contains a silver saving agent.

(Item 8)

The silver salt photothermographic dry imaging material of any one of items 1–7, wherein the silver salt photothermographic dry imaging material contains at least two kinds of compounds, one of the compound generates a reactive active species capable of oxidizing silver, or one of the compounds generates a reactive active species capable of inactivating the reducing agent to be made unable to reduce silver ion of the organic silver salt into silver by radiation of UV light or visible light.

(Item 9)

A method of image recording comprising the steps of:

(1) exposing the silver salt photothermographic dry imaging material of any one of items 1–8; and (2) thermally developing the exposed silver salt photothermographic dry imaging material, wherein step (1) is conducted by employing a laser light scanning exposure device having double laser scanning light beams.

(Item 10)

The method of image recording comprising the steps of:

(1) exposing the silver salt photothermographic dry imaging material of any one of items 1–8; and (2) thermally developing the exposed silver salt photothermographic dry imaging material, wherein the step (1) is conducted by employing a laser scanning exposure device having a longitudinal multiple light of scanning laser light.

(Item 11)

The silver salt photothermographic dry imaging material of any one of items 1–8, wherein a hue angle h ab (defined by JIS Z 8729 standard) of the dry imaging material after thermal development satisfies the relations of 180°<h ab<270°.

(Item 12)

The silver salt photothermographic dry imaging material of any one of items 1–8, wherein the light-sensitive layer is formed by employing a coating composition for forming the a light-sensitive layer contains water not less than 30 weight %.

EFFECTS OF THE INVENTION

This invention provides a silver salt photothermographic dry imaging material exhibiting significantly improved abrasion resistance during thermal development without adversely adversely affecting photographic performance, as well as sufficient slippage without adversely adversely affecting coating property, and an image forming method utilizing the same.

DETAILED DESCRIPTION OF THE INVENTION

In the following paragraphs, the most preferable embodiments to practice this invention will be detailed.

As a result of intensive study of the above problems, the inventors have found that a silver salt photothermographic dry imaging material which exhibits significant improvement in abrasion resistance during thermal development without adversely affecting the photographic performance, as well as providing sufficient slippage without adversely affecting the coating property, by any one of the silver salt photothermographic dry imaging material comprising a support providing thereon a light-sensitive layer containing an organic silver salt, light-sensitive silver halide particles and a reducing agent, wherein 1) at least one layer on the support contains organic solid lubricant particles at an average particle diameter of 1–30 μm, 2) wherein at least one layer on the support contains the above compound represented by Formula (1), or 3) a silver salt photothermographic dry imaging material comprising a support providing thereon a light-sensitive layer containing an organic silver salt, light-sensitive silver halide particles and a reducing agent on a support, wherein at least one layer on the support contains the above compound represented by Formula (1), as well as containing a nonionic fluorine-containing surfactant and an anionic fluorine-containing surfactant; all of which have resulted in this invention.

In the following paragraphs, this invention will be detailed.

The silver salt photothermographic dry imaging material of this invention (hereinafter, also referred to as a light-sensitive material or an imaging material) is characterized in, in one aspect, that at least one layer on the support contains solid organic lubricant particles, and the melting point of the solid organic lubricant particles is preferably not less than 110° C. and not more than 200° C.

Solid organic lubricant particles in this invention are preferably compounds which reduce surface energy, and include particles formed by grinding such as polyethylene, polypropyrene and polytetrafluoroethylene.

In the following, examples of solid organic lubricant particles comprising polyethylene or polypropylene are shown, however, this invention is not limited thereto.

PW-1: polyethylene (exhibiting a low polymerization degree, a melting point of 113° C., and an average particle diameter of 3.6 μm)

PW-2: polypropyrene/polyethylene (exhibiting a melting point of 142° C., and an average particle diameter of 9.6 μm)

PW-3: low density polyethylene (melting point: 113° C., average particle diameter: 7.6 μm)

PW-4: high density polyethylene (melting point: 126° C., average particle diameter: 10.3 μm)

PW-5: polypropyrene (melting point: 145° C., average particle diameter: 8.8 μm)

Further, in the photographic material of this invention, at least one layer on the support contains the above compound represented by Formula (1), the melting point of the compound is preferably not lower than 80° C. and not higher than 200° C.; in addition, the solubility of the compound in the solvent employed for the constituent layer coating composition is at most 0.5 weight %, and the compound is comprised of particles at an average particle diameter of 1–30 μm.

In a compound represented by Formula (1) of this invention, the total carbon number is not specifically limited, however, it is preferably not less than 20, and more preferably not less than 30. Examples of substituents, with which an alkyl group, an alkenyl group, an aralkyl group or an aryl group, in the definition of $R_1$ and $R_2$, is provided, and include such as a halogen atom, a hydroxyl group, a cyano group, an alkoxy group, an aryloxy group, an alkylthio group, an arylthio group, an alkoxycarbonyl group, an aryloxycarbonyl group, an amino group, an acylamino group, a sulfonylamino group, a ureide group, a carbamoyl group, a sulfamoyl group, an acyl group, a sulfonyl group, a sulfinyl group, an aryl group and an alkyl group. These groups may be further substituted by a substituent. Preferable susbstituents are a halogen atom, a hydroxyl group, an alkoxy group, an alkylthio group, alkoxycarbonyl group, an acylamino group, a sulfonylamino group, an acyl group and an alkyl group. The halogen atom is preferably a fluorine atom or a chlorine atom.

The alkyl components in an alkoxy group, an alkylthio group and an alkoxycarbonyl group are the same as alkyl groups of $R_2$, to be described later. The amino groups of an acylamino group and a sulfonyl group may be an N-substituted amino group, the substituent preferably being an alkyl group. The group which connects to the carbonyl group of an acylamino group or an acyl group, and to the sulfonyl group of a sulfonylamino group may be an alkyl group or an aryl group; however, the above alkyl groups are preferred.

$R_1$ and $R_2$ are a substituted or unsubstituted alkyl group, alkenyl group, aralkyl group or aryl group commonly having 6–60 carbon atoms, preferably 6–40 and more preferably 10–30, and these alkyl group, alkenyl group and aralkyl group may be any of a straight chain, a branched chain, a group containing a cyclic structure, or a mixture thereof. Preferable examples of $R_1$ and $R_2$ include any of groups of: octyl, t-octyl, dodecyl, tetradecyl, hexadecyl, 2-hexyldecyl, octadecyl, $C_nH_{2n-1}$ (n being 20–60), eicosyl, docosanyl, melissynyl, octenyl, myristoleyl, oleyl, erucyl, pheny, naphthyl, benzyl, nonylphenyl, dipentylphenyl and cyclohexyl, as well as groups provided with the above substituents.

$X_1$ and $X_2$ are each a divalent connecting group containing a nitrogen atom, and preferably represent —$CONR_3$—, —$NR_4CONR_5$— or —$NR_6COO$—.

L is a substituted or unsubstituted alkyl group, alkenyl group, aralkyl group or aryl group, having a valence of (p plus q). The number of carbon atoms of the hydrocarbon group is not specifically limited, however, it is preferably 1–60, more preferably 1–40 but still more preferably 10–40. "a valence of (p plus q)" in a (p plus q) valent hydrocarbon group indicates that p+q hydrogen atoms in the hydrocarbon are removed and p pieces of $X_1$— groups and q pieces of $X_2$— groups connect thereto. p and q are each an integer of 0–6, and satisfy $1 \leqq p+q \leqq 6$, and preferably $1 \leqq p+q \leqq 4$. Further, it is preferable that both p and q are 1.

The foregoing compounds represented by Formula (1) may be either synthetic or natural substances. Natural substances, or synthetic substances, the raw material of which is a natural higher fatty acid or alcohol, include those having different carbon numbers, include those of a straight chain type and a branched chain type, resulting in a mixture thereof; however, these mixtures may be employed without limitation. Synthetic substances are preferred with respect to a more stable quality of the composition.

In the following, specific examples of compounds represented by Formula (1) will be listed, however, this invention is not limited thereto.

OW-21: methylene bisstearic acid amide (melting point: 142° C., average particle diameter: 6.7 μm)

OW-22: methylene bislauric acid amide (melting point: 131° C., average particle diameter: 5.7 μm)

OW-23: methylene bishydroxystearic acid amide (melting point: 143° C., average particle diameter: 5.5 μm)

OW-24: ethylene biscaprylic acid amide (melting point: 165° C., average particle diameter: 5.8 μm)

OW-25: ethylene biscapric acid amide (melting point: 161° C., average particle diameter: 6.7 μm)

OW-26: ethylene bislauric acid amide (melting point: 157° C., average particle diameter: 6.5 μm)

OW-27: ethylene bisstearic acid amide (melting point: 145° C., average particle diameter: 7.8 μm)

OW-28: ethylene bisisostearic acid amide (melting point: 106° C., average particle diameter: 4.6 μm)

OW-29: ethylene bishydroxystearic acid amide (melting point: 145° C., average particle diameter: 6.9 μm)

OW-30: ethylene bisbehenic acid amide (melting point: 142° C., average particle diameter: 6.6 μm)

OW-31: hexamethylene bisstearic acid amide (melting point: 140° C., average particle diameter: 7.6 μm)

OW-32: hexamethylene bisbehenic acid amide (melting point: 142° C., average particle diameter: 6.7 μm)

OW-33: hexamethylene bishydroxystearic acid amide (melting point: 135° C., average particle diameter: 8.1 μm)

OW-34: butylenes bishydroxystearic acid amide (melting point: 140° C., average particle diameter: 7.8 μm)

OW-37: methylene bisoleic acid amide (melting point: 116° C., average particle diameter: 6.7 μm)

OW-38: ethylene bisoleic acid amide (melting point: 119° C., average particle diameter: 6.7 μm)

OW-39: ethylene biserucic acid amide (melting point: 120° C., average particle diameter: 7.8 μm)

OW-40: hexamethylene bisoleic acid amide (melting point: 110° C., average particle diameter: 7.5 μm)

OW-49: Xylene bistearyl urea (melting point: 166° C., average particle diameter: 6.0 μm)

OW-50: toluylene bisstaryl urea (melting point: 172° C., average particle diameter: 7.8 μm)

OW-51: hexamethylene bisstearyl urea (melting point: 173° C., average particle diameter: 6.5 μm)

OW-52: diphenylmethane bisstearyl urea (melting point: 206° C., average particle diameter: 7.6 μm)

To determine the average particle diameter based on this invention, a compound after dispersion of this invention is diluted to be dispersed on a grid attached to a carbon support film, and after being imaged via a transmission electron microscope (for example, 2000 FX type, manufactured by Nippon Electronics Co., Ltd.) at a direct magnification of 5,000, the negative image captured via a scanner as a digital image; then each particle diameter (equivalent circle diameter) of at least 300 particles is measured by use of appropriate image processing software, resulting in determination of the average particle diameter based on the arithmetic average thereof.

The light-sensitive material of this invention is characterized in that at least one layer on the support contains a compound represented by foregoing Formula (1), as well as a nonionic fluorine-containing surfactant and an anionic fluorine-containing surfactant.

Nonionic surfactants employable in this invention are not specifically limited, however, compounds represented by following Formula (A) are preferable.

$$Rf_1—(AO)_n—Rf_2 \qquad \text{Formula (A)}$$

wherein, $Rf_1$ and $Rf_2$ each are a fluorine-containing aliphatic group, and may be the same or different. AO is a group provided with at least one alkyleneoxy group, and n is an integer of 1–30.

In Formula (A), fluorine-containing aliphatic groups represented by $Rf_1$ and $Rf_2$ include aliphatic groups of a straight chain, branched chain and cyclic types or combinations thereof such as alkyl cyclo aliphatic groups. Preferable fluorine-containing aliphatic groups are fluoroalkyl groups (such as $—C_4F_9$ and $—C_8F_{17}$), sulfofluoroalkyl groups (such as $—C_7F_{15}SO_3$ and $—C_8F_{17}SO_3$), $C_nF_{2n+1}SO_2N(R_1)R_2—$ groups [$R_1$ being a hydrogen atom, an alkyl group, an alkoxy group, an alkylcarboxyl group or an aryl group, each having 1–20 carbon atoms, while $R_2$ being an alkylene group, or an alkylenecarboxyl group each having 1–20 carbon atoms, and n is an integer of 1–20, and examples being such as $—C_7F_{15}SO_2N(C_2H_5)CH_2—$ and $—C_8F_{17}SO_3N(CH_2COOH)CH_2CH_2CH_2—$], and these may be further provided with a substituent.

AO is a group provided with an alkyleneoxy group such as ethyleneoxy, propyleneoxy and i-propyleneoxy, which may be further provided with a substituent such as an amino group at its terminal, while n is preferably an integer of 5–15.

In the following, specific examples of compounds represented by Formula (A) are shown, however, this invention is not limited thereto.

A-1: $C_{12}F_{25}(CH_2CH_2O)_{24}C_{12}F_{25}$

A-2: $C_8F_{17}(CH_2CH_2O)_8C_8F_{17}$

A-3: $C_7F_{15}CH_2CH(OH)CH_2(CH_2CH_2O)_{15}CH_2CH(OH)CH_2C_7F_{15}$

A-4: $C_7F_{15}(CH_2CH_2O)_{10}C_7F_{15}$

A-5: $C_{12}F_{25}(CH_2CH_2O)_{15}C_{12}F_{25}$

A-6: $C_8F_{17}CH_2CH(OH)CH_2(CH_2CH_2O)_{20}CH_2CH(OH)CH_2C_8F_{17}$

A-7: $C_8F_{17}(CH_2CH_2O)_{18}C_8F_{17}$

A-8: $C_8F_{17}(CH_2CH_2O)_{20}C_8F_{17}$

A-9: $C_7F_{15}SO_2N(C_2H_5)CH_2(CH_2CH_2O)_{22}CH_2N(CH_3)SO_2C_7F_{15}$

A-10: $C_9F_{17}O(CH_2CH_2O)_{22}C_9F_{17}$

Further, anionic fluorine-containing surfactants utilizable in this invention are not specifically limited and specific compounds are shown below, however, this invention is not limited thereto.

FA-1

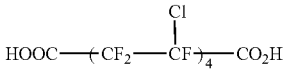

FA-2

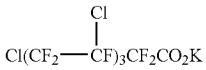

FA-3

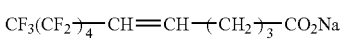

-continued

FA-4

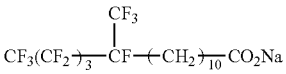

FA-5

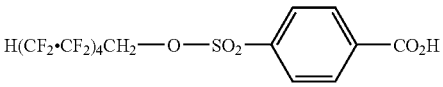

FA-6

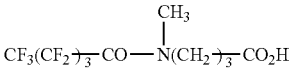

FA-7

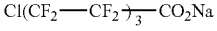

FA-8

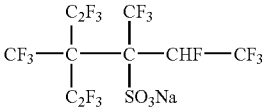

FA-9

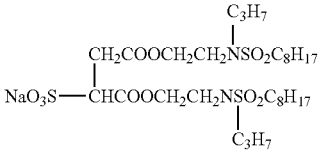

FA-10

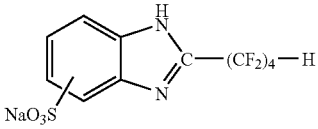

( —$SO_3Na$ being at the 4- or 5-position, or a mixture thereof)

FA-11

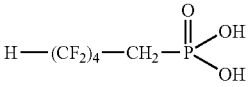

FA-12

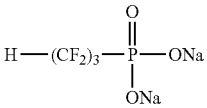

FA-13

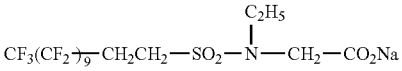

FA-14

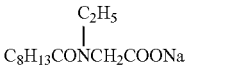

FA-15

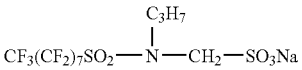

FA-16

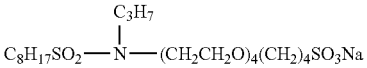

FA-17

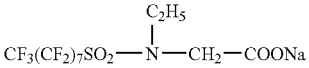

FA-18

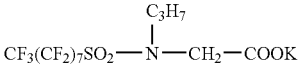

FA-19

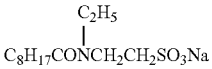

-continued
FA-20
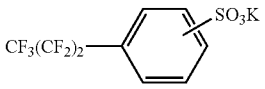
(—$SO_3K$ being at the o-, m- or p- position, or a mixture thereof)
FA-21
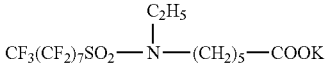
FA-22
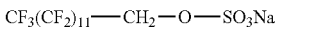
FA-23
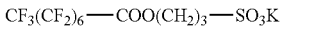
FA-24
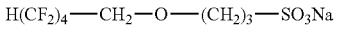
FA-25
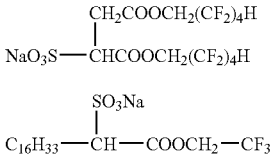
FA-26
FA-27
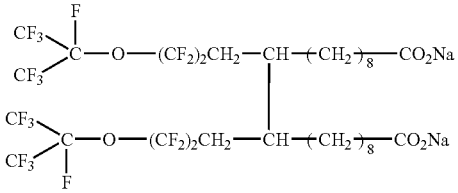
FA-28
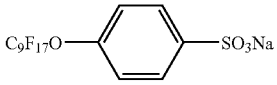
FA-29
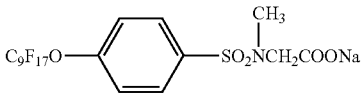
FA-30
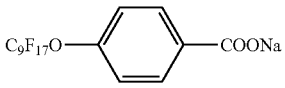
FA-31
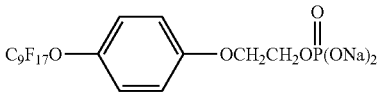
FA-32
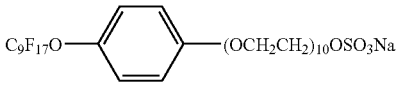
FA-33
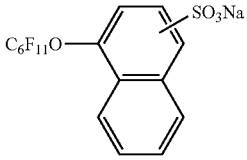
FA-34
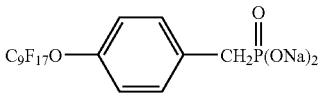
FA-35
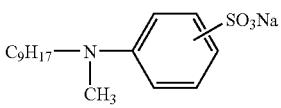
-continued
FA-36
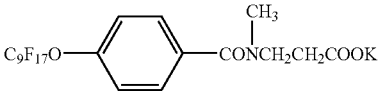
FA-37
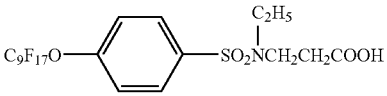
FA-38
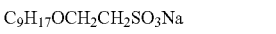
FA-39
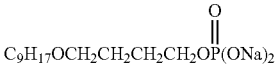
FA-40
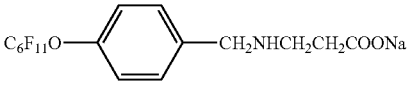
FA-41
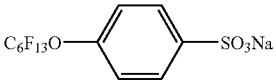
FA-42
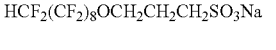
FA-43
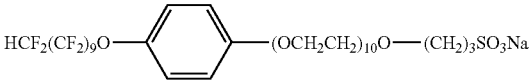
FA-44
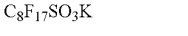
FA-45
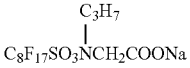
FA-46
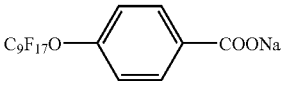
FA-47
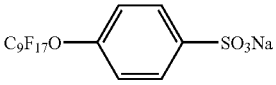
FA-48
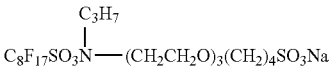
FA-49
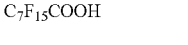
FA-50
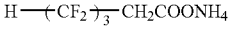
FA-51
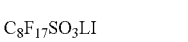
FA-52
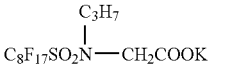
FA-53
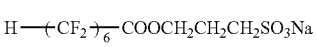
FA-54
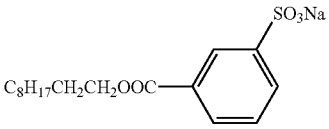
FA-55
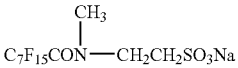

-continued

FA-56

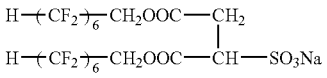

FA-57

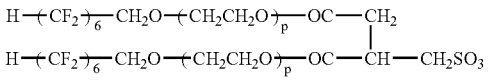

p: averaging 3

FA-58

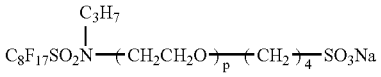

p: averaging 4

FA-59

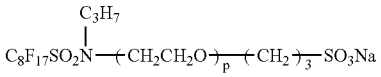

p: averaging 7

FA-60

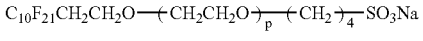

p: averaging 6

FA-61

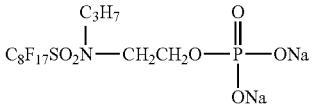

FA-62

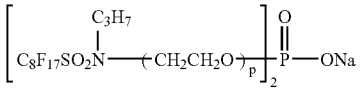

p: averaging 5

FA-63

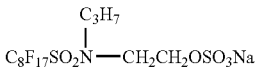

FA-64

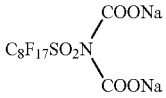

FA-65

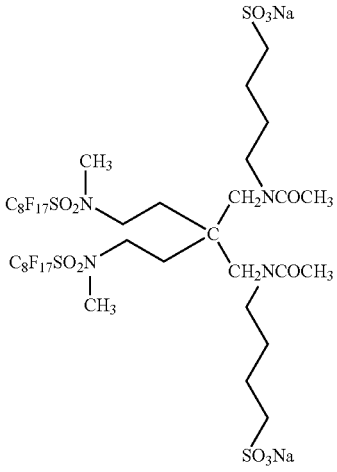

FA-66

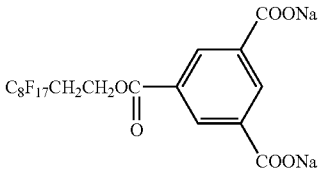

-continued

FA-67

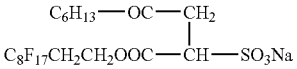

FA-68

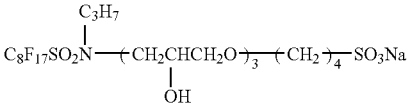

FA-69

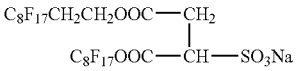

The used amount of each fluorine-containing surfactant of this invention is generally 0.01–1 g, preferably 10–500 mg and more preferably 50–300 mg, per $m^2$ of light-sensitive material.

As fluorine-containing surfactants employed in this invention, other than those described above, ionic fluorine type surfactants described in JP-A Nos. 60-244945, 63-306437 and 1-24245, and anion•cation combined fluorine type sufactants described in JP-A Nos. 5-197068 and 5-204115 may be employed.

The layer, in which a fluorine-containing surfactant employed in this invention is added, is not specifically limited, and the surfactant may be in any layer, however, it is preferably contained in the outermost surface layer.

Next, each constituent element of the silver salt photothermographic dry imaging material of this invention will be described.

Light-Sensitive Silver Halide Particle

Initially, light-sensitive silver halide particles (hereinafter, also simply referred to as silver halide particles) employed in a silver salt photothermographic dry imaging material of this invention will be described.

Light-sensitive silver halide particles in this invention refer to silver halide crystal grains which can essentially perform light absorption as an inherent property of the silver halide crystal, or absorb visible light or infrared light by means of a physicochemical method, as well as being manufactured by processing so that a physicochemical change inside the crystal or on the surface of a crystal will be caused by absorbed light of any wavelength range, within the ultraviolet to the infrared regions.

The silver halide particles themselves employed in this invention can be prepared as a silver halide particle emulsion employing a method described in such as P. Glafkides, Chimie et Physique Photographique (published by Paul Montel Corp., 1967); G. F. Duffin, Photographic Emulsion Chemistry (published by The Focal Press, 1966); and V. L. Zelikman et al, Making and Coating Photographic Emulsion (published by The Focal Press, 1964). Namely, any of the acid method, neutral method or ammonia method may be employed. Further, water-soluble silver salts may be allowed to react with water-soluble halide salts employing either a single-jet method or a double-jet method, as well as a combination thereof, however, preferably employing is the so-called controlled double-jet method, in which silver halide particles are prepared while controlling the formation conditions, within the above methods.

The halogen composition is not specifically limited and may be any of silver chloride, silver chloro-bromide, silver chloro-iodo-bromide, silver bromide, silver iodo-bromide and silver iodide, however, preferable is silver bromide, silver iodo-bromide or silver iodide.

In the case of silver iodo-bromide, the content of iodine is preferably in the range of 0.02–16 mol %/Ag mol. Iodine may be contained so as to be distributed over the whole silver halide particle or at a higher concentration in a specific portion, for example, in the central portion of the silver halide particle while at a lower or essentially zero concentration in the vicinity of the surface, providing a core/shell type structure.

Grain formation is generally divided into two steps: generation of silver halide seed grains (nuclei grains) and grain growth, and both of these steps may be performed continuously, or nuclei formation and grain growth may be performed separately. As conditions for grain formation, preferable is a controlled double-jet method, in which grain formation is performed while such as pAg and pH are controlled, with respect to controlling the grain shape and size. For example, in the case of performing nucleation and grain growth separately, after initially performing nucleation by rapidly mixing a water-soluble silver salt and a water-soluble halide salt into a gelatin aqueous solution, silver halide particles are prepared via a grain growth process in which grains are grown while supplying a water-soluble silver salt and a water-soluble halide salt under the control of such as pAg and pH.

Silver halide particles employed in this invention are preferably provided with a smaller particle diameter to restrain whitening and toning (yellowish color), as well as at excellent image quality, and further the average particle diameter is preferably between 0.030–0.055 μm based on excluding particles having an average particle diameter of less than 0.02 μm from these being measured.

Herein, particle diameter means the length of the edge of a silver halide grain, in the case of silver halide particles being a so-called normal crystal, such as a cube or octahedron. Further, particle diameter means the diameter of a circular image having the same area as the projected area of the primary surface, in the case of a silver halide particle being a tabular grain.

In this invention, silver halide particles are preferably monodispersed. Herein, "monodispersed" means that the coefficient of variation of the particle diameter determined by the following equation is not more than 30%, preferably not more than 20% and most preferably not more than 15%.

Coefficient of variation of particle diameter=standard deviation of particle diameter/mean particle diameter×100 (%)

The shape of silver halide particles includes such as a cubic grain, an octahedral grain, a tetradecahedral grain, a tabular grain, a spherical grain, a bar-shaped grain and a potato-shaped grain, but specifically preferable among these are cubic, octahedral, tetradecahedral and tabular silver halide particles.

The mean aspect ratio in the case of employing tabular silver halide particles is preferably between 1.5–100, but more preferably between 2–50. These methods are described in such as U.S. Pat. Nos. 5,264,337, 5,314,798 and 5,320,958, and the targeted tabular grains can be easily prepared. Further, also preferably employed are silver halide particles having rounded corners.

The crystal habit of the outer surface of silver halide particles is not specifically limited, however, silver halide particles provided with a crystal habit which fits the selectivity at a higher ratio are preferably utilized in the case of employing a spectral sensitizing dye having a selectivity of a crystal habit (surface). For example, when a sensitizing dye which selectively adsorbs on a crystal surface at a Miller's Index of [100] is employed, it is preferable that the occupying ratio of [100] surface on the outer surfaces of silver halide particles is high, but this ratio is preferably at least 50%, more preferably at least 70% and specifically preferably at least 80%. On the contrary, when a sensitizing dye which selectively adsorbs on a crystal surface of Miller's Index of [111] is employed, it is preferable that the occupying ratio of [111] surface on the outer surfaces of silver halide particles is raised. Herein, the ratio of a Miller's Index [100] surface can be determined based on T. Tani, J. Imaging Sci., 29, 165 (1985) which employs the adsorption dependence of [111] and [100] surfaces in adsorption of sensitizing dyes.

Silver halide particles employed in this invention are preferably prepared by employing low molecular weight gelatin at a maximum average molecular weight of 50,000 during the grain formation, however, the gelatin is specifically preferably employed during the nucleation of silver halide particles. Low molecular weight gelatin has a maximum average molecular weight of 50,000, preferably 2,000–40,000 but more preferably 5,000–25,000. The average molecular weight of gelatin can be measured via gel permeation chromatography.

The concentration of a dispersion medium during nucleation is preferably at most 5 weight % and the nucleation is more effectively performed at a concentration as low as 0.05–3.0 weight %.

Silver halide particles employed in this invention may incorporate during the grain formation a polyoxyethylene oxide compound represented by formula [I] described below.

$$YO(CH_2CH_2O)_m(CH(CH_3)CH_2O)_p(CH_2CH_2O)_nY \qquad \text{formula [I]}$$

wherein, Y is a hydrogen atom, —$SO_3M$ or —CO—B—COOM; M is a hydrogen atom, an alkali metal, an ammonium group or an ammonium group substituted by an alkyl group having a carbon number of not more than 5; B is a chain or cyclic group which forms an organic dibasic acid, m and n are each an integer of 0–50, while p is an integer of 1–100.

Polyethylene oxide compounds represented by foregoing formula [I] have commonly been preferably employed as a defoaming agent to counter excessive foaming during stirring or transporting of the emulsion raw materials, such as during the preparation of a gelatin solution, adding a water-soluble halide compound and a water-soluble silver salt into the gelatin solution, and coating a silver halide emulsion on a support, during manufacturing a light-sensitive material. Techniques employing a defoaming agent are described, for example, in JP-A No. 44-9497, and polyethylene oxide compounds represented by foregoing formula [I] also function as a defoaming agent during nucleation.

Polyethylene oxide compounds represented by foregoing formula [I] are preferably employed at a maximum of 1 weight % but more preferably between 0.01–0.1 weight %, based on silver.

Polyethylene oxide compounds represented by foregoing formula [I] are preferably present during nucleation and may be added into a dispersion medium before nucleation in advance, however, they may be added during nucleation, or may be employed by being added in a silver salt aqueous solution or a halide aqueous solution, which is employed during nucleation. It is preferable to employ the compound by adding it in a halide aqueous solution or in both aqueous solutions of a silver salt and a halide at 0.01–2.0 weight %.

Further, the compound is preferably made to be present during at least 50% of the time of the nucleation process, and more preferably during at least 70% of the time. Polyethylene oxide compounds represented by the above formula may be added as a powder or by being dissolved in a solvent such as methanol.

Herein, temperature during nucleation is commonly 5–60° C. but is preferably 15–50° C., however it is preferably controlled in the foregoing temperature range, in case of a constant temperature pattern, a rising temperature pattern (for example, the temperature at initiation of nucleation being 25° C., after which the temperature being gradually raised during nucleation to reach 40° C. at the termination of nucleation) and the opposite temperature pattern.

The concentration of a silver salt aqueous solution and a halide aqueous solution employed for nucleation is preferably at most 3.5 mol/l but more preferably in as low a concentration as 0.01–2.5 mol/l. The addition rate of silver ions during nucleation is preferably $1.5\times10^{-3}$–$3.0\times10^{-1}$ mol/min but is more preferably $3.0\times10^{-3}$–$8.0\times10^{-2}$ mol/min.

The pH during nucleation can be set in the range of 1.7–10, however, is preferably set at 2–6 because pH of the alkaline solution broadens the particle diameter distribution. Further, the pBr during nucleation is commonly 0.05–3.0, preferably 1.0–2.5 and more preferably 1.5–2.0.

Internal Latent Image After Thermal Development Type Silver Halide Particles

As light-sensitive silver halide particles of this invention, employed may be silver halide particles in which the surface sensitivity is decreased by being converted from a surface latent image type to an internal latent image type via thermal development. That is, the silver halide particles are characterized in that a latent image, which functions as a catalyst of a development reaction (being a reduction reaction of silver ions by a silver ion redusing agent), is formed on the surface of the silver halide particles by exposure before thermal development, while exposure after a thermal development process results in latent image formation on the surface being restrained because latent images are formed more in the interior than on the surface of the silver halide particles.

Generally, when silver halide particles are exposed, a spectral sensitizing dye, which is adsorbed on the surface of light-sensitive silver halide particles, is photo-excited to generate freely movable electrons, and these electrons are competitively trapped (captured) by electron traps existing on the silver halide grain surface (light-sensitive centers) or electron traps existing in the interior of the grains. Therefore, latent images are formed preferentially on the surface when such as chemical sensitivity centers (chemical sensitivity specks) or dopants, which are effective as electron traps, exist more on the surface than in the interior of silver halide particles, which enables grains to become developable. On the contrary, latent images are inherently formed in the interior when such as chemical sensitivity centers (chemical sensitivity specks) or dopants, which are effective as electron traps, exist more in, and at a suitable number, in the interior than on the surface of silver halide particles, which makes surface development difficult. In other words, sensitivity is higher on the surface than in the interior in the former case, while sensitivity is lower on the surface than in the interior in the latter case (please refer to Reference Literature: (1) "The Theory of The Photographic Process" 4th edition, edited by T. H. James), published by Macmillan Publishing Co., Ltd., 1977, and (2) "Principles of Photographic Engineering (Silver Salt Photography)", revised edition, edited by The Society of Photographic Science and Technology of Japan, published by Corona Publishing Co., Ltd., 1998).

In light-sensitive silver halide particles of this invention, it is preferable to incorporate a dopant which functions as an electron trapping dopant in the interior of silver halide particles, at least during exposure after thermal development, with respect to sensitivity and image storage stability.

Herein, specifically preferable is a dopant which functions as a positive hole trap during exposure for image formation before thermal development, and may be modified during thermal development, functioning as an electron trap after thermal development.

An electron trapping dopant is an element or a compound other than silver and halogen, which constitute silver halide particles, and refers to those in which the dopant itself is provided with the property to trap (capture) free electrons, or a portion of the particle exhibits an electron trapping lattice defect which is generated by incorporating the dopant in the silver halide particles. For example, listed are ions of metals other than silver, salts or complexes thereof, inorganic compounds or organic compounds containing chalcogen (oxygen group elements) such as sulfur, selenium and tellurium, or a nitrogen atom; or metal complexes thereof, and rare earth ions or complexes thereof.

Metal ions, or salts or complexes thereof, include such as lead ions, bismuth ions and gold ions; as well as lead bromide, lead nitrate, lead carbonate, lead sulfate, bismuth nitrate, bismuth chloride, bismuth trichloride, bismuth carbonate, sodium bismuthate, chloroauric acid, lead acetate, lead stearate and bismuth acetate.

As compounds containing chalcogen such as sulfur, selenium and tellurium, employed may be various chalcogen releasing compounds, generally known as chalcogen sensitizers in the photographic industry. Further, organic compounds containing chalcogen or nitrogen are preferably heterocyclic compounds, and include, for example, imidazole, pyrazole, pyridine, pyrimidine, pyradine, pyridazine, triazole, triazine, indole, indazole, purine, thiadiazole, oxadiazole, quinoline, phthalazine, naphthylizine, quinoxaline, quinazoline, cinnoline, pteridine, acridine, phenanthroline, phenazine, tetrazole, thiazole, oxazole, benzimidazole, benzoxazole, benzthiazole, indolenine and tetrazaindene; preferable of which are imidazole, pyridine, pyrimidine, pyradine, pyridazine, triazole, triazine, thiadiazole, oxadiazole, quinoline, phthalazine, naphthylizine, quinoxaline, quinazoline, cinnoline, tetrazole, thiazole, oxazole, benzimidazole, benzoxazole, benzthiazole and tetrazaindene.

Herein, the heterocyclic compounds described above may be provided with a substituent, preferable substituents of which are: an alkyl group, an alkenyl group, an aryl group, an alkoxy group, an aryloxy group, an acyloxy group, an acyl group, an alkenyl group, an alkoxycarbonyl group, an aryloxycarbonyl group, an acyoxy group, an acylamino group, an alkoxycarbonylamino group, an aryloxycarbonylamino group, a sulfonylamino group, a sulfamoyl group, a carbamoyl group, a sufonyl group, an ureido group, a phosphoric amido group, a halogen atom, a cyano group, a sulfo group, a carboxyl group, a nitro group and a hetero cyclic group; but more preferable of which are: an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, an ureido group, a phosphoric amido group, a halogen atom, a cyano group, a nitro group and a hetero cyclic group; however the most preferable of which are: an alkyl group, an aryl group, an alkoxy group, an aryloxy group, an acyl group, an acylamino group, a sulfonylamino group, a sulfamoyl group, a carbamoyl group, a halogen atom, a cyano group, a nitro group and a hetero cyclic group.

Herein, silver halide particles employed in this invention may contain an ion of a transition metal belonging to the 6th–11th groups of The Periodic Table, while chemically controlling the oxidation state of the metal with such as a ligand, so that the ion functions as an electron trapping dopant or as a hole trapping dopant similar to the above-described dopant. The above-described transition metals preferably include W, Fe Co, Ni, Cu, Ru, Rh, Pd, Re, Os, Ir and Pt.

In this invention, with respect to the various types of dopants described above, either one type or combinations of at least two types of compounds or complexes from the same type or different types may be employed. However, at least one type is necessary to function as an electron trapping dopant during exposure after thermal development. These dopants may be introduced into silver halide particles in any appropriate chemical form.

In this invention, an embodiment to achieve doping by employing either one type alone of a complex or salt of Ir or Cu is not always preferable.

The content of the dopant is preferably in the range of $1\times10^{-9}$–10 mol per mol of silver, more preferably $1\times10^{-8}$–$1\times10^{-1}$ mol but still more preferably $1\times10^{-6-1}\times10^{-2}$ mol.

However, since the most preferable content depends on such factors as the type of dopant, particle diameter and shape of silver halide particles, as well as environmental conditions, it is preferable to study optimization of the dopant addition conditions related to these conditions.

In this invention, those transition metal complexes or complex ions represented by the following formula are preferable.

$$[ML_6]^m \qquad \text{Formula}$$

wherein, M is a transition metal selected from elements of 6th–11th groups of The Periodic Table, L is a ligand, and m is 0, −, 2−, 3− or 4−. Specific examples of ligands represented by L include each ligand of halogen ions (such as a fluorine ion, a chlorine ion, a bromine ion and an iodine ion), cyanide, cyanato, thiocyanato, selenocyanato, tellurocyanato, azide and aquo; nitrosyl and thionitrosyl, but preferably aquo, nitrosyl or thionitrosyl. In the case that an aquo ligand is present, it is preferable the aquo ligand preferably occupies one or two of the ligands, while L's may be the same or differ.

Compounds, which provide these metal ions or complex ions, are preferably incorporated into silver halide particles via addition during silver halide grain formation. These may be added during any of the preparation stages of silver halide particles, that is, before or after nucleation, growth, physical ripening, or chemical sensitization. However, these are preferably added at the stage of nucleation, growth or physical ripening, more preferably at the stage of nucleation or growth, but most preferably at the stage of nucleation. The addition may be carried out several times by dividing the total amount so that uniform content in the interior of the silver halide grain results, or incorporation can be carried out so as to result in uniform distribution in the interior of the grain, as described in such as JP-A Nos. 63-29603, 2-306236, 3-167545, 4-76534, 6-110146 and 5-273683.

It is possible to dissolve these metal compounds in water or suitable organic solvents (such as alcohols, ethers, glycols, ketones, esters and amides) and subsequently add the resulting solution. There are methods in which, for example, an aqueous solution of metal compound powders or an aqueous solution, in which a metal compound is dissolved along with NaCl and KCl, is added to a water-soluble silver salt solution or a water-soluble halide solution, during grain formation; a method in which a metal compound is added as a third solution while simultaneously mixing the three solutions to form silver halide particles; a method in which during grain formation, an aqueous solution comprising the necessary amount of a metal compound is charged into a reaction vessel; or a method in which dissolution is carried out by the addition of other silver halide particles previously doped with metal ions or complex ions during silver halide preparation. Specifically, the preferred method is one in which an aqueous solution of metal compound powders or an aqueous solution in which a metal compound is dissolved along with NaCl and KCl is added to a water-soluble halide solution. When the addition is carried out on the grain surface, it is possible to charge an aqueous solution, comprising the necessary amount of a metal compound, into a reaction vessel immediately after grain formation, or during physical ripening or at the completion thereof, or during chemical sensitization.

Herein, a non-metallic dopant can also be incorporated in the interior of silver halide particles according to a method, similar to that for the metallic dopant described above.

In light-sensitive materials of this invention, whether the above-described dopant is provided via an electron trapping property can be evaluated by a method, heretofore, commonly known in the photographic industry, which will be explained below. That is, a silver halide emulsion comprising silver halide particles, the interior of which is doped with the above-described dopant or a decomposition product thereof, can be evaluated by measuring as a standard, the decreasing rate of photoconductivity by means of such as a microwave photoconductivity measuring method employing a silver halide emulsion which contains no dopants. Further, evaluation is also possible by means of a comparison of the internal sensitivity and the surface sensitivity of the silver halide particles.

Silver halide particles of this invention may be added to a light-sensitive layer using any appropriate method, and silver halide particles are preferably arranged to be adjacent to the reducible silver source (in this case silver aliphatic carboxylate) to obtain an imaging material exhibiting high sensitivity and high covering power (CP).

Silver halide particles of this invention are specifically preferably prepared in advance and added into a solution to prepare silver aliphatic carboxylate particles, with respect to separate handling of a preparation process of silver halide grain and a preparation process of silver aliphatic carboxylate particless, as well as control of manufacture. However, it is also possible to have a halogen component such as a halide ion coexist in combination with a component to form silver aliphatic carboxylate during preparation of silver aliphatic carboxylate particles, and to inject silver ions therein, resulting in utilization of silver halide particles, which are formed almost simultaneously during formation of silver aliphatic carboxylate particles. Further, it is also possible to have a halogen-containing compound react with silver aliphatic carboxylate and to prepare silver halide particles by conversion of silver aliphatic carboxylate, resulting in utilization of the particles. That is, it is also possible to make a silver halide forming component react with a solution or dispersion of silver aliphatic carboxylate, or with a sheet material containing silver aliphatic carboxylate, resulting in conversion of a part of the silver aliphatic carboxylate into a light-sensitive silver halide.

Silver halide grain forming components include inorganic halogen compounds, onium halides, hydrocarbon halogenides, N-halogen compounds and other halogen-containing compounds, and specific examples thereof are disclosed in such as U.S. Pat. Nos. 4,009,039, 3,457,075, and 4,003,749, British Pat. No. 1,498,956, and JP-A Nos. 53-27027 and 53-25420.

Silver halide particles, which are manufactured by conversion of a part of the silver aliphatic carboxylate, may be employed in combination with silver halide particles preoared separately, as described above.

These silver halide particles, both silver halide particles separately prepared and silver halide particles prepared by conversion of silver aliphatic carboxylate, are preferably employed at 0.001–0.7 mol but more preferably 0.03–0.5 mol, against 1 mol of silver aliphatic carboxylate.

Unnecessary salts in light-sensitive silver halide particles separately prepared may be desalted via a commonly known desalting method such as a noodle method, a flocculation method, an ultra-filtration method or an electrical dialysis method, however, the grains may be also employed without desalting.

Organic Silver Salt: Photo-Insensitive Silver Aliphatic Carboxylate

Organic silver salts of this invention are preferably non-light-sensitive silver aliphatic carboxylate. The organic silver salts function as a reducible silver source and are preferably silver aliphatic carboxylate having a carbon number of 10–30, but preferably 15–25. Preferable examples of silver salts include the following.

For example, listed are silver salts of such as gallic acid, oxalic acid, behenic acid, stearic acid, arachidinic acid, palmitic acid and lauric acid, but the preferable silver salts are silver behenate, silver arachdinate and silver stearate.

Further, in this invention, a mixture of at least two types of silver aliphatic carboxylates is preferable with respect to increasing developability to form a silver image of a high density and high contrast, which is preferably prepared by mixing a silver ion solution into a mixture of at least two types of aliphatic carboxylic acids.

On the other hand, with respect to image storage stability after development, it is preferred that the content ratio of an aliphatic carboxylic acid, as a raw material of silver aliphatic carboxylate, featuring a melting point of at least 50° C. but preferably at least 60° C., is at least 50%, preferably at least 70% but most preferably at least 80%. From this point of view, the highest content of silver behenate is preferred.

Silver aliphatic carboxylate can be prepared by mixing a water-soluble silver compound and a compound forming a complex with silver, which is preferably employed via a normal precipitation method, a reverse precipitation method or a simultaneous precipitation method, as well as controlled double jet method, such as described in JP-A No. 9-127643. For example, after forming an organic alkali metal soap (such as sodium behenate and sodium arachidinate) by adding an alkali metal salt (such as sodium hydroxide and potassium hydroxide) into an organic acid, crystals of silver aliphatic carboxylate are prepared by mixing the soap with such as silver nitrate by means of a controlled double jet method. In such a case, coexisting may be such as seed crystal grains of silver aliphatic carboxylate and silver halide particles.

The types of alkali metal salts employed in this invention include such as sodium hydroxide, potassium hydroxide and lithium hydroxide, however, it is preferable to employ sodium hydroxide and potassium hydroxide in combination. The combination ratio is preferably in the range of 10/90–75/25 based on mole ratio of both foregoing hydroxides. By employing the above ratio range, when the alkali metal reacts with an aliphatic carboxylic acid to form an alkali metal salt of aliphatic carboxylic acid, the viscosity of the reaction solution can be controlled to an optional state.

Further, in the case of preparing a silver aliphatic carboxylate in the presence of silver halide particles of an average particle diameter of at most 0.050 μm, it is specifically preferable that an alkali metal of an alkali metal salt has a high potassium ratio because dissolution and Ostwald ripening of the silver halide particles are thereby prevented. Further, the higher the potassium salt ratio, the smaller can be the size of silver aliphatic carboxylate particles. A preferable potassium salt ratio is 50–100% compared to the total alkali metal salts employed during manufacture of silver aliphatic carboxylate. The concentration of alkali metal salt is preferably 0.1–0.3 mol/1,000 ml.

Structure and Form of Silver Aliphatic Carboxylate

Silver aliphatic carboxylate of this invention may be in the form of crystal grains featuring a core/shell structure as described in European Pat. No. 1168069A1 and JP-A No. 2000-23303. In the case of a core/shell structure, silver salts other than silver aliphatic carboxylate, for example, silver salts of organic silver compounds such as phthalic acid and benzimidazole may be employed as a constituent component of the crystal grains, in a part of or in the whole of either the core portion or the shell portion.

In the silver aliphatic carboxylate of this invention, it is preferable that the average equivalent circle diameter is at least 0.05 μm but at most 0.8 μm, and the average thickness is at least 0.005 μm but at most 0.07 μm. Specifically however it is preferable that the average equivalent circle diameter is at least 0.2 μm but at most 0.5 μm, while the average thickness is at least 0.01 μm but at most 0.05 μm.

When the average equivalent circle diameter is at most 0.05 μm, transparency is excellent but image storage stability suffers, while when the average particle diameter is at least 0.8 μm, devitrification is significant. When the mean thickness is at most 0.005 μm, the surface area is too large to perform rapid supply of silver ions during development, and large quantity of silver ions remain unconsumed in the silver image of a film, particularly in low density portions, resulting in significant deterioration of image storage stability. Further, when the mean thickness is at least 0.07μm, the surface area is too small to improve image storage stability; however, silver supply during development is slow to result in non-uniformity of developed silver particles, particularly in high density portions, resulting in likelyhood of a decrease of maximum density.

To determine the average equivalent circle diameter, silver aliphatic carboxylate after dispersion is diluted to be dispersed on a grid attached to a carbon holding film; imaging is performed at a direct magnification of 5,000 times via a transparent electron microscope (for example, 2000FX type, manufactured by Nippon. Electronics Co., Ltd), the obtained negative is then converted into a digital image via a scanner, and the average particle diameter can be calculated by measuring at least 300 random particle diameters employing appropriate image processing software.

Average thickness can be calculated by a method utilizing a TEM (transmission electron microscope), as described below.

First, a light-sensitive layer coated on a support is pasted on a suitable holder with appropriate adhesive, and an ultra-thin slice at a thickness of 0.1–0.2 μm is prepared employing a diamond knife in the direction perpendicular to the support surface. The prepared ultra-thin slice is supported on a copper mesh to be transferred onto a carbon film which has been made hydrophilic by glow discharge, the light field image of the sample being observed, while cooled to at most −130° C. via liquid nitrogen, employing a transmission electron microscope at a magnification of 5,000–40,000, after which the image is quickly recorded on such as a film, an imaging plate or a CCD camera. At this time, an appropriate field to be observed is selected at a portion in which the slice sample has no breaks or wrinkles.

As a carbon film, preferable are those held by an organic film such as a very thin collodion or Formvar, but more preferable are those formed on a rock salt support which will be removed via dissolution, or a film comprising only carbon which is prepared by removing the foregoing organic film in an organic solvent or by means of ion etching. The acceleration voltage of the TEM is preferably 80–400 kV but more preferably 80–200 kV.

As for other details of electron microscopic observation techniques and sample preparation techniques please refer to "Medical•Biological Electron Microscopic Observation Methods", edited by The Society of Electron Microscopy of Japan, Kanto Branch (published by Maruzen Co., Ltd.), and "Electron Microscopic Biological Sample Preparation Methods" edited by Japanese Society of Electron Microscopy, Kanto Branch (published by Maruzen Co., Ltd.).

With respect to a TEM image recorded on an appropriate medium, one image is composed of at least 1,024×1,024 pixels but preferably 2,048×2,048 pixels to enable image processing via a computer. To perform the image processing, an analogue image recorded on a film is converted to a digital image, which is preferably subjected to such as shading correction and contrast-edge enhancement as necessary. Thereafter, a histogram is formed and the points corresponding to silver aliphatic carboxylate are extracted via binarization.

The thickness of silver aliphatic carboxylate particles extracted above is manually measured of not less than 300 random particles by use of appropriate software to determine the average value.

A method to obtain silver aliphatic carboxylate particles provided of the above desired shape is not specifically limited, for example, it is effective to maintain the mixing state during formation of an organic alkali metal soap, or the mixing state during addition of silver nitrate to the soap, under appropriate conditions; or to set the ratio of organic acid to the soap, being an optimal ratio of silver nitrate which reacts with the soap.

In this invention, tabular silver aliphatic carboxylate grains (which refers to silver aliphatic carboxylate particles having an average equivalent circle diameter between 0.05–0.8 μm and an average thickness between 0.005–0.07 μm) is preferably dispersed and appropriately ground by such as a media homogenizer or a high pressure homogenizer after having been pre-dispersed together with such as a binder or a surfactant. As methods for the above-described pre-dispersion, for example, general stirrers such as of an anchor type or a propeller type, a high speed rotational centrifugal radial stirrer (dissolver), and a high speed rotational shared type stirrer (homo-mixer) may be employed.

Further, as the above-described media homogenizers, for example, tumbling mills such as a ball mill, a planetary ball mill, a vibratory ball mill, medium stirring mills such as a bead mill and an atliter, as well as a basket mill may be employed. As a high pressure mill, employed may be various types such as one in which a liquid collides against a wall or a plug, one in which a liquid is divided into plural portions to collide against each other, and a type in which a liquid is forced through a narrow orifice.

Specifically preferable ceramics employed as ceramics beads for media dispersion is yttrium stabilized zirconia or zirconia reinforced almina (hereinafter, these ceramics containing zirconia are abbreviated as zirconia) because these generate a minimum amount of impurity due to friction with beads and a homogenizer during dispersion.

In equipment employed during dispersion of the tabular silver halide aliphatic carboxylate particles of this invention, preferably employed as material of the parts, which silver halide aliphatic carboxylate particles contact, are ceramics such as zirconia, alumina, silicon nitride and boron nitride, or diamond, of which most preferable is zirconia. During the above dispersion, the binder concentration is preferably 0.1–10% based on the total weight of silver halide aliphatic carboxylate particles, and during which the solution temperature is preferably less than 45° C. throughout the process, from pre-dispersion to primary dispersion. Further, as preferable operation conditions of the primary dispersion, for example, in the case of employing a high pressure homogenizer as a dispersion means, operation conditions of 29–100 MPa and at least two operation steps are preferable. Further, if employing a media homogenizer as a dispersion means, preferred conditions include a circumferential rate of 6–13 m/sec.

In this invention, photo-insensitive silver halide aliphatic carboxylate particles, preferably have been formed in the presence of a compound which functions as a crystal growth restrainer or a dispersant. Further, a compound which functions as a crystal growth restrainer or a dispersant is preferably an organic compound provided with a hydroxyl group or a carboxyl group.

In this invention, a compound which functions as a crystal growth restrainer or a dispersant refers to a compound provided with a function or effect to result in a smaller particle diameter or a higher mono-dispersibility, when silver halide aliphatic carboxylate grains are manufactured in the presence of the compound than when without the presence of the compound in the manufacturing process of silver halide aliphatic carboxylate grains. Specific examples include alcohols having a carbon number of less than 10 and preferably are secondary alcohols, tertiary alcohols, glycols such as ethylene glycol and propyrene glycol, polyethers such as polyethylene glycol, and glycerins. The preferable addition amount is 10–200 weight % of all silver halide aliphatic carboxylate particles.

On the other hand, also pereferred are branched aliphatic carboxylic acids, each including isomers, such as isoheptanoic acid, isodecanoic acid, isotridecanoic acid, isomyristinic acid, isopalmitic acid, isostearic acid, isoarachidinic acid, isobehenic acid and isohexasanoic acid. In this case, preferable side chains include alkyl groups or alkenyl groups having a maximum carbon number of 4. Further, listed are aliphatic unsaturated carboxylic acids such as palmitoleic acid, oleic acid, linolic acid, linolenic acid, moroctic caid, eicosenoic acid, arachidonic acid, eicosapentaenoic acid, erucic acid, docosapentaenoic acid, docosahexaenoic acid and selacholenoic acid. The preferable addition amount of silver aliphatic carboxylate is 0.5–0.10 mol %.

Also listed as preferable compounds are glycocides such as glucocide, galactocide and fructocide; trehalose type disaccharides such as trehalose and sucrose; polysaccharides such as glycogen, dextrine, dextrane and alginic acid; cellosolves such as methylcellosolve and ethylcellosolve; water-soluble organic solvents such as sorbitane, sorbite, ethyl acetate, methyl acetate and dimethylformamide; and water-soluble polymers such as polyvinyl alcohol, polyacrylic acid, acrylic acid copolymers, maleic acid copolymers, carboxymethyl cellulose, hydroxypropyl cellulose, hydroxypropylmethyl cellulose, polyvinyl pyrrolidone and gelatin. The preferable addition amount is 0.1–20 weight % compared to silver aliphatic carboxylate.

Alcohols having a maximum carbon number of 10, preferably including secondary alcohols such as isopropylalcohol and tertiary alcohols such as t-butylalcohol, increase solubility of alkali metal aliphatic carboxylate to reduce viscosity and to enhance stirring efficiency, resulting in promotion of mono-dispersibility and smaller diameter particles. Since branched aliphatic carboxylic acid silver salts and unsaturated aliphatic carboxyliac acid silver salts are provided with steric hindrance higher than straight chain aliphatic carboxylic acid silver salts, which is a primary component during crystallization of silver aliphatic carboxylate; and disorder of the crystal lattice increases hindering production of large crystals, resulting in a reduced particle diameter.

Antifoggant and Image Stabilizer

Antifoggants and image stabilizers employed in the silver salt photothermographic dry imaging material of this invention will now be specifically described.

In the silver salt photothermographic dry imaging material of this invention, preferably contained are at least two types of compounds which generate, via radiation of UV or visible light, reactive species capable of oxidizing silver or compounds which generate, via radiation of UV or visible light, reactive species capable of deactivating the reducing agent to render it unable to reduce silver.

In the silver salt photothermographic dry imaging material of this invention, preferably incorporated as reducing agent of silver ions, are primarily bisphenols as described below, and a compound, which can deactivate this reducing agent during storage of the imaging material and during storage after thermal development. Preferable is a compound, which prevents generation of phenoxy radicals from the reducing agent, or a compound, which traps and stabilizes the phenoxy radicals generated not to function as a reducing agent of silver. As suitable compounds provided with such an effect•function include non-reducible compounds provided with a group which can form a hydrogen bond with a hydroxyl group of the bisphenols, for example, compounds provided with a phosphoryl group, a sulfoxide group, a sulphonyl group, a carbonyl group, an amide group, an ester group, a urethane group, a ureido group, a tertiary amino group and a nitrogen-containing aromatic group. Specifically preferable are compounds provided with a sulfonyl group, a sulfoxide group and a phophoryl group. Specific examples are disclosed in, for example, JP-A Nos. 6-208192, 2001-215648, 2001-350235, 2002-6444 and 2002-18264. Further, compounds provided with a vinyl group are disclosed in, for example, Japanese Translation of PCT International Application Publication No. 2000-515995, and JP-A Nos. 2002-207273 and 2003-140298.

Compounds capable of oxidizing silver (metallic silver), can be employed in combination, such as a compound which can release a halogen radical capable of oxidizing or interacting with silver to form a complex, resulting in oxidation of silver. Specific examples of these compounds are disclosed in JP-A Nos. 50-120328, 59-57234, 4-232939, 6-208193, 7-2781 and 10-197989; and U.S. Pat. No. 5,460,938. Particularly, in the imaging material of this invention, examples of preferable compounds include halogen radical releasing compounds represented by Formula (OFI) described below.

$$Q_2—Y—C(X_1)(X_2)(X_3) \qquad \text{Formula (OFI)}$$

In Formula (OFI), $Q_2$ is an aryl group or a heterocyclic group, $X_1$, $X_2$, and $X_3$ are each a hydrogen atom, a halogen atom, an acyl group, an alkoxycarbonyl group, an aryoxycarbonyl group, a sulfonyl group or an aryl group, at least one of which is a halogen atom, and Y is —C(═O)—, —SO— or —$SO_2$—.

An aryl group represented by $Q_2$ may be either a monocyclic or condensed cyclic group, preferably a monocyclic or bicyclic aryl group (such as phenyl and naphthyl) having preferably a carbon number of preferably 6–30 but more preferably being the phenyl group.

Heterocyclic groups represented by $Q_2$ may be saturated or unsaturated 3- to 10-membered heterocyclic groups provided with at least one atom of N, O or S, and these may be monocyclic or form a condensed ring in conjunction with another ring.

Heterocyclic groups are preferably 5- or 6-membered unsaturated heterocyclic groups which may be provided with a condensed ring, more preferably 5- or 6-membered aromatic heterocyclic groups and specifically preferably 5- or 6-membered aromatic heterocyclic groups which may be provided with a condensed ring containing a nitrogen atom. Hetero rings in these heterocyclic groups are preferably imidazole, pyrazole, pyridine, pyrimidine, pyradine, pyridazine, triazole, triazine, indole, indazole, purine, thiadiazole, oxadiazole, quinoline, phthalazine, naphthylizine, quinoxaline, quinazoline, cinnoline, pteridine, acridine, phenanthroline, phenazine, tetrazole, thiazole, oxazole, benzimidazole, benzoxazole, benzthiazole, indolenine or tetrazaindene; are more preferably imidazole, pyridine, pyrimidine, pyradine, pyridazine, triazole, triazine, thiadiazole, oxadiazole, quinoline, phthalazine, naphthylizine, quinoxaline, quinazoline, cinnoline, tetrazole, thiazole, oxazole, benzimidazole, benzoxazole, benzthiazole or tetrazaindene; are furthermore preferably imidazole, pyridine, pyrimidine, pyradine, pyridazine, triazole, triazine, thiadiazole, quinoline, phthalazine, naphthylizine, quinoxaline, quinazoline, cinnoline, tetrazole, thiazole, benzimidazole or benzthiazole; but are specifically preferably pyridine, thiadiazole, quinoline or benzthiazole.

Aryl groups and heterocyclic groups represented by $Q_2$ may be provided with a substituent other than —Y—C($X_1$)($X_2$)($X_3$), preferable substituents of which are an alkyl group, an alkenyl group, an aryl group, an alkoxy group, an aryloxy group, an acyloxy group, an acyl group, an alkoxycarbonyl group, an aryloxycarbonyl group, an acyoxy group, an acylamino group, an alkoxycarbonylamino group, an aryloxycarbonylamino group, a sulfonylamino group, a sulfamoyl group, a carbamoyl group, a sufonyl group, an ureido group, a phosphoric amido group, a halogen atom, a cyano group, a sulfo group, a carboxyl group, a nitro group or a hetero cyclic group; more preferable are an alkyl group, an aryl group, an aryloxy group, an acyl group, an acylamino group, an alkoxycarbonylamino group, an aryloxycarbonylamino group, a sulfonylamino group, a sulfamoyl group, a carbamoyl group, an ureido group, a phosphoric amido group, a halogen atom, a cyano group, a nitro group or a hetero cyclic group; furthermore preferable are an alkyl group, an aryl group, an alkoxy group, an aryloxy group, an acyl group, an acylamino group, a sulfonylamino group, a sulfamoyl group, a carbamoyl group, a halogen atom, a cyano group, a nitro group or a hetero cyclic group; but specifically preferable are an alkyl group, an aryl group or a halogen atom.

$X_1$, $X_2$, and $X_3$ are each preferably a halogen atom, a haloalkyl group, an acyl group, an alkoxycarbonyl group, an aryloxycarbonyl group, a carbamoyl group, a sulfamoyl group, a sulfonyl group or heterocyclic group; more preferably a halogen atom, a haloalkyl group, an acyl group, an alkoxycarbonyl group, an aryloxycarbonyl group or a sulfonyl group; furthermore preferably are a halogen atom or a trihalomethyl group; but specifically preferable is a halogen atom. Among halogen atoms, preferable are a chlorine atom, a bromine atom or an iodine atom, furthermore preferable atoms are: chlorine or bromine, of which specifically preferable is a bromine atom.

Y is —C(═O)—, —SO— or —$SO_2$—, and preferably —$SO_2$—.

The addition amount of these compounds is preferably $1\times10^{-4}$–1 mol but more preferably $1\times10^{-3}$–$5\times10^{-2}$ mol compared to 1 mol of silver.

Herein, in an imaging material of this invention, the compounds disclosed in JP-A No. 2003-5041 can be similarly employed as those represented by above formula (OFI).

In the following, specific examples of compounds represented by formula (OFI) will be listed, however, this invention is not limited thereto.

OFI-1

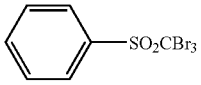

OFI-2

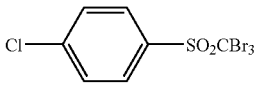

OFI-3

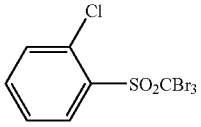

OFI-4

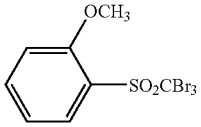

OFI-5

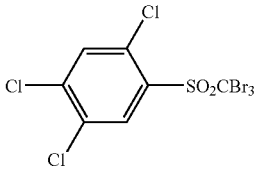

OFI-6

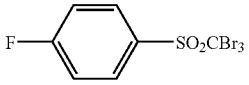

OFI-7

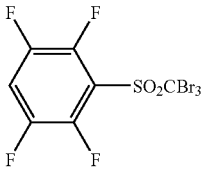

-continued

OFI-8

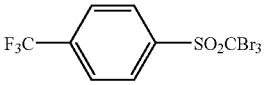

OFI-9

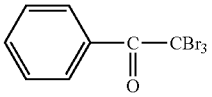

OFI-10

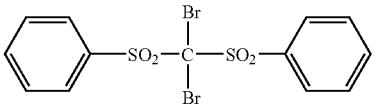

OFI-11

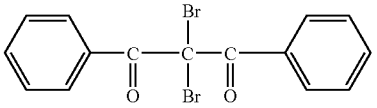

OFI-12

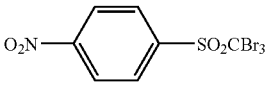

OFI-13

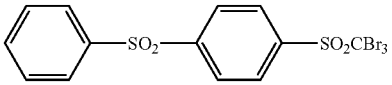

OFI-14

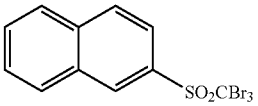

OFI-15

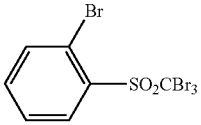

OFI-16

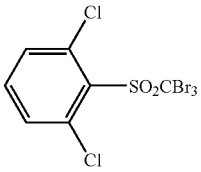

OFI-17

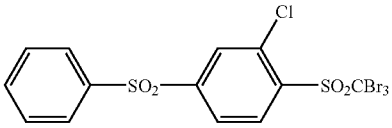

OFI-18

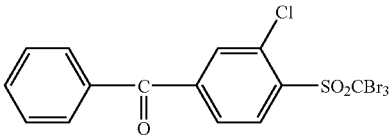

OFI-19

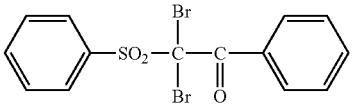

OFI-20

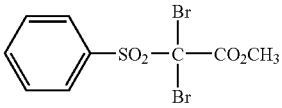

-continued
OFI-21
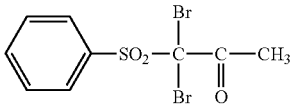
OFI-22
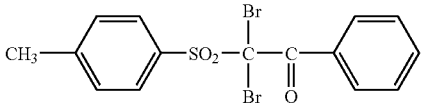
OFI-23
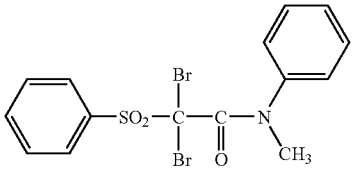
OFI-24
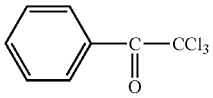
OFI-25
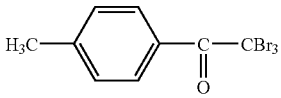
OFI-26
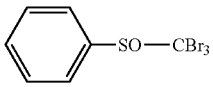
OFI-27
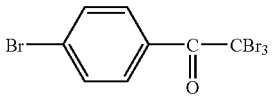
OFI-28
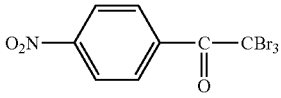
OFI-29
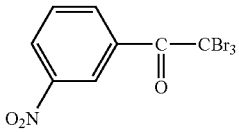
OFI-30
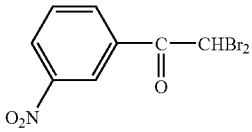
OFI-31
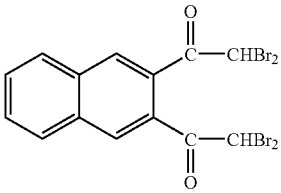
OFI-32
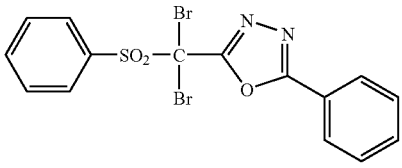
-continued
OFI-33
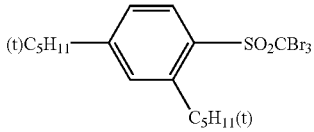
OFI-34
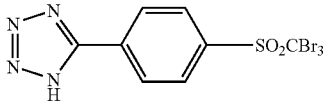
OFI-35
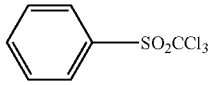
OFI-36
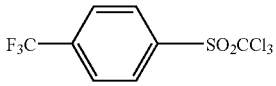
OFI-37
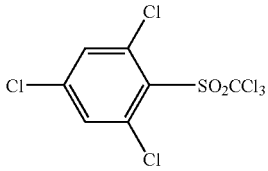
OFI-38
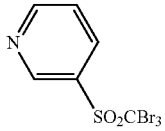
OFI-39
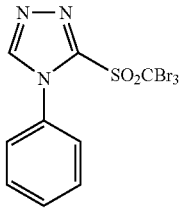
OFI-40
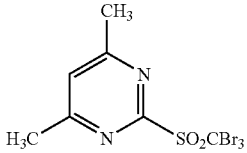
OFI-41
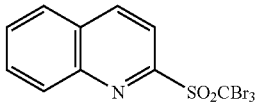
OFI-42
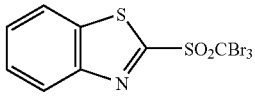
OFI-43
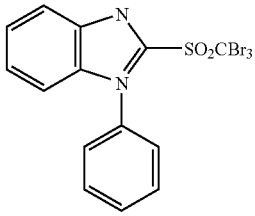

-continued
OFI-44
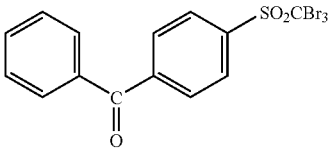
OFI-45
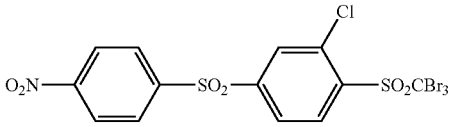
OFI-46
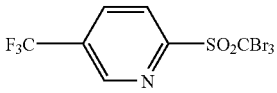
OFI-47
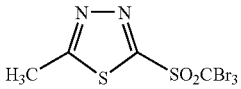
OFI-48
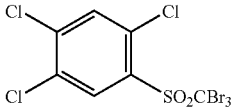
OFI-49
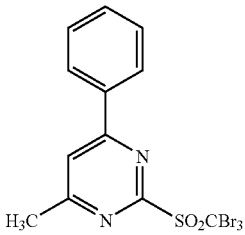
OFI-50
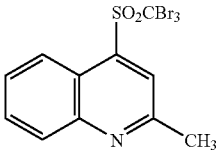
OFI-51
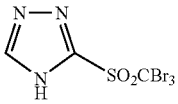
OFI-52
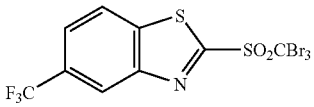
OFI-53
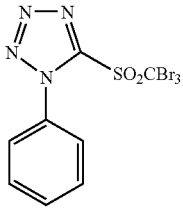
-continued
OFI-54
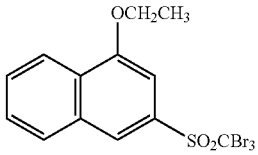
OFI-55
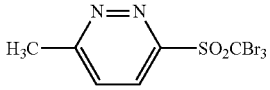
OFI-56
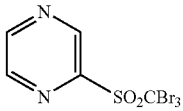
OFI-57
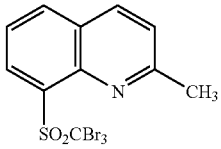
OFI-58
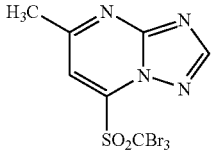
OFI-59
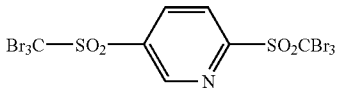
OFI-60
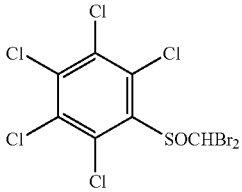
OFI-61
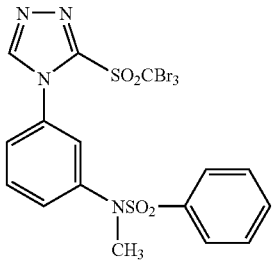
OFI-62
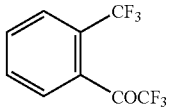
OFI-63
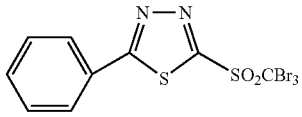

-continued

OFI-64

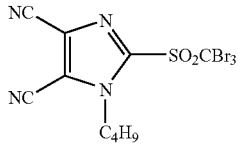

Polymer PO Inhibitor

Further, in the imaging material of this invention, preferably employed with respect to making high sensitivity and higher CP in addition to further stabilization of a silver image, is a polymer having at least one repeating unit of a monomer provided with a halogen radical releasing group as disclosed in JP-A No. 2003-91054. Specifically, an unexpectedly excellent result is obtained via photothermographic imaging material of this invention.

In the following, specific examples of polymers provided with a halogen radical releasing group are listed, however, this invention is not limited thereto.

XP1

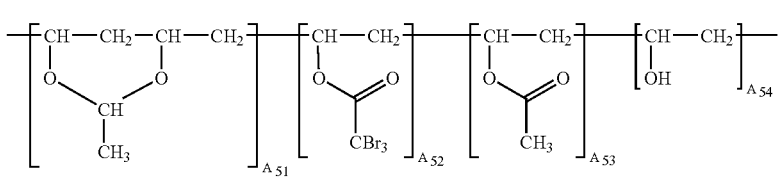

Number average molecular weight: 20,000
Composition (weight %): $A_{51}/A_{52}/A_{53}/A_{54}$=70/22/2/6

XP2

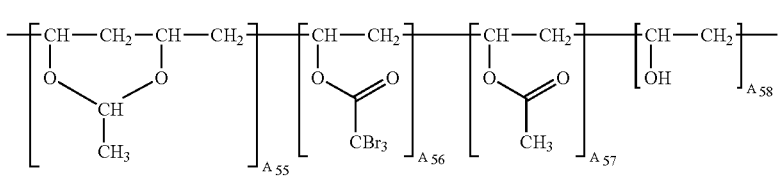

Number average molecular weight: 60,000
Composition (weight %): $A_{55}/A_{56}/A_{57}/A_{58}$=65/29/0.5/5.5

XP3

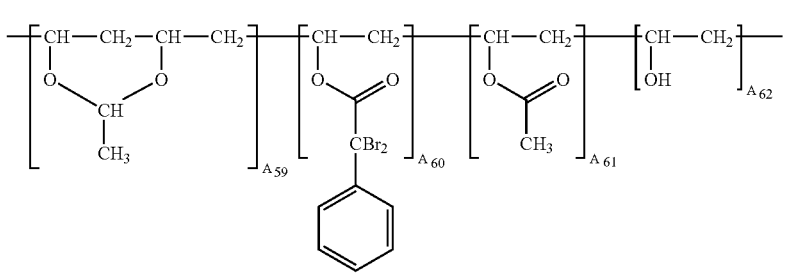

Number average molecular weight: 30,000
Composition (weight %): $A_{59}/A_{60}/A_{61}/A_{62}$=52/40/4/4

XP4

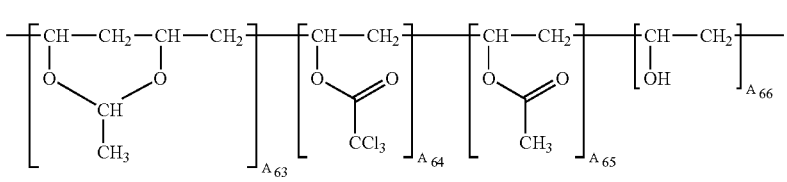

Number average molecular weight: 30,000
Composition (weight %): $A_{63}/A_{64}/A_{65}/A_{66}$=57/39/2/2

XP5
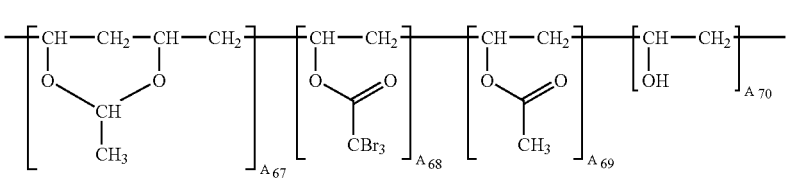
Number average molecular weight: 100,000
Composition (weight %): $A_{67}/A_{68}/A_{69}/A_{70}$=60/33/2/2.5
XP6
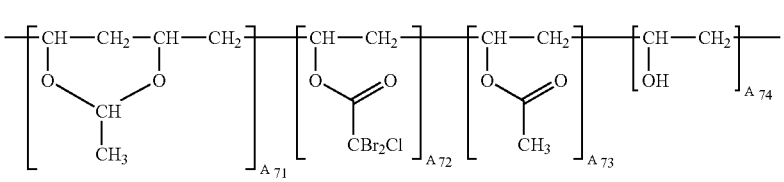
Number average molecular weight: 25,000
Composition (weight %): $A_{71}/A_{72}/A_{73}/A_{74}$=80/12/2/6
XP7
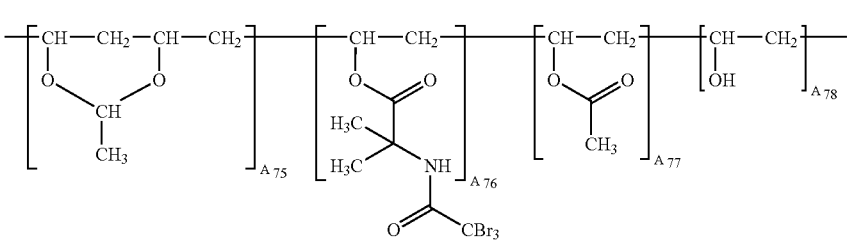
Number average molecular weight: 20,000
Composition (weight %): $A_{75}/A_{76}/A_{77}/A_{78}$=78/21/2/6
XP8
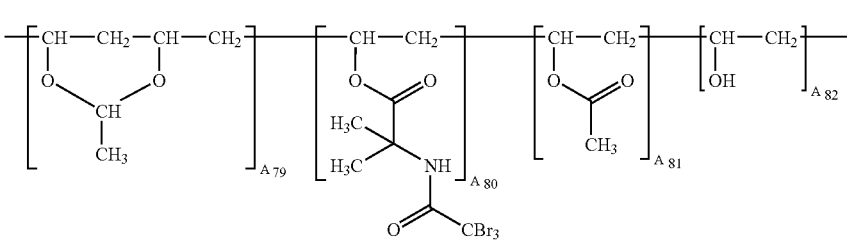
Number average molecular weight: 60,000
Composition (weight %): $A_{79}/A_{80}/A_{81}/A_{82}$=70/25/1/4

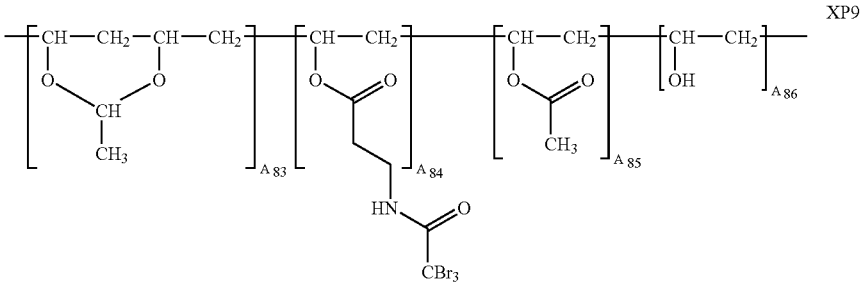

XP9

Number average molecular weight: 100,000

Composition (weight %): $A_{83}/A_{84}/A_{85}/A_{86}$=76/23/0.5/0.5

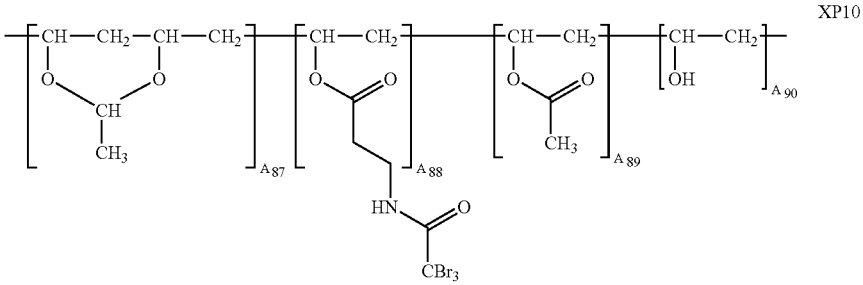

XP10

Number average molecular weight: 27,000

Composition (weight %): $A_{87}/A_{88}/A_{89}/A_{90}$=71/20/3/6

Herein, other than the above compounds, compounds which are conventionally known as antifoggants may be contained in the silver salt photothermographic dry imaging material of this invention. For example, listed are compounds described in U.S. Pat. Nos. 3,589,903, 4,546,075, 3,874,946, 4,452,885 and 4,756,999, and JP-A Nos. 59-57234, 9-288328 and 9-90550. Further, other antifoggants include compounds disclosed in U.S. Pat. No. 5,028,523, and European Pat. Nos. 600,587, 605,981 and 631,176.

Polycarboxyl Compounds

In an imaging material of this invention, a compound represented by following formula (PC) is also preferably employed as an antifoggant and storage stabilizer of the material.

$$R—(CO—O—M)_n \qquad \text{Formula (PC)}$$

wherein, R is an atom which is connectable, an aliphatic group, an aryl group, a heterocyclic group, or an atomic group which can form a ring by bonding to each other, M is a hydrogen atom, a metal atom, a quaternary ammonium group or a sulfonium group, while n is an integer of 2–20.

Connectable atoms represented by R in foregoing Formula (PC) include atoms such as nitrogen, oxygen, sulfur and phosphor.

Aliphatic groups represented by R include straight chain or branched chain alkyl, alkenyl, alkynyl or cycloalkenyl groups having a carbon number of 1–30 but preferably of 1–20. Specifically, listed is each group of such as methyl, ethyl, propyl, butyl, hexyl, decyl, dodecyl, isopropyl, t-butyl, 2-ethylhexyl, aryl, 2-butenyl, 7-octenyl, propalgyl, 2-butynyl, cyclopropyl, cyclopentyl, cyclohexyl and cyclododecyl.

Aryl groups represented by R include those having a carbon number of 6–20, and specifically, listed are groups such as phenyl, naphtyl or anthranyl.

Heterocyclic groups represented by R may be a monocyclic ring or a condensed ring and include 5- or 6-membered heterocyclic groups provided with at least one of O, S and N atoms and an amineoxide group in the ring. Specific examples include pyrrolidine, piperidine, tetrahydrofuran, tetrahydropyran, oxyrane, morphorine, thiomorphorine, thiopyrane, tetrahydrothiophene, pyrrole, pyridine, furan, thiophene, imidazole, pyrazol, oxazole, thiazole, isooxazole, isothiazole, triazole, tetrazole, thiadiazole and oxadiazole; and groups derived from above benzologues.

In the case that R is formed of $R_1$ and $R_2$, $R_1$ and $R_2$ are identical to R, and $R_1$ and $R_2$ may be the same or different. Rings formed by $R_1$ and $R_2$ include 4- to 7-membered rings and preferably 5- to 7-membered rings. Preferable groups as $R_1$ and $R_2$ are aromatic groups and heterocyclic groups. Aliphatic groups, aromatic groups or heterocyclic groups represented by $R_1$ and $R_2$ may be further substituted by a substituent, including such as: halogen atoms (e.g. a chlorine atom and a bromine atom), alkyl groups (e.g. a methyl group, an ethyl group, an isopropyl group, a hydroxyethyl group, a methoxymethyl group, a trifluoromethyl group and a t-butyl group), cycloalkyl groups (e.g. cyclopentyl group and a cyclohexyl group), aralkyl groups (e.g. a benzyl group and a 2-phenetyl group), aryl groups (e.g. a phenyl group, a naphthyl group, a p-tolyl group and a p-chlorophenyl group), alkoxy groups (e.g. a methoxy group, an ethoxy group, an isopropoxy group and a butoxy group), aryloxy groups (e.g. a phenoxy group and a 4-methoxyphenoxy group), a cyano group, acylamino groups (e.g. an acetylamino group and a propionylamino group), alkylthio groups (e.g. a methylthio group, an ethylthio group and a butylthio group), arylthio groups (e.g. a phenylthio group and a p-methylpentylthio group), sulfonylamino groups (e.g. a methanesulfonylamino group and a benzenesulfonylamino group), ureido groups (e.g. a 3-methylureido group, a 3,3-dimethylureido group and a 1,3-dimethylureido group), sulfamoylamino groups (e.g. a dimethylsulfamoylamino group and diethylsulfamoylamino group), carbamoyl groups (e.g. a methylcarbamoyl group, an ethylcarbamoyl group and a dimethylcarbamoyl group), sulfamoyl groups (e.g. an ethylsufamoyl group and a dimethylsulfamoyl group), alkoxycarbonyl groups (e.g. a methoxycarbonyl group and an ethoxycarbonyl group), aryloxycarbonyl groups (e.g. a phenoxycarbonyl group and a chlorophenoxycarbonyl group), sulfonyl groups (e.g. a methanesulfonyl group, a butanesulfonyl group and a phenylsulfonyl group), acyl groups (e.g. an acetyl group, a propanoyl group and a butyloyl group), amino groups (e.g. a methylamino group, an ethylamino group and a dimethylamino group), a hydroxyl group, a nitro group, a nitroso group, amineoxide groups (e.g. pyridine-oxide group), imido groups (such as phthalimido group), disulfide groups (e.g. a benzenedisulfide and a benzthiazolyl-2-disulfide group), and heterocyclic groups (e.g. a pyridyl group, a benzimidazolyl group, a benzthiazolyl group and a benzoxazolyl group). $R_1$ and $R_2$ may be provided with a single or a plural number of these substituents. Further, each substituent may also be substituted by the above substituents. Still further, $R_1$ and $R_2$ may be the same or different. Yet further, it is also effective that formula (PC-1) is an oligomer or a polymer $(R—(COOM)_{n0})_m$, while n is preferably an integer of 2–20 and m is 1–100, or the molecular weight is at most 50,000.

Further, an acid anhydride of formula (PC-1) refers to a compound which is formed by a dehydration reaction from two carboxyl groups of a compound represented by formula (PC-1). Compounds provided with 3–10 carboxyl groups and acid anhydrides as derivatives thereof are preferable.

Further, dicarboxylic acids, which are described in JP-A Nos. 58-95338, 10-288824, 11-174621, 11-218877, 2000-10237, 2000-10236, 2000-10235, 2000-10233, 2000-10232 and 2000-10231, in combination may also be employed.

Thiosulfonic Acid Restrainer

In an imaging material of this invention, compounds represented by following formula (ST) are preferably incorporated.

$$Z—SO_2.S—M \qquad \text{Formula (ST)}$$

wherein Z is a substituted or unsubstituted alkyl group, aryl group or heterocyclic group, and M is a metal atom or an organic cation.

In compounds represented by formula (ST), alkyl groups, aryl groups, heterocyclic groups, aromatic rings and hetero rings, which are represented by Z, may be substituted. Substituents include lower alkyl groups such as a methyl group and an ethyl group, aryl groups such as a phenyl group, alkoxy groups having a carbon number of 1–8, halogen atoms such as chlorine, a nitro group, an amino group or a carboxyl group. Heterocyclic groups represented by Z include thiazole, benzthiazole, imidazole, benzimidazole and oxazole. Metal atoms represented by M are preferably alkali metal atoms such as a sodium ion or a potassium ion, and organic cations are preferably such as an ammonium ion or a guanidine group.

Specific examples of compounds represented by formula (ST) include the following, however, this invention is not limited thereto.

(ST-1) $CH_3SO_2SNa$ (ST-2) $C_2H_5SO_2SNa$ (ST-3) $HOOC—CH_2CH_2SO_2SK$ (ST-4) $(n)C_4H_9SO_2SNa$ (ST-5) $NC—CH_2CH_2CH_2SO_2SNa$ (ST-6) $(n)C_8H_{17}SO_2SNa$ (ST-7) $(n)C_{12}H_{25}SO_2SNa$ (ST-8) $ClCH_2(CH_2)_4SO_2SK$ (ST-9) $(n)C_{18}H_{37}SO_2SNa$ (ST-10) $(n)C_4H_9SO_2SK$ (ST-11) $(n)C_8H_{17}SO_2SK$ (ST-12) $(CH_3)_2CHCH_2SO_2SNa$ (ST-13) $(CH_3)_2CHCH_2CH_2SO_2SNa$ (ST-14) 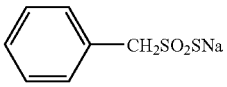

(ST-15) $(n)C_8H_{17}SO_2S^- \cdot (n)(C_4H_9)_4N^+$ (ST-16) $(n)C_8H_{17}SO_2S^- \cdot$ 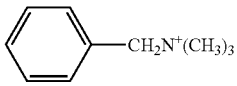

(ST-17) $H_2N—CH_2CH_2SO_2SH$ (ST-18) $CH_3O—CH_2CH_2SO_2SNa$ (ST-19) 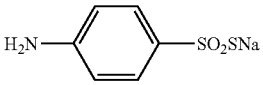

(ST-20) 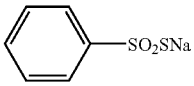

(ST-21) 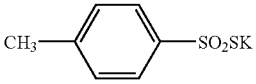

(ST-22) 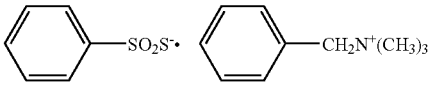

(ST-23) 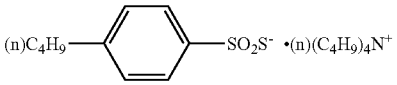

(ST-24) 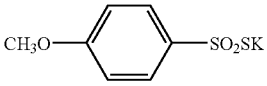

-continued (ST-25)

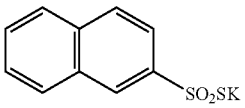

(ST-26)

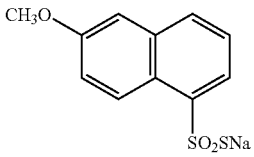

(ST-27)

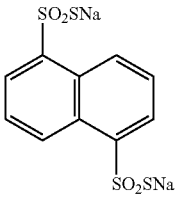

(ST-28)

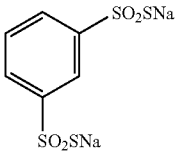

(ST-29)

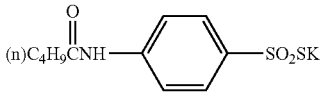

(ST-30)

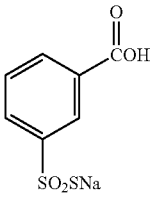

(ST-31)

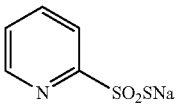

(ST-32)

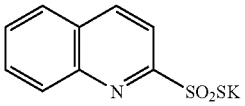

(ST-33)

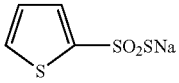

(ST-34)

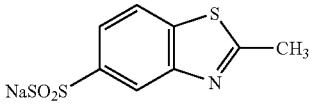

(ST-35)

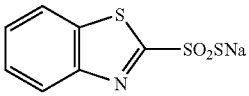

(ST-36)

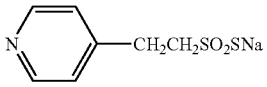

-continued (ST-37)

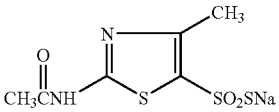

(ST-38)

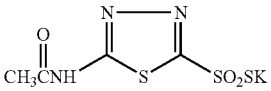

(ST-39)

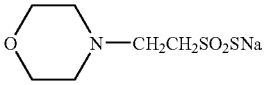

(ST-40)

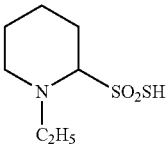

The compounds represented by formula (ST) can be synthesized by well known methods. For example, the compounds can be synthesized by a reaction method of a corresponding sulfonyl fluoride with sodium sulfide, or a reaction method of a corresponding sodium sulfonate with sulfur. These compounds are also readily available on the market.

The compound represented by formula (ST) is preferably added to the coating composition just before the coating, even though it may be added at any time during the production process before coating of the imaging material of this invention.

Though the added-amount of the compound represented by formula (ST) is not specifically limited, an amount from $1\times10^{-6}$–1 g per mole of the entire silver is preferable. Similar compounds are disclosed in JP-A 8-314059.

Vinyl Type Inhibitor Having Electron-Withdrawing Group

In this invention, a fog inhibitor represented by following formula (CV) is preferably employed in combination.

Formula (CV)

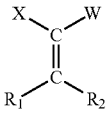

In formula (CV), the electron-withdrawing group represented by X is a substituent having a positive Hammett substituent group constant $\sigma_p$. Specific examples of the substituent include a substituted alkyl group such as a halogen substituted alkyl group; a substituted alkenyl group such as cyanovinyl group, a substituted or unsubstituted alkynyl group such as trifluoromethylacetylenyl group, cyanoacetylenyl group and formylacetylenyl group; a substituted aryl group such as a cyanophenyl group; a substituted or unsubstituted heterocyclic group such as a pyridyl group, a triazinyl group and a benzooxazolyl group; a halogen atom; a cyano group; an acyl group such as an acetyl group and a trifluoroacetyl group; a thioacyl group such as thioformyl group and thioacetyl group; an oxaryl group such as a methyloxaryl group; an oxyoxaryl group such as an ethoxaryl group; an —S-oxaryl group such as an ethylthiooxyaryl group; an oxamoyl group such as a methyloxamoyl group; an oxy carbonyl group such as an ethoxycarbonyl group and a carboxyl group; an —S-carbonyl group such as an ethylthiocarbonyl group; a carbamoyl group; a thiocarbamoyl group; a sulfonyl group; a sulfinyl group; an oxysulfonyl group such as ethoxysulfonyl group; an —S-sulfonyl group such as an ethylthiosulfonyl group; a sulfamoyl group; an oxysulfinyl group such as a methoxysulfinyl group; a sulfinamoyl group; a phosphoryl group; a nitro group; an imino group such as an imino group such as an N-methylimino group, an N-phenylimino group, an N-pyridylimino group, an N-cyanoimino group and an N-nitroimino group; an N-carbonylimino group such as an acetylimino group, an N-ethoxycarbonylimino group, an N-ethoxyarylimino group, an N-formylimino group, an N-trifluoroacetylimino group and an N-carbamoylimino group; an N-sulfonylimino group such as an N-methanesulfonylimino group, an N-trifluoromethanesulfonylimino group, an N-methoxysulfonylimino group and an N-sulfamoylimino group; an ammonium group; a sulfonium group; a phosphonium group; pyrylium group; and an immonium group. Examples of the substituent further include a heterocyclic-like group formed by combination with an ammonium group, a sulfonium group, a phosphonium group or an immonium group. Further, a formyl group is not included in the groups represented by X. The value of the $\sigma_p$ is preferably not more than 0.2 and more preferably not more than 0.3.

Examples of the group represented by W include a hydrogen atom; an alkyl group such as a methyl group, an ethyl group and a trifluoromethyl group; an alkenyl group such as a vinyl group, a halogen-substituted vinyl group and a cyanovinyl group; an alkynyl group such as an acetylenyl group and a cyanoacetylenyl group; an aryl group such as a phenyl group, a chorophenyl group, a nitrophenyl group, a cyanophenyl group and a pentafluorophenyl group; a heterocyclic group such as a pyridyl group, a pyrimidyl group, a pyrazinyl group, a quinoxalinyl group, a triazinyl group, a succinimido group, a tetrazolyl group, a triazolyl group, an imidazolyl group and a benzoxazolyl group; and those element described regarding X as above are such as a halogen atom, a cyano group, a thioacyl group, an oxalyl group, an oxyoxalyl group, an —S-oxalyl group, an oxamoyl group, an oxycarbonyl group, an —S-carbonyl group, a carbamoyl group, a thiocarbamoyl group, a sulfonyl group, a sulfinyl group, an oxysulfonyl group, an —S-sulfonyl group, a sulfamoyl group, an oxysulfinyl group, an —S-sulfinyl group, a sulfinamoyl group, a phosphoryl group, a nitro group, an imino group, an N-carbonylimino group, an N-sulfonylimino group, an ammonium group, a sulfonium group, a phosphonium group, a pyrylium group and an immonium group. However, W does not represent a formyl group.

As groups represented by W, are the electron-withdrawing groups having a positive $\sigma_p$ value, except a formyl group, of which the above described aryl groups and heterocyclic groups are preferable.

X and W may be bound together to form a condensed ring. The ring formed by X and W may be a saturated or unsaturated carbon ring, heterocyclic ring or cyclic ketone ring. The heterocyclic ring preferably contains one or more, but specifically 1 or 2 atoms selected from N, O and S.

$R_1$ may be a hydroxyl group, or an organic or inorganic salt of a hydroxyl group. Specific examples of the alkyl group, alkenyl group, aryl group and heterocyclic group include the alkyl group, alkenyl group, aryl group and heterocyclic group described as the examples of the group represented by W.

Further, in this invention, groups represented by X, W or $R_2$ may each have an anti-diffusion group. The anti-diffusion group is a so called ballast group in coupler in the field of photography and employed for making large the volume of a compound so that the added compound cannot move in the layer of the light-sensitive material.

Further, in this invention, the group represented by X, W or $R_2$ may contain a group to accelerate adsorption to silver salt crystals. Examples of such adsorption accelerating group include a thioamido group, an aliphatic mercapto group, an aromatic mercapto group, a heterocyclic mercapto group, and a 5 to 6-member heterocyclic ring, such as a benzotriazole ring, a triazole ring, a tetrazole ring, an indazole ring, a benzimidazole ring, an imidazole ring, a benzothiazole ring, a thiazole ring, a benzoxazole ring, an oxazole ring, a thiazole ring, a thiadiazole ring, an oxadiazole ring and a triazine ring.

In this invention, preferable are ones in which either X or W is a cyano group, or ones in which X and W form a cyclic structure by bonding.

Further, in this invention, preferable are compounds in which a thioether group (being —S—) is contained in the substituent represented by X, W or $R_2$.

Particularly preferred are compounds having an alkene group represented by the following formula (CV1) in the substituent represented by X, W or $R_2$.

$$—C(R)=C(Y)(Z) \qquad \text{Formula (CV1)}$$

In which, R is a hydrogen atom or a substituent, and Y and Z are each a hydrogen atom or a substituent and either Y or Z is an electron-withdrawing group.

Examples of the electron-withdrawing group represented by Y or Z are the foregoing electron-withdrawing groups represented by X or W and a formyl group.

Examples of X and W represented by formula (CV1) include the following groups.

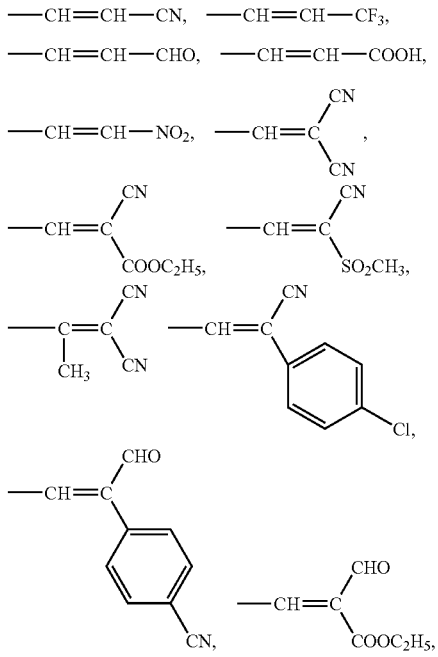

-continued

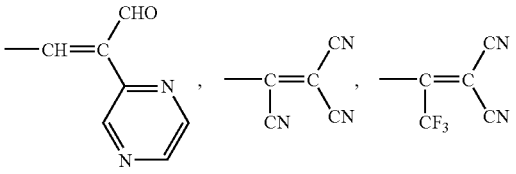

Also preferable are ones in which either X or W is the following alkyne group.

—C≡C—$R_5$ $R_5$ is a hydrogen atom or a substituent which is preferably an electron-withdrawing group such as those described as X and W. Examples of X and W represented by formula (CV1) include the following groups.

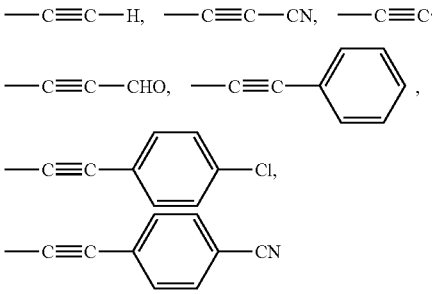

Further, also preferable are compounds in which either X or W is an acyl group selected from a substituted alkylcarbonyl group, an alkenylcarbonyl group and an alkynylcarbonyl group. Examples of such X and W are as follows.

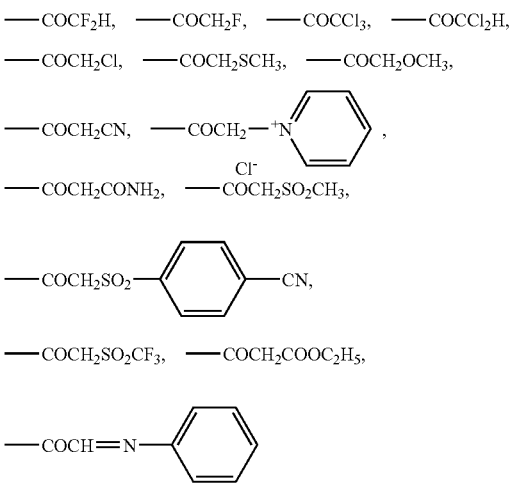

Further preferable are ones in which either X or W has an oxalyl group, examples follow.

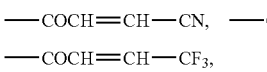

-continued

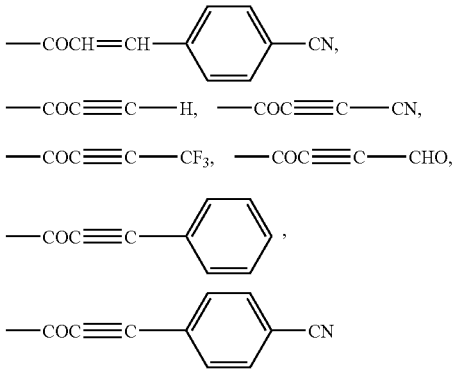

—$COCOCH_3$, —$COCOC_2H_5$, —$COCONHCH_3$, —$COCOSC_2H_5$, —$COCOOC_2H_4SCH_3$ and —$COCONHC_2H_4SCH_3$.

Preferable groups are ones in which either X or W is an aryl group or a nitrogen-containing heterocyclic group, each substituted by an electron-withdrawing group, examples of which are follow.

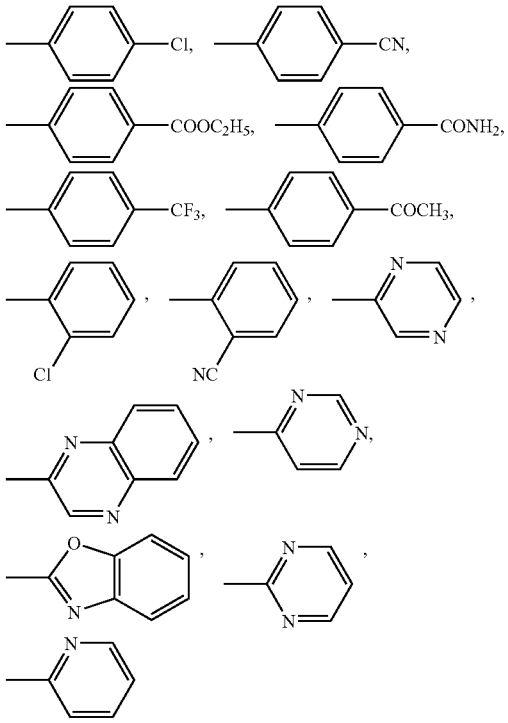

In this invention, the alkene compounds represented by formula (CV) include entire isomers when the compounds can be an isomeric structure with respect to a double bond in which X, W, $R_1$ and $R_2$ are substituted, and the compounds can be a tautomeric structure such as a keto-enol form.

Specific examples of the compounds represented by formula (CV) are shown below, however, the invention is not limited to these examples.

CV-1
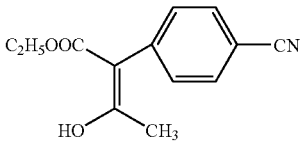
CV-2
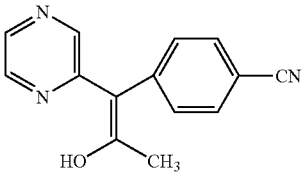
CV-3
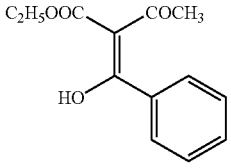
CV-4
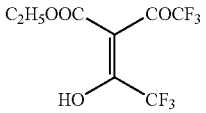
CV-5
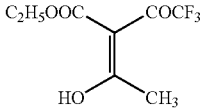
CV-6
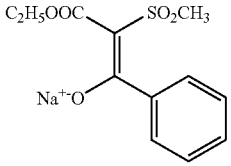
CV-7
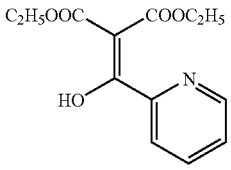
CV-8
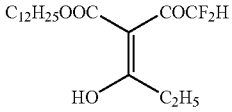
CV-9
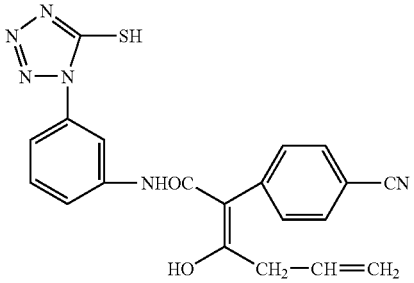
-continued
CV-10
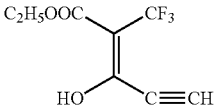
CV-11
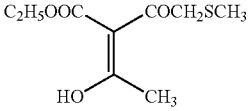
CV-12
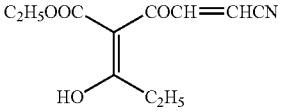
CV-13
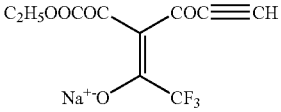
CV-14
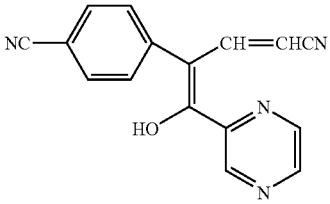
CV-15
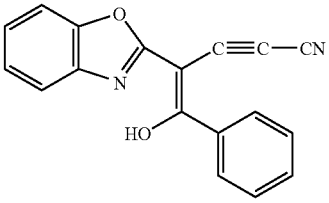
CV-16
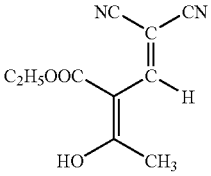
CV-17
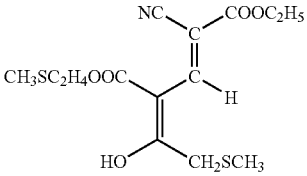
CV-18
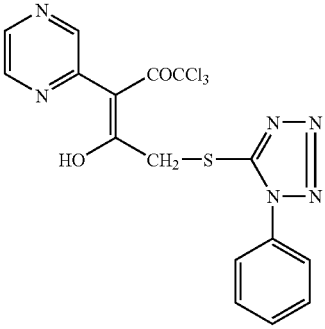

-continued
CV-19
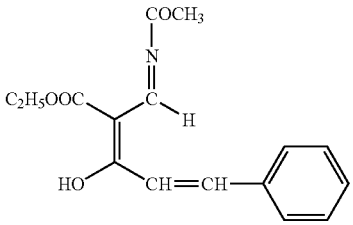
CV-20
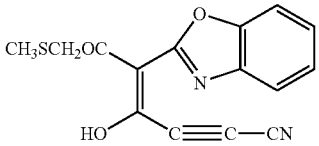
CV-21
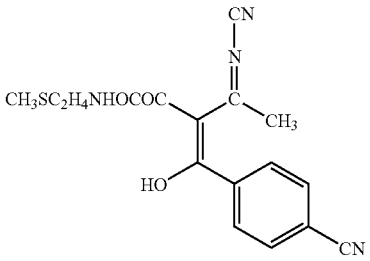
CV-22
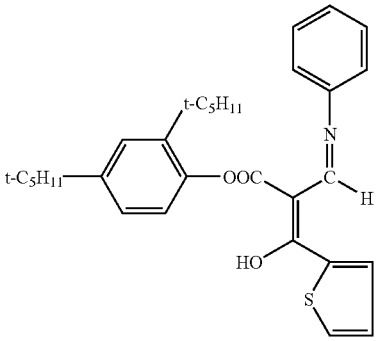
CV-23
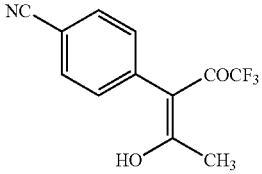
CV-24
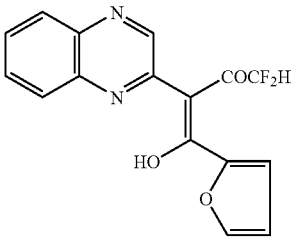
CV-25
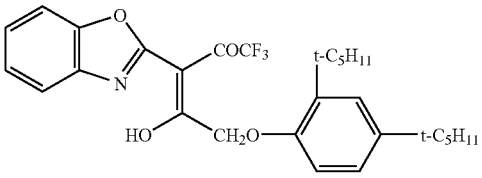
-continued
CV-26
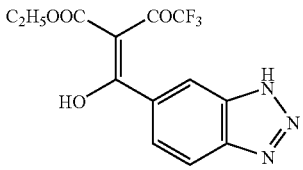
CV-27
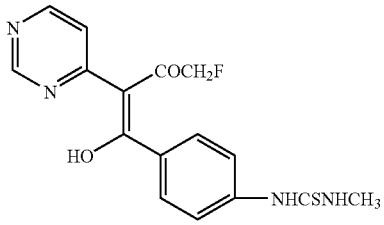
CV-28
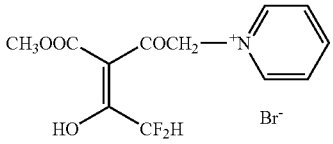
CV-29
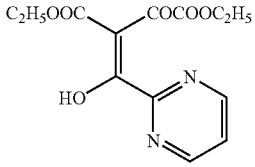
CV-30
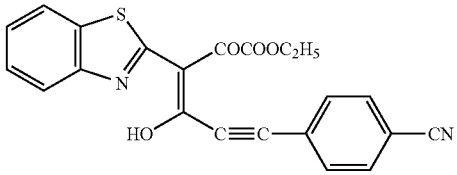
CV-31
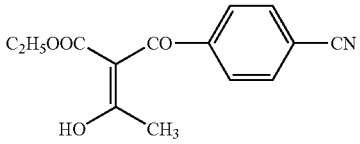
CV-32
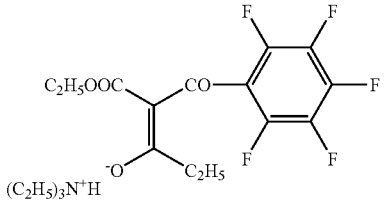
CV-33
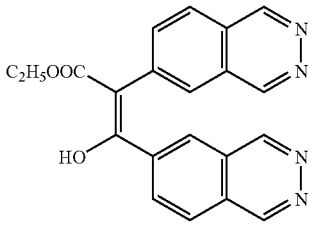

-continued
CV-34
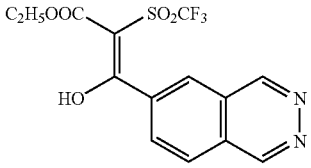
CV-35
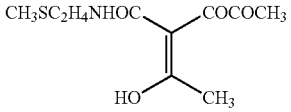
CV-36
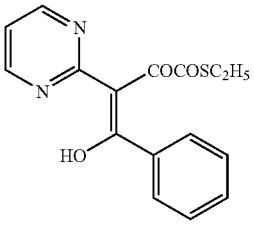
CV-37
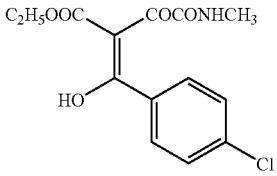
CV-38
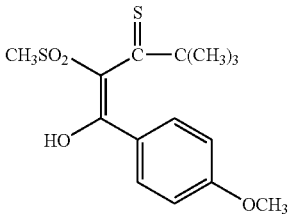
CV-39
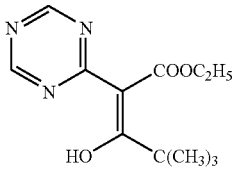
CV-40
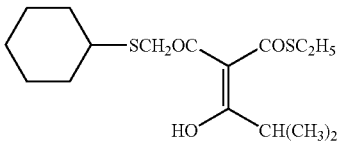
CV-41
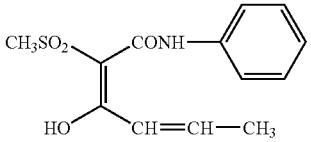
-continued
CV-42
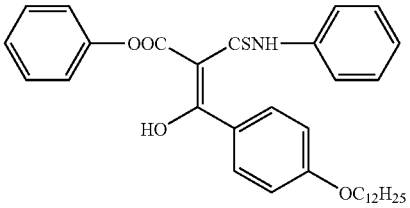
CV-43
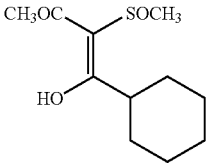
CV-44
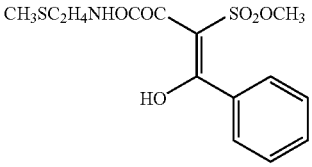
CV-45
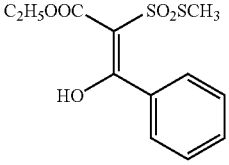
CV-46
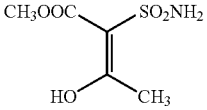
CV-47
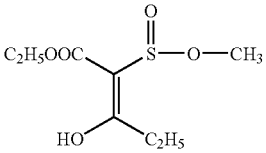
CV-48
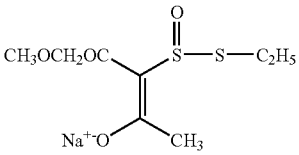
CV-49
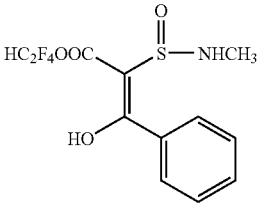
CV-50
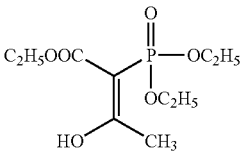

-continued
CV-51
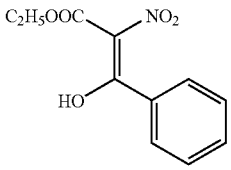
CV-52
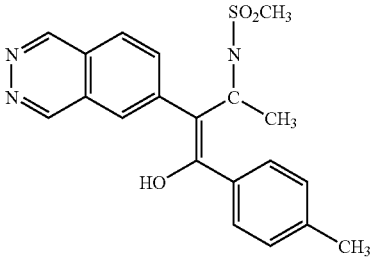
CV-53
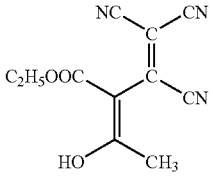
CV-54
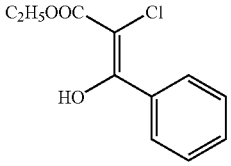
CV-55
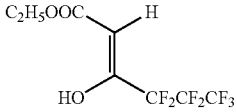
CV-56
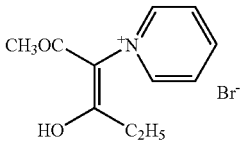
CV-57
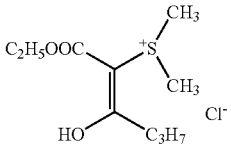
CV-58
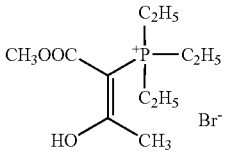
-continued
CV-59
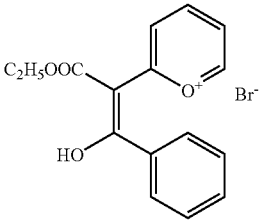
CV-60
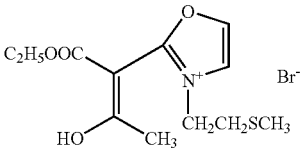
CV-61
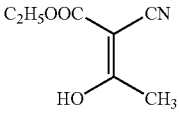
CV-62
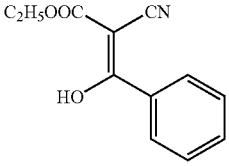
CV-63
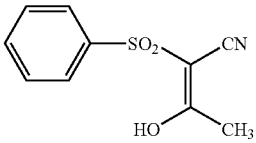
CV-64
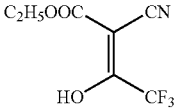
CV-65
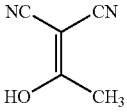
CV-66
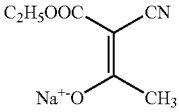
CV-67
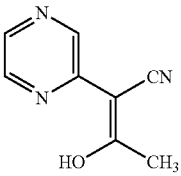
CV-68
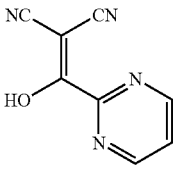

-continued
CV-69
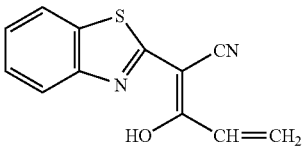
CV-70
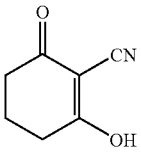
CV-71
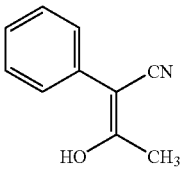
CV-72
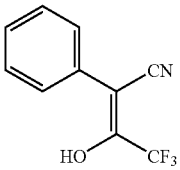
CV-73
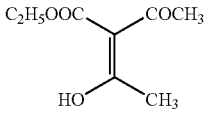
CV-74
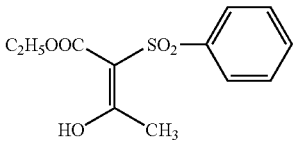
CV-75
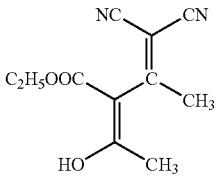
CV-76
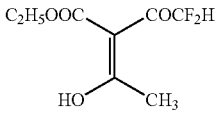
CV-77
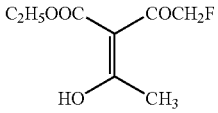
-continued
CV-101
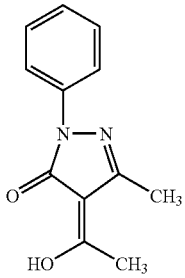
CV-102
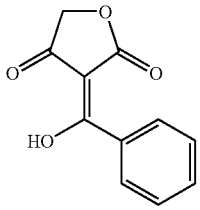
CV-103
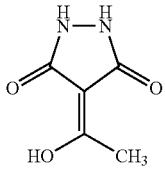
CV-104
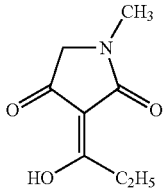
CV-105
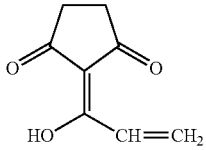
CV-106
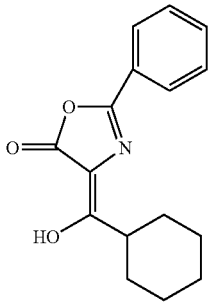
CV-107
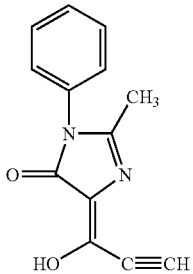

-continued
CV-108
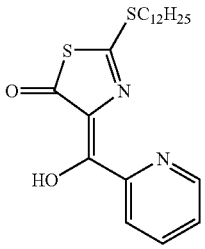
CV-109
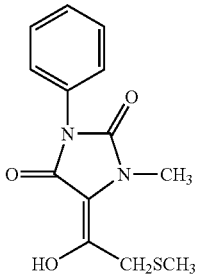
CV-110
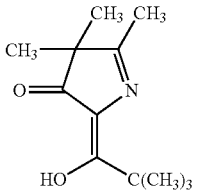
CV-111
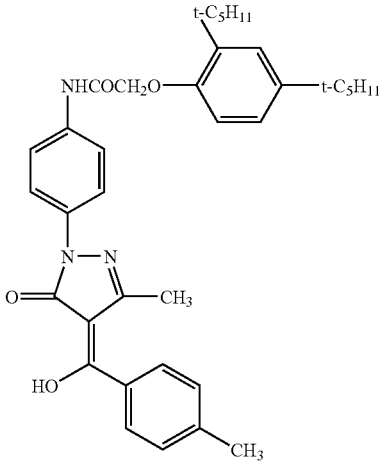
CV-112
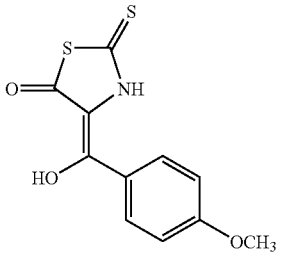
-continued
CV-113
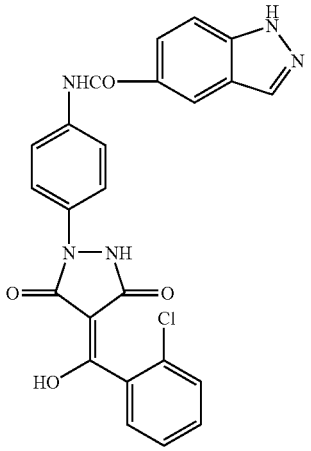
CV-114
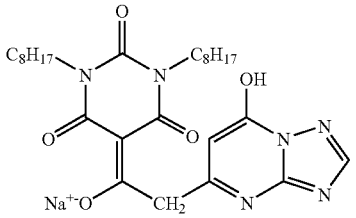
CV-115
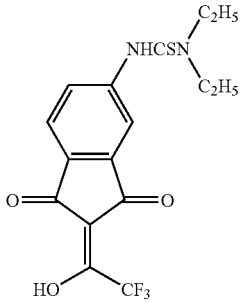
CV-116
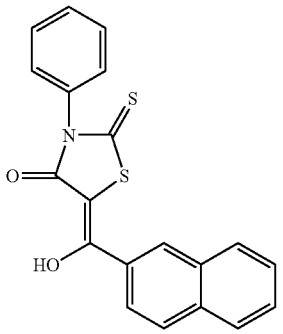
CV-117
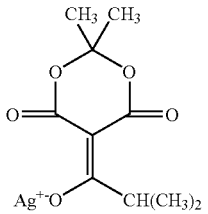

-continued
CV-118
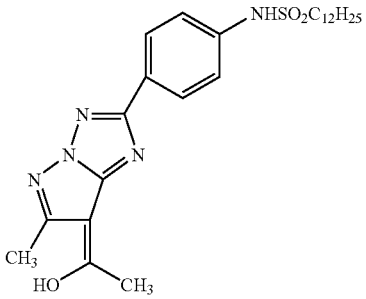
CV-119
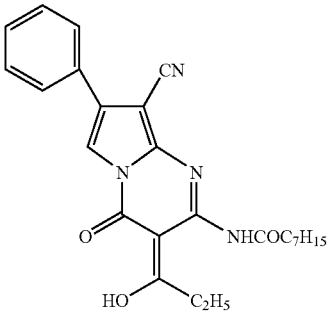
CV-120
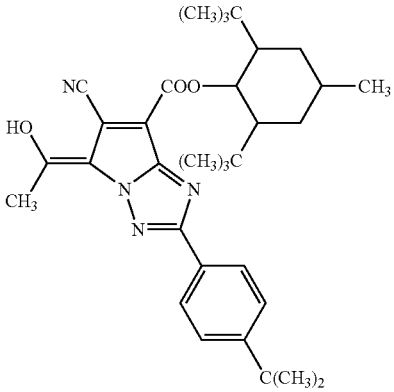
CV-121
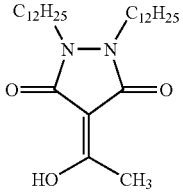
CV-122
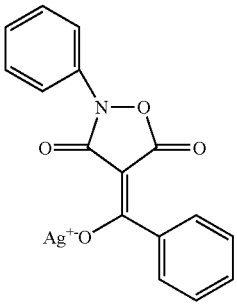
-continued
CV-123
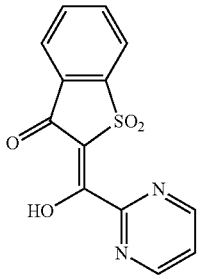
CV-124
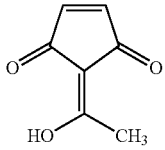
CV-125
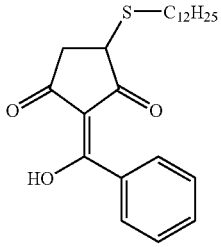
CV-126
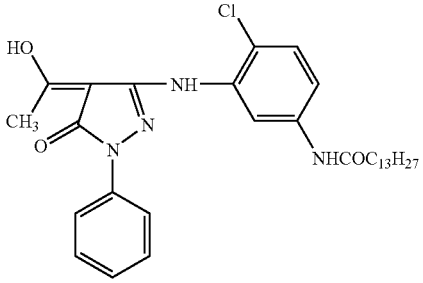
CV-127
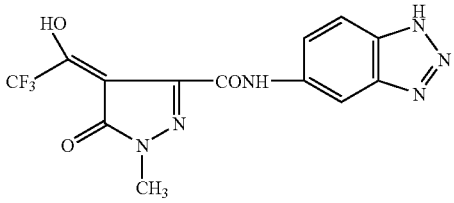
CV-128
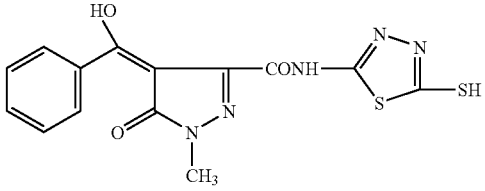

-continued

CV-129

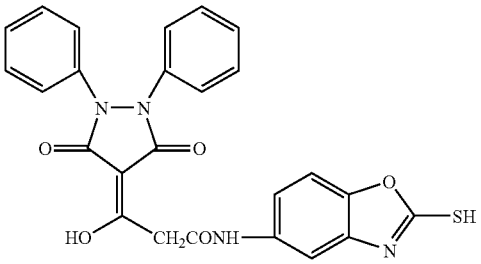

CV-130

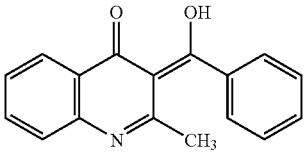

CV-131

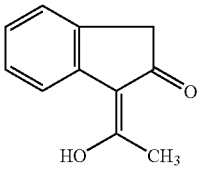

CV-132

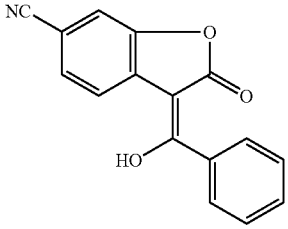

CV-133

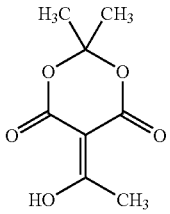

CV-134

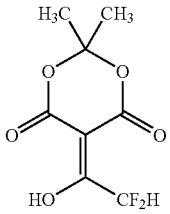

CV-135

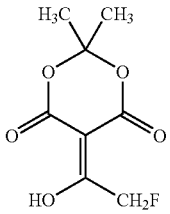

-continued

CV-136

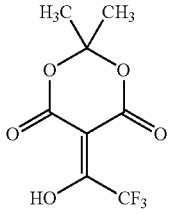

CV-137

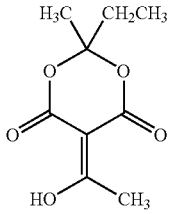

The compounds represented by formula (CV) can be synthesized by various methods, for example, please refer to the method described in Japanese Translation of PCT International Application Publication No. 2000-515995.

Further, Exemplified Compound CV-5 can be synthesized by the following procedure.

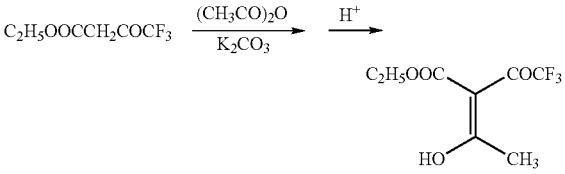

Though the compound represented by formula (CV) may be added into either the light-sensitive layer or a non-light-sensitive layer on the light-sensitive layer side, the addition to the light-sensitive layer is preferable. The added amount of the compound represented by formula (CV) is preferably from $1\times10^{-8}$–1 mol, more preferably from $1\times10^{-6}$–$1\times10^{-1}$ mol, and still more preferably from $1\times10^{-4}$–$1\times10^{-2}$ mol, per mol of silver.

The compound represented by formula (CV) may be added to the light-sensitive layer or the non-light-sensitive layer employing common methods. The compound may also be added to the coating composition of the light-sensitive layer or that of non-light-sensitive layer in a dissolved form in an alcohol such as methanol and ethanol, in a ketone such as methyl ethyl ketone and acetone or in a polar solvent such as dimethylsulfoxide and dimethylformamide. Further, it may be added in the form of microscopic particles, exhibiting a maximum diameter of 1 μm, dispersed in water or an organic solvent. Many techniques have been disclosed for dispersing microscopic particles, this compound may be dispersed by any of such methods.

Silver Ion Reducing Agent

In this invention, the following may be employable as silver ion reducing agents, hereinafter also simply referred to as a reducing agent; polyphenol compounds described in U.S. Pat. Nos. 3,589,903 and 4,021,249, British Patent No. 1,486,148, and JP-A Nos. 51-51933, 50-36110, 50-116023, 52-84727 and 51-35727; a bisnaphthol such as 2,2'-hydroxy-1,1'-binaphthyl and 6,6'-dibromo-2,2'-dihydroxy-1,1'-binaphthyl described in U.S. Pat. No. 3,672,904; a sulfonamidophenol or a sulfonamidonaphthol such as 4-benzenesulfonamidophenol, 2-benzenesulfonamidophenol, 2,6-dichloro-4-benzenesulfonamidophenol and 4-benznesulfonamidonaphthol described in U.S. Pat. No. 3,801,321.

However, in this invention, prefarable is a compound represented by the following formula (RED).

Formula (RED)

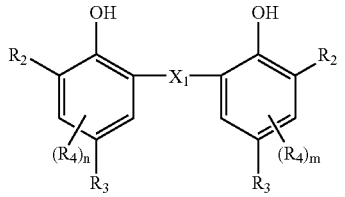

In the formula, $X_1$ is a charcogen atom or a $CHR_1$ group, while $R_1$ is a hydrogen or halogen atom, an alkyl group, an alkenyl group, an aryl group or a heterocyclic group, $R_2$ is an alkyl group, $R_3$ is a hydrogen atom or a group capable of substituting on the benzene ring, $R_4$ is a group capable of being substituted on the benzene group, while m and n are each an integer of 0–2.

In formula (RED), $X_1$ is a charcogen atom or a $CHR_1$ group. The charcogen atom may be a sulfur atom, a selenium atom or a tellurium atom, but preferably a sulfur atom. $R_1$ in $CHR_1$ is a hydrogen or halogen atom, an alkyl group, an alkenyl group, an aryl group or a heterocyclic group, and the halogen atom is a fluorine atom, a chlorine atom or a bromine atom, while the alkyl group is preferably an alkyl group of 1 to 20 carbon atoms. Specific examples of the alkyl group include a methyl group, an ethyl group, a propyl group, a butyl group, a hexyl group, a heptyl group and a cycloalkyl group; those of the alkenyl group include a vinyl group, an allyl group, a butenyl group, a hexenyl group, a hexadienyl group, an ethenyl-2-propenyl group, a 3-butenyl group, a 1-methyl -3-propenyl group, a 3-pentenyl group, a 1-methyl-3-butenyl group and a cyclohexenyl group; those of the aryl group include a benzene ring or a naphthalene ring; and those of the heterocyclic group include a thienyl group, a furyl group, an imidazolyl group, a pyrazolyl group and a pyrrolyl group. Preferable of the cyclic group are such as a cycloalkyl group and a cycloalkenyl group.

The foregoing groups each may have a substituent. Examples of the substituent include a halogen atom such as a fluorine atom, a chlorine atom and a bromine atom; an alkyl group such as a methyl group, an ethyl group, a propyl group, a butyl group, a pentyl group, an i-pentyl group, a 2-ethylhexyl group, an octyl group and a decyl group; a cycloalkyl group such as a cyclohexyl group and a cycloheptyl group; an alkenyl group such as an ethenyl-2-propenyl group, a 3-butenyl group, a 1-methyl-3-propenyl group, a 3-pentenyl group and a 1-methyl-3-butenyl group; a cycloalkenyl group such as a 1-cycloalkenyl group and a 2-cycloalkenyl group; an alkynyl group such as an ethinyl group and a 1-propinyl group; an alkoxyl group such as a methoxy group, an ethoxy group and a propoxy group; an alkylcarbonyloxy group such as an acetyloxy group, an alkylthio group such as a methylthio group and a trifluoromethylthio group; a carboxyl group; an alkylcarbonylamino group such as an acetylamino group; a ureido group such as a methylaminocarbonylamino group; an alkylsulfonylamino group such as a methanesulfonylamino group; a carbamoyl group such as a carbamoyl group, an N,N-dimethylcarbamoyl group and an N-morpholinocarbonyl group; a sulfamoyl group such as a sulfamoyl group, an N,N-dimethylsulfamoyl group and an N-morpholinosulfamoyl group; a trifluoromethyl group; a hydroxyl group; a nitro group; a cyano group; an alkylsulfonamido group such as a methanesulfonamido group and a butanesulfonamido group; an alkylamino group such as an amino group, an N,N-dimethylamino group and N,N-diethylamino group; a sulfo group; a phosphono group; a sulfite group; a sulfino group; an alkylsulfonylaminocarbonyl group such as an methanesulfonylaminocarbonyl group and an ethanesulfonylaminocarbonyl group; an alkylcarbonylaminosulfonyl group such as a methanesulfonylaminocarbonyl group and an ethanesulfonylaminocarbonyl group; an alkylcarbonylaminosulfonyl group such as an acetoamidosulfonyl group and a methoxyacetoamidosulfonyl group; an alkynylaminocarbonyl group such as an acetoamidocarbonyl group and a methoxyacetoamidosulfonyl group; and an alkylsulfinylaminocarbonyl group such as a methanesulfinylaminocarbonyl group and an ethanesulfinylaminocarbonyl group. When there are two or more substituents, they may be the same or different.

The particularly preferable substituent is the alkyl group.

$R_2$ is an alkyl group, and as such preferable is a substituted or unsubstituted alkyl group having 1–20 carbon atoms. Specific examples include a methyl group, an ethyl group, a propyl group, an i-propyl group, a butyl group, an i-butyl group, a t-butyl, a t-pentyl group, a t-octyl group, a cyclohexyl group, a cyclopentyl group, a 1-methylcyclohexyl group and a 1-methylcyclopropyl group.

Though the substituent for the alkyl group is not specifically limited, being for example, an aryl group, a hydroxyl group, an alkoxyl group, an aryloxy group, an alkylthio group, an arylthio group, an acylamino group, a sulfonamido group, a sulfonyl group, a phosphoryl group, an acyl group, a carbamoyl group, an ester group and a halogen atom are applicable. $(R_4)_n$ may form a saturated ring together with $(R_4)_m$. $R_2$'s are each preferably a secondary or tertiary alkyl group having 2–20 carbon atoms, of which a t-butyl group, a t-pentyl group and a 1-cyclohexyl group are more preferable but the t-butyl group is most preferable.

$R_3$ is a hydrogen atom or a group capable of being substituted on the benzene ring. Examples of the groups capable of substituting on the benzene ring include a halogen atom such as a fluorine atom, a chlorine atom and a bromine atom, an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfinyl group, a cyano group and a heterocyclic group.

Preferable examples of groups of $R_3$ are a methyl group, an ethyl group, an i-propyl group, a t-butyl group, a cyclohexyl group, a 1-methylcyclohexyl group and 2-hydroxyethyl group, of which methyl group and the 2-hydroxyethyl groups are more preferable.

These groups may further each have a substituent, such as these described for $R_1$ being applicable.

$R_3$ is preferably an alkyl group having 1–10 carbon atoms, preferably preferred of which are an alkyl group described in JP-A 2004-4650 which has a hydroxyl group or a substituent capable of forming a hydroxyl group by deprotection such as a 2-hydroxyethyl group. A reducing agent having such an alkyl group is preferably used singly or together with another reducing agent to obtain higher maximum density (being $D_{max}$) via a specific silver coating amount or higher covering power (also known as CP).

In the most preferable combination of $R_2$ and $R_3$, $R_2$ is the tertiary alkyl group such as a t-butyl group and a 1-methylcyclohexyl group, while $R_3$ is the alkyl group having a hydroxyl group or a substituent capable of forming a hydroxyl group by deprotection such as a 2-hydroxyethyl group. Plural $R_2$ and $R_3$ may be the same or different.

$R_4$ is a group capable of being substituted on the benzene ring, and specific examples thereof include the following: an alkyl group having 1–25 carbon atoms such as a methyl group, an ethyl group, a propyl group, an i-propyl group, a t-butyl group, a pentyl group, a hexyl group and a cyclohexyl group; a halogenoalkyl group, such as a trifluoromethyl group and a perfluorooctyl group; a cycloalkyl group, such as a cyclohexyl group and a cyclopentyl group; an alkynyl group, such as a propalgyl group; a glycidyl group; an acrylate group; a methacrylate group; an aryl group, such as a phenyl group; a heterocyclic group, such as a pyridyl group, a thiazolyl group, an oxazolyl group, an imidazolyl group, a furyl group, a pyrrolyl group, a pyrazinyl group a pyridazinyl group, a selenazolyl group, a sulforanyl group, a piperizinyl group, a pyrazolyl group and a tetrazolyl group; a halogen atom, such as a chlorine atom, a bromine atom, an iodine atom and fluorine atom; an alkoxyl group, such as a methoxy group, an ethoxy group, a propoxy group, a pentyloxy group, a hexyloxy group and a cyclohexyloxy group; an aryloxy group, such as a phenoxy group; an alkoxycarbonyl group, such as a methyloxycarbonyl group, an ethyloxycarbonyl group and a butyloxycarbonyl group; an aryloxycarbonyl group, such as a phenyloxycarbonyl group; a sulfonamido group, such as a methanesulfonamido group, an ethensulfonamido group, a butanesulfonamido group, a hexanesulfonamido group, a cyclohexanesulfonamido group and a benzenesulfonamido group; a sulfamoyl group, such as an aminosulfonyl group, a methylaminosulfonyl group, a dimethylaminosulfonyl group, a butylaminosulfonyl group, a hexylaminosulfonyl group, a cyclohexylaminosulfonyl group, a phenylaminosulfonyl group and a 2-pyridylaminosulfonyl group; a urethane group, such as a methylureido group, an ethylureido group, a pentylureido group, a cyclohexylureido group, a phenylureido group and a 2-pyridylureido group; an acyl group, such as an acetyl group, a propionyl group, a butanoyl group, a hexanoyl group, a cyclohexanoyl group, a benzoyl group and pyridinoyl group; a carbamoyl group, such as an aminocarbonyl group, a methylaminocarbonyl group, a dimethylaminocarbonyl group, a propylaminocarbonyl group, a pentylaminocarbonyl group, a cyclohexylaminocarbonyl group, a phenylaminocarbonyl group and a 2-pyridylaminocarbonyl group; an amido group, such as an acetoamido group, a propionamido group, a butanamido group, a hexanamido group and benzamido group; a sulfonyl group, such as a methylsulfonyl group, an ethylsulfonyl group, a butylsulfonyl group, a cyclohexylsulfonyl group, a phenylsulfonyl group and a 2-pyridylsulfonyl group; an amino group, such as an amino group, an ethylamino group, a dimethylamino group, a butylamino group, a cyclohexylamino group, an anilino group and a 2-pyridylamino group; a cyano group; a nitro group; a sulfo group; a carboxyl group; a hydroxyl group; and an oxamoyl group. The above groups each may be further substituted by these substituents, n and m are each an integer of 0–2 but most preferably both of them being 0, while plural $R_4$ may be the same or different.

$R_4$ may form a saturated ring with $R_2$ or $R_3$, while $R_4$ is preferably a hydrogen atom or an alkyl group, but more preferably a hydrogen atom.

Specific examples of the compounds represented by formula (RED) are listed below, however this invention is not limited to the exemplified compounds.

(RED-1)

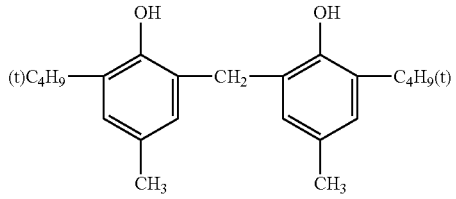

(RED-2)

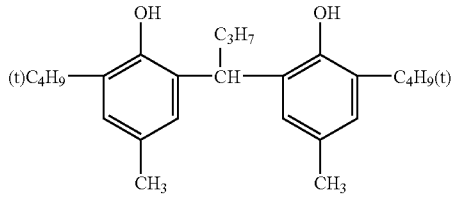

(RED-3)

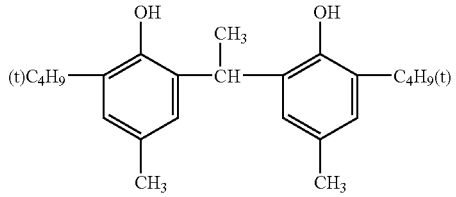

(RED-4)

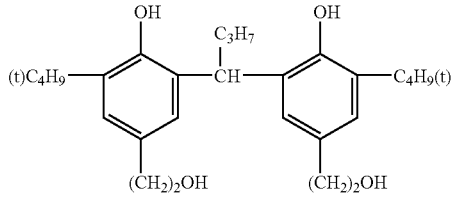

(RED-5)

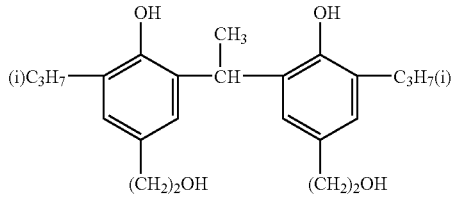

(RED-6)

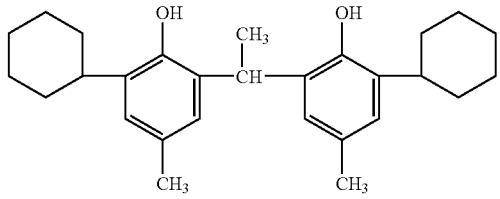

-continued
(RED-7)
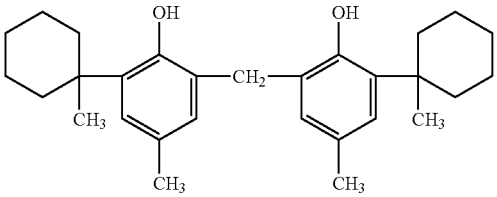
(RED-8)
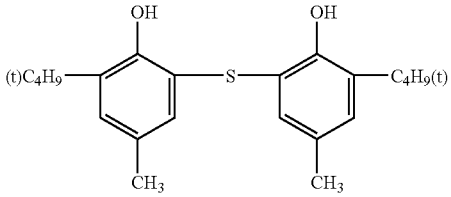
(RED-9)
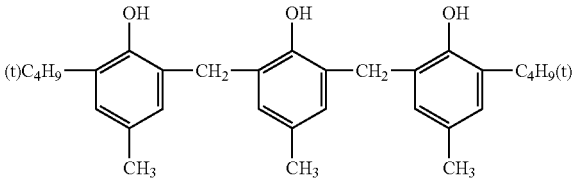
(RED-10)
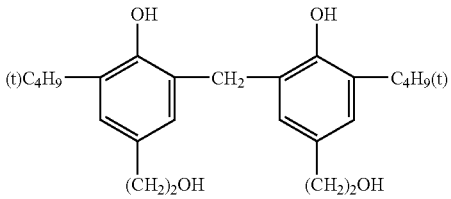
(RED-11)
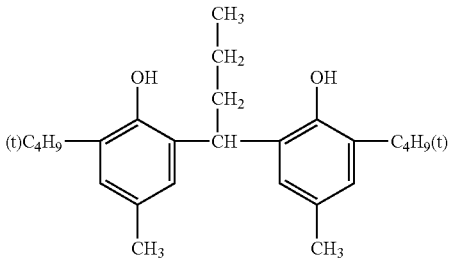
(RED-12)
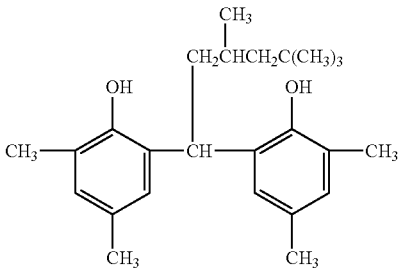
-continued
(RED-13)
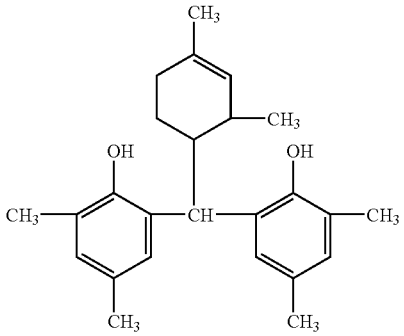
(RED-14)
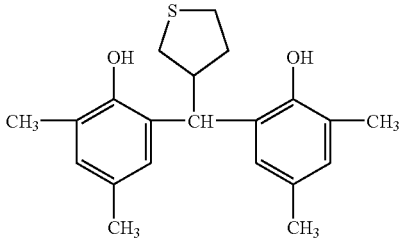
(RED-15)
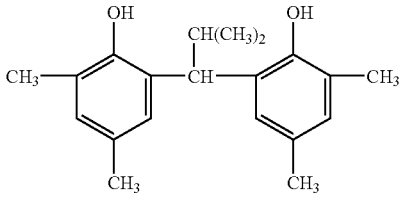
(RED-16)
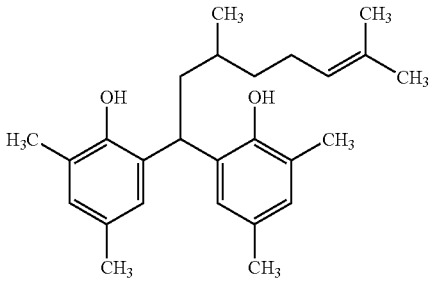
(RED-17)
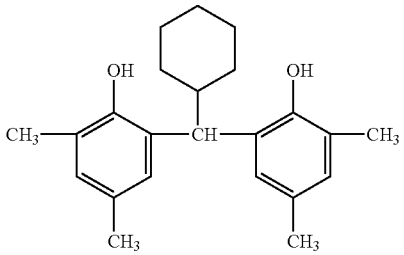
(RED-18)
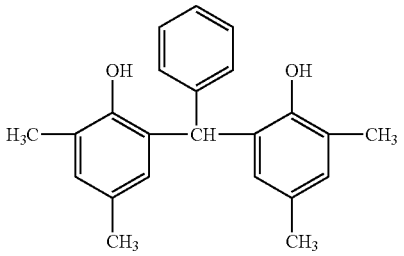

-continued (RED-19)

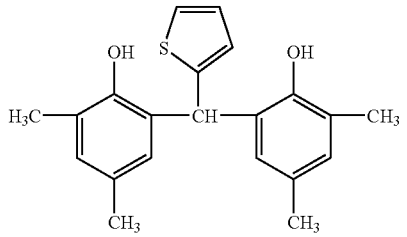

(RED-20)

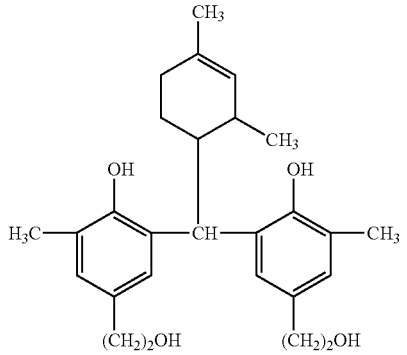

(RED-21)

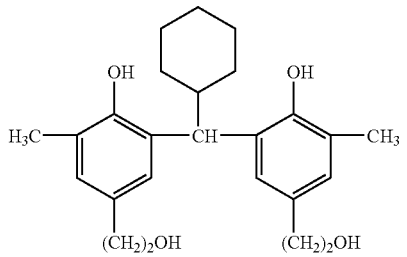

The compounds represented by formula (RED) (being bisphenol compounds) can be easily synthesized by commonly known methods (for example, cf. JP-A 2003-302723).

The silver ion reducing agent to be employed in the photothermographic dry imaging material of this invention is usually from 0.05–10 moles, but preferably from 0.1–3 moles, per mole of the organic silver salt, even though the amount varies depending on the kind of organic silver salt, the reducing agent and other additives. Two or more kinds of the silver ion reducing agents relating to this invention may be employed in combination within the above range of the added amount. It is preferable that the reducing agents, each differing in reactive property due to the difference of chemical structure, are preferably employed in combination to obtain an image excellent in the storage ability, high image quality and high covering power.

In this invention, it is preferable in some cases that the reducing agent is added and mixed into the light-sensitive emulsion coating composition comprised of light-sensitive silver halide, organic silver salt particles and solvent immediately prior to coating to reduce variation in photographic properties during the stand by time.

In the silver salt photothermographic material of this invention, the hydrazine derivatives and the phenol derivatives, represented by formulas (1)–(4) described in JP-A 2003-43614, and formulas (1)–(3) described in JP-A 2003-66559, are preferably employed as a development accelerating agent to be used in combination with the reducing agent.

The oxidation potential, via polarographic measurement of the development accelerating agent to be used in the silver salt photothermographic material of the invention, is preferably 0.01–0.4 V, but more preferably 0.01–0.3 V, lower than the compound represented by formula (RED). The oxidation potential of the development accelerating agent is preferably 0.2–0.6 V, but more preferably 0.3–0.55 V, when the potential is measured via a polarographic method in a mixture solvent of tetrahydrofuran and Britton-Robinson buffer solution at a ratio of 3:2, adjusted to pH of 6 using a SCE reference electrode. The pKa of the developing accelerating agent ay a mixture solvent of tetrahydrofuran and water in a ratio of 3:2 is preferably 3–12, but more preferably 5–10. It is particularly preferred that the oxidation potential measured via a polarographic method in a mixture solvent of tetrahydrofuran and Britton-Robinson buffet solution at a ratio of 3:2 adjusted to pH of 6 using a SCE reference electrode is 0.3–0.55 V, and the pKa value in the mixture solvent of tetrahydrofuran and water at a ratio of 3:2 is 5–10.

Various kinds of reducing agent disclosed in EP No. 1,278,101 and JP-A 2003-15252 are employable as the silver ion reducing agent relating to this invention.

Chemical Sensitization

The light-sensitive silver halide particles relating to this invention may be subjected to chemical sensitization. For example, a chemical sensitization center (being a chemical sensitization nucleus) capable of capturing an electron or a positive hole generated by light excitation of the light-sensitive silver halide particle, or a spectral sensitizing dye on the particle surface can be formed by applying a compound releasing a charcogen such as sulfur, selenium and trillium or a noble metal compound releasing a noble metal ion such as a gold ion according to the methods, for example, described in JP-A Nos. 2001-249428 and 2001-249426. Particularly preferable is chemical sensitization via an organic sensitizing agent containing a charcogen atom.

Organic sensitizing agents containing a charcogen atom are preferably compounds which have a group capable of absorbing on the silver halide particles or an unstable charcogen atom site.

Organic sensitizing agents having various structures can be employed, such as these which are disclosed in JP-A Nos. 60-150046, 4-109240, 11-218874, 11-218875, 11-218876 and 11-194447. Of these, preferable is a compound having a structure in which a charcogen atom is bonded with a carbon atom or a phosphor atom through a double bond. However particularly preferable are thiourea derivatives and triphenylphosphinesulfide derivatives each having a heterocyclic group.

To perform chemical sensitization, various chemical sensitizing techniques similar to those typically applied to production of common silver halide light-sensitive material for wet processing may be applied (please refer to Reference Literature: (1) "The Theory of The Photographic Process" 4th edition, edited by T. H. James), published by Macmillan Publishing Co., Ltd., 1977, and (2) "Principles of Photographic Engineering (Silver Salt Photography)", revised edition, edited by The Society of Photographic Science and Technology of Japan, published by Corona Publishing Co., Ltd., 1998). Chemical sensitization of the usual method may be applied when the silver halide particle emulsion is previously sensitized and then mixed with non-light sensitive organic silver salt particles.

The added amount of charcogen compound as the organic sensitizing agent is preferably $10^{-8}$–$10^{-2}$ moles, but more preferably $10^{-7}$–$10^{-3}$ moles, per mole of silver halide even thought the amount varies depending on the charcogen compound, silver halide grain and reaction conditions during chemical sensitization. There is no limitation to the conditions for chemical sensitization. However, in some cases, it is preferable that charcogen sensitization via organic sensitizers containing the charcogen atom is performed in the presence of a compound capable of negating or reducing the silver charcogenide or the silver nucleus on the light sensitive silver halide particle, particularly an oxidizing agent capable of oxidizing the silver nucleus. In such a case, sensitization is preferably performed at a pAg of 6–11, but more preferably 7–10, a preferable pH of 4–10, but more preferably 5–8, and a maximum temperature of 30° C.

Chemical sensitization employing such an organic sensitizer is preferably performed in the presence of a sensitizing dye or a hetero atom containing compound exhibiting adsorbing ability onto silver halide particles. By performing the chemical sensitization in the presence of compound exhibiting adsorbing ability onto silver halide, dispersion of the chemical sensitizing nuclei can be prevented so that high sensitivity and low fogging are attained. The spectral sensitizer will be described later, however preferable examples of the hetero atom containing compounds exhibiting adsorbing ability onto silver halide are the nitrogen-containing heterocyclic compounds described in JP-A 3-24537. In the nitrogen containing heterocyclic compounds, for example, a pyrazole ring, a pyrimidine ring, a 1,2,4-triazole ring, a 1,2,3-triazole ring, a 1,3,4-thiadiazole ring, a 1,2,4-thiadiazole ring, a 1,2,5-thiadiazole ring, a 1,2,3,4-tetrazole ring, a pyridazine ring, a 1,2,3-triazine ring, a ring formed by combining two or three of the above rings such as a triazolotriazole ring, a diazaindene ring, a triazaindene ring and a tetrazaindene ring are applicable as the heterocyclic ring. Also applicable are a heterocyclic ring formed by condensation of a single heterocyclic ring and an aromatic ring such as a phthaladine ring, a benzimidazole ring, an indazole ring and benzothiazole ring.

Among the above, an azaindene ring is preferred but further preferred is an azaindene compound having a hydroxyl group as a substituent such as hydroxytriazaindene, tetrahydroxyazaindene and hedroxypentazaindene.

The heterocyclic ring may have a substituent other than a hydroxyl group. As such an applicable substituent, may be an alkyl group, a substituted alkyl group, an alkylthio group, an amino group, a hydroxyamino group, an alkylamino group, a dialkylammino group, an arylamino group, a carboxyl group, an alkoxycarbonyl group, a halogen atom and a cyano group.

The added amount of the nitrogen-containing heterocyclic compound is about $10^{-6}$–1 mole, preferably from $10^{-4}$–$10^{-1}$ moles, per mole of silver halide even though the amount varies widely depending on the size and composition of the silver halide grains.

The light-sensitive silver halide relating to this invention may be subjected to noble metal sensitization via application of a compound releasing noble metal ions such as gold. For example, chloroaurate and an organic gold compound may be employed as the gold sensitizer, please refer to the gold sensitizing techniques disclosed in JP-A 11-194447.

A reduction sensitizing method may be applied other than the above methods. Employable as the concrete compound for the reducing sensitization are ascorbic acid, thiourea dioxide, stannous chloride, a hydrazine derivative, a borane compound, a silane compound and a polyamine compound. Further, the reducing sensitization may be performed by ripening the emulsion at a pH of at least 7 and a maximum pAg of 8.3.

In this invention, the silver halide grains to be subjected to chemical sensitization may be formed in the presence of a silver salt of aliphatic carboxylic acid, formed in the presence of no organic silver salt, or a mixture thereof.

In this invention, it is essential that the effect of chemical sensitization is largely removed after the thermal developing process when the chemical sensitization is applied to the surface of the light-sensitive silver halide particles. The clause "effect of the chemical sensitization is largely removed" means that the sensitivity of the imaging material obtained via chemical sensitization is reduced to a maximum of 1.1 times the sensitivity of the material, without any chemical sensitization after the thermal developing process. To reduce the effect of chemical sensitization in the thermal developing process, it is essential that a suitable amount of an oxidizing agent capable of negating the chemical sensitizing center (being the chemical sensitizing nucleus) via oxidation reaction such as a halogen radical releasing compound is incorporated in the emulsion layer and/or the non-light-sensitive layer of the imaging material. It is preferable that the incorporating amount of oxidizing agent is controlled in referrence to the oxidizing capability of the oxidizing agent and the reduction degree of the effect of chemical sensitization.

Spectral Sensitization

The light-sensitive silver halide of this invention is preferably subjected to spectral sensitization by adsorption of a spectral sensitizing dye, such dyes as: cyanine, merocyanine, a cyanine complex, a merocyanine complex, a holopolar cyanine dye, styryl, hemicyanine, an oxonol dye and a hemioxonol dye are employable as spectral sensitizers. For example, the sensitizing dyes described in the following are employable: JP-A Nos. 63-159841, 60-140335, 63-231437, 63-259651, 63-304242 and 63-15245, as well as U.S. Pat. Nos. 4,639,414, 4,740,455, 4,741,966, 4,751,175 and 4,836,095.

The sensitizing dyes beneficially applicable to this invention are described in, for example, Research Disclosure (hereinafter referred to as RD), 17643 IV-A, p. 23, December 1978, and RD 18431 X, p. 437, August 1978, or documents cited in the above. Preferably employed are sensitizing dyes resulting in spectral sensitivity suited to the spectral property of the light source of various laser imagers or scanners. Preferably employed, for example, are the compounds described in JP-A Nos. 9-34078, 9-54409 and 9-80679.

A useful cyanine dye is one having a basic nucleus being rings of such as: thiazoline, oxazoline, pyrroline, pyridine, oxazole, thiazole, selenazole or imidazole. Useful merocyanine dyes each have an acidic nucleus being nuclei of such as: thiohydantoin, rhodanine, oxazolidinedione, thiazolinedione, barbituric acid, thiazolinone, malononitrile and pyrazolone, in addition to the above basic nuclei.

In this invention, any sensitizing dye resulting in spectral sensitivity in the infrared region may be employed. Preferably employed, for example, are the infrared spectral sensitizing dyes disclosed in U.S. Pat. Nos. 4,536,473, 4,515,888 and 4,959,294.

In the silver salt photothermal photographic dry imaging material, relating to this invention, it is preferable that the material contains at least one of the compounds represented by formula SD-1 described in JP-A 2004-309758, as well as those represented by following formula SD-2.

Formula SD-1

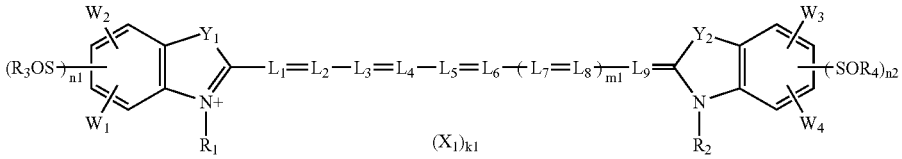

Formula SD-2

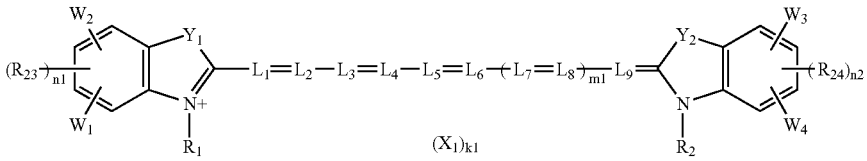

In these formulas, $Y_1$ and $Y_2$ are each an oxygen atom, a sulfur atom, a selenium atom or a —CH═CH— group, and $L_1$–$L_2$ are each a methine group. $R_1$ and $R_2$ are each an aliphatic group, while $R_3$, $R_4$, $R_{23}$ and $R_{24}$ are each a lower alkyl group, a cycloalkyl group, an alkenyl group, an aralkyl group, an aryl group or a heterocyclic group. $W_1$–$W_4$ are each a hydrogen atom, a substituent or a group of non-metal atoms necessary for forming a condensed ring by bonding between $W_1$ and $W_2$, or between $W_3$ and $W_4$, or a group of non-metal atoms necessary for forming a 5- or 6-member condensed ring by bonding between $R_3$ and $W_1$, $R_3$ and $W_2$, $R_{23}$ and $W_1$, $R_{23}$ and $W_2$, $R_4$ and $W_3$, $R_4$ and $W_4$, $R_{24}$ and $W_3$, or $R_{24}$ and $W_4$. $X_1$ is an essential ion to neutralize the charge on the molecule, and k1 is the essential number of ions to neutralize the charge in the molecule. m1 is 0 or 1, while n1 and n2 are each 0, 1 or 2 but n1 and n2 may not simultaneously be 0.

The above-described infrared sensitizing dyes are easily synthesized by the methods described in, for example, F. M. Harmer "The Chemistry of Heterocyclic Compounds" vol. 18, Cyanine Dyes and Related Compounds, A. Weissberger ed. Interscience Co., Ltd., New York 1964.

The infrared sensitizing dye may be added to the silver halide emulsion at an appropriate time after formation of the silver halide grains, for example, the dyes may be added to the light-sensitive emulsion containing silver halide grains or silver halide grains/aliphatic carboxylic acid silver salt grains in the form of a solution in a solvent, or in the state of a solid dispersion in which the dye is dispersed in the form of microscopic particles. The dye may be adsorbed onto the silver halide grain surfaces previous to chemical sensitization, similar to the heterocyclic compound having adsorption capability to silver halide. By such a method, dispersion of the chemical sensitizing center can be prevented so that high sensitivity and low fogging can be attained.

In this invention, though a single dye may be employed, plural kinds of the dye are preferably employed in combination. The combination of the dyes is frequently applied for super sensitization or expansion or control of the spectral sensitive range.

Emulsions employed in the silver salt photothermographic dry imaging material of this invention which contain silver halide particles and silver salt of aliphatic carboxylic acid, may be subjected to super spectral sensitization by adding a substance resulting in super sensitizing effect, which is a dye having no spectral sensitizing capability or a substance having almost no light adsorbing capability.

Useful combinations of the sensitizing dye and the super sensitizing dye, or the super sensitizer, are described in RD 17643 (December 1978) IV-J p. 23, and Examined Japanese Patent Application Publication No. (hereinafter, referred to as JP-B) 9-25500, JP-A Nos. 59-19032, 59-192242, and 5-341432. The following aromatic heterocyclic mercapto compounds or mercapto derivative compounds are preferred as such super sensitizers.

Ar—SM

In the above formula, M is a hydrogen atom or an alkali metal atom while Ar is an aromatic ring or an aromatic condensed ring, each containing one or more atoms of: nitrogen, sulfur, oxygen, selenium or tellurium. Preferable aromatic heterocyclic ring may be rings of: benzimidazole, naphthoimidazole, benzothiazole, naphthothiazole, benzoxazole, naphthoxazole, benzoselenazole, benzotetrazole, imidazole, oxazole, pyrazole, triazole, triazine, pyrimidine, pyridazine, pyrazine, purine, quinoline and quinazoline. However, other aromatic heterocyclic rings are also applicable.

Further, mercapto derivative compounds are also applicable, which form the above-described mercapto compounds when they are contained in the dispersion of the silver salt of aliphatic carboxylic acid or in the silver halide emulsion. The following mercapto compounds are preferable examples.

—Ar—S—S—Ar

Ar in this formula also represents Ar in the above mercapto compound.

The above aromatic heterocyclic ring may have a substituent selected from the group of halogen atoms, being such as: chlorine, bromine and iodine, or groups such as: hydroxyl, amino, carboxyl, or an alkyl group commonly having 1 or more, but preferably 1–4 carbon atoms, and an alkoxyl group having 1 or more, but preferably 1–4 carbon atoms.

Other than the above super sensitizer, macrocyclic compounds each having a hetero atom, as disclosed in JP-A 2001-330918 are also employable as the super sensitizer.

Super sensitizers relating to this invention are preferably employed in an amount of 0.001–1.0 mole, but more preferably 0.01–0.5 moles, per mole of silver in the light-sensitive material incorporating organic silver salt and silver halide grains.

In this invention, it is essential that the silver halide grains are spectrally sensitized by the spectral sensitizer absorbing onto the surface thereof and the spectral sensitizing effect is basically removed after the thermal developing process. The almost total removal of the spectral sensitizing effect means that sensitivity of the imaging material is reduced until it is not more than 1.1 times the sensitivity of not sensitized silver halide particles, after the thermal developing process.

To negate the chemical sensitizing effect in the thermal developing process, it is necessary to use a spectral sensitizer easily eliminated from the silver halide grain and/or to add an oxidizing agent capable of negating the spectral sensitizer via an oxidation reaction in the emulsion layer and/or the non-light-sensitive layer. The added amount of the oxidizing agent is preferably controlled based on the oxidation potential of the oxidizing agent, as well as the reduction degree of the spectral sensitizing effect.

Silver Saving Agent

In this invention, the light-sensitive layer or the non-light-sensitive layer contains a silver saving agent.

The silver saving agent employed in this invention is a compound by which the amount of silver, necessary to form a specific silver image density, can be reduced. Though various mechanisms of the function for reducing the silver amount are considered, a compound which functions to raise the covering power of silver is preferred, such covering power of silver is the optical density per unit amount of silver. The silver saving agent may be incorporated in the light-sensitive layer or in the non-light-sensitive layer, or in both.

Preferable examples of the silver saving agent include a hydrazine derivative represented by following formula H, a vinyl compound represented by formula G and a quaternary onium compound represented by formula P.

Formula H

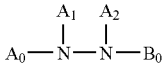

Formula G

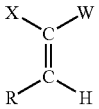

Formula P

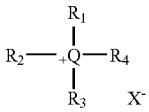

In formula H, $A_0$ is an aliphatic group, an aromatic group or a —$G_0$—$D_0$ group each of which may have a substituent, $B_0$ is a blocking group, $A_1$ and $A_2$ are a hydrogen atom or one of them is a hydrogen atom while the other is an acyl group, a sulfonyl group or a oxalyl group. $G_0$ is a group of such as: —CO—, —COCO—, —CS—, —C(═$NG_1D_1$)—, —SO—, —$SO_2$— or —P(O)($G_1D_1$)—; $G_1$ is a simple bonding, an —O— group, an —S— group or an —N($D_1$)— group; $D_1$ is an aliphatic group, an aromatic group, a heterocyclic group or a hydrogen atom, however when plural $D_1$ are in the molecule, they may be the same or different. $D_0$ is a hydrogen atom, an aliphatic group, an aromatic group, a heterocyclic group, an amino group, an alkoxy group, an aryloxy group, an alkylthio group or an arylthio group. Preferable $D_0$ is a hydrogen atom, an alkyl group, an alkoxy group or an amino group.

In formula H, the aliphatic group represented by $A_0$ is preferably a straight- or branched-chain alkyl group having 1–30 carbon atoms, but more preferably having 1–20 carbon atoms, such as a methyl group, an ethyl group, a t-butyl group, an octyl group, a cyclohexyl group, and a benzyl group; and these groups may have a suitable substituent such as an aryl group, an alkoxy group, an aryloxy group, an alkylthio group, a sulfoxy group, a sulfonamido group, a sulfamoyl group, an acylamino group and a ureido group.

In formula H, the aromatic group represented by $A_0$ is preferably a single ring or a condensed ring aryl group such as a benzene ring or a naphthalene ring. The heterocyclic group represented by $A_0$ is preferably a single ring or a condensed ring heterocyclic group containing at least one hetero atom selected from a nitrogen atom, a sulfur atom and an oxygen atom, such as a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring and a furan ring. The aromatic group, the heterocyclic group and the —$G_0$—$D_0$ group each may have a substituent. Further, the aryl group and the —$G_0$—$D_0$ group are particularly preferable as the group represented by $A_0$.

In formula H, $A_0$ preferably contains at least one anti-diffusion group or a group adsorbable onto silver halide grains. As an anti-diffusion group, a ballast group usually employed in an immovable photographic additive is preferred. A photographically inactive group such as an alkyl group, an alkenyl group, an alkynyl group, a phenyl group and an alkylphenoxy group are employable, and the total carbon atoms in the substituent is preferably at least 8.

As a group to promote adsorption acceleration onto silver halide in formula H, employable are a thiourea, a thiourethane group, a mercapto group, a thioether group, a thione group, a heterocyclic group, a thioamidoheterocyclic group, a mercaptoheterocyclic group or adosorbable group described in JP-A 64-90439.

In formula H, $B_0$ is a blocking group but preferably a $G_0$—$D_0$ group, in which $G_0$ is a —CO— group, a —COCO— group, a —CS— group, a —C(═$NG_1D_1$)— group, an —SO— group, an —$SO_2$— group or a —P(O)($G_1D_1$)— group; $G_0$ is preferably a —CO— group or a —COCO— group; $G_1$ is a simple bonding, an —O—, an —S— or a —N($D_1$)— group; and $D_1$ is an aliphatic group, an aromatic group, a heterocyclic group or a hydrogen atom, when plural $D_1$ are in the molecule, they may be the same or different. $D_0$ is a hydrogen atom, an aliphatic group, an aromatic group, a heterocyclic group, an amino group, an alkoxy group, an aryloxy group, an alkylthio group and an arylthio group, but preferably is a hydrogen atom, an alkyl group, an alkoxy group or an amino group. $A_1$ and $A_2$ are a hydrogen atom, or one of them is a hydrogen atom while the other is an acyl group such as an acetyl group, a trifuloroacetyl group or a benzoyl group; a sulfonyl group such as a methanesulfonyl group or a toluenesulfonyl group; or an oxalyl group such as an ethoxalyl group.

Such compounds as represented by formula H are easily synthesized by known methods, such as for example, those described in U.S. Pat. Nos. 5,464,738 and 5,496,695.

Further, preferably employable hydrazine compounds are compounds H-1-H-29 described in columns 11–20 of U.S. Pat. No. 5,545,505, and compounds 1–12 described in columns 1-12 of U.S. Pat. No. 5,464,738.

Though X and R are described in "cis" form in formula G, X and R in "trans" form are also included in formula G. Such matters are the same as in the structure of the specific examples.

In formula G, X is an electron-withdrawing group and W is a hydrogen atom, an alkyl group, an alkenyl group, an alkynyl group, an aryl group, a heterocyclic group, a halogen atom, an acyl group, a thioacyl group, a oxalyl group, an oxyoxalyl group, a thiooxalyl group, an oxamoyl group, an oxycarbonyl group, a thiocarbonyl group, a carbamoyl group, a thiocarbonyl group, a sulfonyl group, a sulfinyl group, an oxysulfinyl group, a thiosulfinyl group, a sulfinamoyl group, a phosphoryl group, a nitro group, an imino group, an N-carbonylimino group, an N-sulfonylimino group, a dicyanoethylene group, an ammonium group, a sulfonium group, a pyrylium group or an immonium group.

R is a halogen atom, a hydroxyl group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an arcoxycarbonylthio group, an aminocarbonylthio group, a salt of a hydroxyl group or mercapto group such as a sodium salt, a potassium salt and a silver salt; an amino group, an alkylamino group, a cyclic amino group such as a pyrrolidino group, an acylamino group, an oxycarbonylamino group; a heterocyclic group, for example, 5- or 6-member nitrogen-containing heterocyclic group such as a benzotriazolyl group, an imidazolyl group, a triazolyl group and a tetrazolyl group, a ureido group and a sulfonamido group. X and W, and X and R, may each form a ring structure by bonding with each other. Examples of a ring formed by X and W include a pyrazolone ring, a pyrazolidinone ring, a cyclopentadione ring, a β-ketolactone ring or a β-ketolactum ring.

In formula G, the electron-withdrawing group represented by X is a substituent capable of resulting in positive substituent constant $\sigma_p$. Examples of such a substituent include a substituted alkyl group such as a halogen-substituted alkyl group, substituted alkenyl group such as a cyanovinyl group, a substituted or unsubstituted alkynyl group such as a trifluoromethylacetylenyl group and a cyanoacetylenyl group, a substituted aryl group such as a cyanophenyl group, a substituted or unsubstituted heterocyclic group such as a pyridyl group, a triazinyl group and a benzoxazolyl group, a halogen atom, a cyano group, an acyl group such as an acetyl group, a trifluoroacetyl group and a formyl group, a thioacetyl group such as a thioacetyl group and a thioformyl group, an oxalyl group such as a methyloxalyl group, an oxyoxalyl group such as an ethoxalyl group, a thioxalyl group, such as a ethylthioxalyl group, an oxamoyl group such as a methyloxamoyl group, an oxycarbonyl group such as an ethoxycarbonyl group, a carboxyl group, a thiocarbonyl group, such as an ethylthiocarbonyl group, a carbamoyl group, a thiocarbamoyl group, a sulfonyl group, a sulfinyl group, an oxysulfonyl group such as an ethoxysulfonyl group, a thiosulfonyl group such as an ethylthiosulfonyl group, a sulfamoyl group, an oxysulfinyl group such as a methoxysulfinyl group, a thiosulfinyl group, such as a methylthiosulfinyl group, a sulfinamoyl group, a phosphoryl group, a nitro group, an imino group, an N-carbonylimino group such as an N-acetylimino group, an N-sulfonylimino group such as a methanesulfonylimino group, a dicyanoethylene group, an ammonium group, a sulfonium group, a phosphonium group, a pyrilium group and an immonium group, and a heterocyclic ring formed by an ammonium group, a sulfonium group, a phosphonium group and an immonium group. Substituents having a $\sigma_p$ value of at least 0.30 are particularly preferred.

W represents an alkyl group such as a methyl group, an ethyl group and a trifluoromethyl group; an alkenyl group such as a vinyl group, a halogen-substituted vinyl group and a cyanovinyl group; an alkynyl group such as an acetlenyl group and a cyanoacetylenyl group; an aryl group such as an nitrophenyl group, a cyanophenyl group and a pentafluorophenyl group; a heterocyclic group such as a pyridyl group, prymidyl group, a triazinyl group, a succinimido group, a tetrazolyl group, a triazolyl group, an imidazolyl group or a benzoxazolyl group. The group represented by W is preferably an electron-withdrawing group but is more preferably an electron-withdrawing group having a $\sigma_p$ value of at least 0.30.

Among the substituents represented by foregoing R, preferable are a hydroxyl group, a mercapto group, an alkoxy group, an alkylthio group, a halogen atom, an organic or organic salt of hydroxyl group or mercapto group, and a heterocyclic group, while more preferable are a hydroxyl group, an alkoxy group, an organic or organic salt of hydroxyl group or mercapto group, and a heterocyclic group, but particularly preferable are a hydroxyl group and an organic or an organic salt of a hydroxyl group or a mercapto group.

Among the substituents represented X or W, ones having a thioether bond are preferable.

In Formula P, $Q_3$ is a nitrogen atom or a phosphor atom, $R_1$, $R_2$, $R_3$ and $R_4$ are each a hydrogen atom or a substituent and X is an anion. $R_1$–$R_2$ each may be bonded to form a ring.

Examples of the substituent represented by $R_1$–$R_4$ include an alkyl group such as a methyl group, an ethyl group, a propyl group, a butyl group, a hexyl group and a cyclohexyl group; an alkenyl group such as an allyl group and a butenyl group; an alkynyl group such as a propalgyl group and a butynyl group; an aryl group such as a phenyl group and a naphthyl group; a heterocyclic group such as a pyperidinyl group, a piperazinyl group, a morpholyl group, a pyridyl group, a furyl group, a thienyl group, a tetrafuryl group, a tetrahydrothienyl group and a sulforanyl group, as well as an amino group.

The rings formed by bonding groups represented by $R_1$–$R_4$ include, for example, a piperidine ring, a morpholine ring, a piperazine ring, a quinacridine ring, a pyridine ring, a pyrrole ring, an imidazole ring, a triazole ring, and a tetrazole ring.

The group represented by $R_1$–$R_4$ may each have a substituent such as a hydroxyl group, an alkoxy group, an aryloxy group, a carboxyl group, a sulfo group, an alkyl group and an aryl group. $R_1$–$R_4$ are preferably a hydrogen atom or an alkyl group.

The anion represented by $X^-$ is an inorganic or organic anion such as a halogen ion, a sulfate ion, a nitrate ion, an acetate ion and a p-toluenesulfonate ion.

The above quaternary onium compounds can be easily synthesized by common methods, prefer for example, to the method described in "Chemical Reviews" vol. 55, pp. 335–483. The added amount of the silver saving agent is $10^{-5}$–1 mole, but preferably $10^{-4}$–$5\times10^{-1}$ moles, per mole of the silver salt of aliphatic carboxylic acid.

In this invention, it is also preferable that at least one of the silver saving agents is a silane compound. Silane compounds usable as silver saving agents in this invention are preferably an alkoxysilane compound having two or more primary or secondary amino groups, or a salt thereof, such as those disclosed in JP-A 2003-5324.

When the alkoxysilane compound or its salt, or a Schiff base, is added to the image forming layer as the silver saving agent, the adding amount is preferably from 0.00001–0.05 moles per mole of silver. The range of the added amount is the same as the above when both the alkoxysilane compound or its salt, and the Schiff base, are added to the image forming layer.

Binder

Binders suitable for the silver salt photo-thermal photographic dry imaging material of this invention may be transparent or semitransparent but usually are colorless. Examples of such binder include a natural polymer synthesized resin, a polymer, a copolymer and another film formable material such as gelatin, gum arabic, poly(vinyl alcohol), hydroxyethyl cellulose, cellulose acetate, cellulose acetate butylate, polyvinylpyrrolidone, casein, starch, poly (acrylic acid), poly(methyl methacrylate), poly(vinyl chloride), poly(methacrylic acid), styrene-maleic anhydride copolymer, styrene-acrylonitrile copolymer, styrene-butadiene copolymer; poly(vinyl acetal) such as poly(vinyl formal) and poly(vinyl butyral); polyesters, polyurethanes, phenoxy resin, poly(vinylidene chloride), polyepoxides, polycarbonates, poly(vinyl acetate) cellulose esters and polyamides. The binder may be either hydrophilic or hydrohobic. An appropriate binder for the photo-thermal photographic dry imaging material is poly(vinyl acetal) but poly(vinyl butyral) is particularly preferred, which is to be described in detail later. For a non-light sensitive layer such as an overcoating layer, undercoating layer, a specific protective layer or a backing layer, preferable are a polymer having a high softening point such as cellulose esters, particularly triacetyl cellulose and cellulose acetate butylate. Two or more kinds of polymers may be employed in combination, as appropriate.

A binder may be employed within a range in which it effectively functions as such; the effective range can be easily determined by one skilled in the art. For example, a criterion of the rate of binder to the silver aliphatic carboxylate for supporting the silver aliphatic carboxylate in the light-sensitive layer is within the range of 15:1–1:2, but is particularly preferable 8:1–1:1, is preferable. Namely, the amount of binder is preferably 1.5–6 g/m$^2$, but more preferably 1.7–5 g/m$^2$. When the amount is less than 1.5 g/m$^2$, the density in unexposed area is considerably increased so as to occasionally be impractical.

In this invention, the thermal transition temperature is preferably 46° C.–200° C., more preferably 70° C.–105° C., after development processing at a temperature of at least 100° C. The thermal transition temperature is represented by a VICAT softening point or a ring and ball method and an endothermic peak measured on the thermally light sensitive layer separated after development by a differential scanning calorimeter (DSC) such as Exstar 6000 or DSC 220C, both manufactured by Seiko Denshi Co., Ltd., or DSC-7 manufactured by Parkin Elmer Co., Ltd. In the photo-thermal photographic dry imaging material, a large endothermic peak appears at a temperature lower than the Tg of binder resin employed in the light-sensitive layer even though polymer compound generally has a glass transition. As a result of investigation noting such the point, it is found that not only the strength of the coated layer is increased but also the photographic properties such as the sensitivity, the maximum density and the storage ability of image are considerably improved by making the thermal transition temperature to be within the range of 46° C.–200° C. Thus the invention is attained.

Glass transition point, Tg, can be determined by the method described in Brandrap et al. "Polymer Handbook" III, pp. 139–179, Weilly and Son Co., Ltd., 1966, and Tg can alternatively be calculated by the following equation when the binder is a copolymer.

$$\text{Tg (copolymer)}^\circ\text{ C.} = v_1 Tg_1 + v_2 Tg_2 + \ldots + v_n Tg_n$$

In the equation, $v_1$, $v_2$. . . $v_n$ are each the weight ratio of the monomer in the copolymer, and $Tg_1$, $Tg_2$. . . $Tg_n$ are each the Tg (° C.) of a homopolymer formed by each of the monomers in the copolymer.

The precision of the Tg calculated by the above equation is ±5° C.

In the photo-thermal photographic dry imaging material of this invention, commonly known polymer compounds may be employed for the binder to be incorporated in the light sensitive layer coated onto the support, which is comprised of silver aliphatic carboxylate, light-sensitive silver halide grains and a reducing agent. The polymer is typically one exhibiting a Tg of 70–105° C., a number average molecular weight of 1,000–1,000,000, but preferably 10,000–500,000, and a polymerization degree of about 50–1,000. Examples of such polymer include a polymer or a copolymer incorporating an ethylenic unsaturated monomer such as vinyl chloride, vinyl acetate, vinyl alcohol, maleic acid, acrylic acid, acrylate, vinylidene chloride, acrylonitrile, methacrylic acid, methacrylate, styrene, butadiene, ethylene, vinyl butyral, vinyl acetal and vinyl ether as the constitution unit, as well as polyurethane resin and various rubber type resins.

Also employable are phenol resin, epoxy resin, polyurethane hardenable resin, urea resin, melamine resin, alkyd resin, formaldehyde resin, silicone resin, epoxy-polyamide resin and polyester resin. "Plastic Handbook" Asakura Shoten, describes these resins in detail. There is no limitation on these polymer compounds, and either a homopolymer or a copolymer may be employed as long as the Tg of the polymer is within the range of 70–105° C.

Examples of the polymer and the copolymer each incorporating the above ethylenic unsaturated monomer as the constitution unit, include an alkyl acrylate, an aryl acrylate, an alkyl methacrylate, an aryl methacrylate, an alkyl cyanoacrylate, and an aryl cyanoacrylate. The above alkyl group and the aryl group each may have a substituent such as a methyl group, an ethyl group, an n-propyl group, an isopropyl group, an n-butyl group, an isobutyl group, a sec-butyl group, a tert-butyl group, an amyl group, a hexyl group, a cyclohexyl group, a benzyl group, a chlorobenzyl group, an octyl group, a stearyl group, a sulfopropyl group, an N-ethyl-phenylaminoethyl group, a 2-(3-phenylpropyloxy)ethyl-group, a dimethylaminophenoxyethyl group, a furfuryl group, a terahydrofuryl group, a phenyl group, a cresyl group, a naphthyl group, a 2-hydroxyethyl group, 4-hydroxybutyl group, triethylene glycol group, a dipropylene glycol group, a 2-methoxyethyl group, a 3-methoxybutyl group, 2-acetoxyethyl group, a 2-acetoacetoxyethyl group, a 2-ethoxyethyl group, a 2-isopropoxyethyl group, a 2-butoxyethyl group, a 2-(2-methoxyethoxy)ethyl group, a 2-(2-ethoxyethoxy)ethyl, a 2-(2-butoxyethoxy)ethyl group, 2-diphenylphosphorylethyl group, a ω-methoxypolyethylene glycol (at an addition mole number n=6) an allyl group and a dimethylaminoethylmethylchloride salt.

Other than the above, the following monomers may also be employed: a vinyl ester such as vinyl acetate, vinyl propionate, vinyl butylate, vinyl isobutylate, vinyl caproate, vinyl chloroacetate, vinyl methoxyacetate, vinyl phennylacetate, vinylbenzoate and vinyl salicylate; an N-substituted acrylamide, an N-substituted methacrylamide and acrylamide in which the substituent of N is, for example, a methyl group, an ethyl group, a propyl group, a butyl group, a tert-butyl group, a cyclohexyl group, a benzyl group, a hydroxymethyl group, a methoxyethyl group, a dimethylaminoethyl group, a phenyl group, a dimethyl group, a diethyl group, β-cyanoethyl group, an N-(2-acetoacetoxyethyl) group and diacetone; an olefin such as dicyclopentadiene, ethylene, propylene, 1-butene, 1-pentene, vinyl chloride, vinylidene chloride, isoprene, chloroprene, butadiene and 2,3-dimethylbutadiene; a styrene such as methyl styrene, dimethylstyrene, trimethylstyrene, ethylstyrene, isopropylstyrene, tert-butylstyrene, chloromethylstyrene, methoxystyrene, acetoxystyrene, chlorostyrene, dichlorostyrene, bromostyrene and methyl vinylbenzoate; a vinyl ether such as methyl vinyl ether, butyl vinyl ether, hexyl vinyl ether, methoxyethyl vinyl ether and dimethylaminoethyl vinyl ether; an N-substituted maleimide having a substituent of N such as a methyl group, an ethyl group, a propyl group, a butyl group, a tert-butyl group, a benzyl group, an n-dodecyl group, a phenyl group, a 2-methylphenyl group, a 2,6-diethylphenyl group and a 2-chlorophenyl group; and other substituents such as: butyl crotonate, hexyl crotonate, dimethyl itaconate, dibutyl itaconate, diethyl maleate, dimethyl maleate, dibutyl maleate, diethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalonnitrile and vinylidene chloride.

Particularly preferable examples of the above are the alkyl methacrylate, the aryl methacrylate and the styrene. Among the polymer compounds, ones having an acetal group are preferable, since they are excellent in compatibility with aliphatic carboxylic acid whereby softening of the layer is largely prevented.

Among the polymer compounds having the acetal group, compounds represented by the following Formula V are particularly preferred.

Formula V

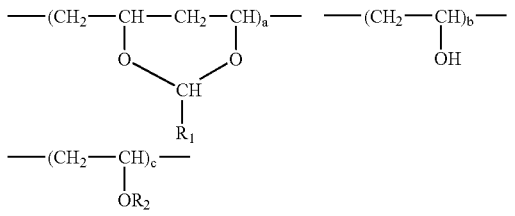

In this formula, $R_1$ is an alkyl group, a substituted alkyl group, an aryl group or a substituted aryl group, and preferably is a group other than the aryl group. $R_2$ is a unsubstituted alkyl group, a substituted alkyl group, a unsubstituted aryl group, a substituted aryl group, a —$COR_3$ group or a —$CONHR_3$ group. $R_3$ is the same as $R_1$.

The unsubstituted alkyl group represented by $R_1$–$R_3$ is preferably one having 1–20 carbon atoms, but particularly preferably 1–6. The alkyl group may be either a straight or branched chain, however the straight chain alkyl group is preferred. Examples of such an unsubstituted alkyl group include a methyl group, an ethyl group, an n-propyl group, an isopropyl group, an n-butyl group, an isobutyl group, a t-butyl group, an n-amyl group, a t-amyl group, an n-hexyl group, a cyclohexyl group, an n-heptyl group, an n-octyl group, a t-octyl group, a 2-ethylhexyl group, an n-nonyl group, an n-decyl group, an n-dodecyl group and an octadecyl. The methyl group and the propyl group are particularly preferred.

As an unsubstituted aryl group, one having 6–20 carbon atoms, such as a phenyl group or a naphthyl group is preferable.

Examples of a substituent capable of substituting on the alkyl group or on the aryl group include an alkyl group such as a methyl group, an n-propyl group, a t-amyl group, a t-octyl group, an n-nonyl group and a dodecyl group, an aryl group such as a phenyl group, a nitro group, a hydroxyl group, a cyano group, and a sulfo group; an alkoxy group such as a methoxy group; an aryloxy group such as a phenoxy group; an acyloxy group such as an acetoxy group; an acylamino group such as an acetylamino group; a sulfonamido group such as a methanesulfonamido group; a sulfamoyl group such as a methylsulfamoyl group; a halogen atom such as a fluorine atom, a chlorine atom and a bromine atom; a carboxyl group; a carbamoyl group such as a methylcarbamoyl group; an alkoxycarbonyl group such as a methoxycarbonyl group; and a sulfonyl group such as a methylsulfonyl group. When two or more substituents coexist, they may be the same or different. The total number of carbon atoms in the substituted alkyl group is preferably 1–20 and that in the substituted aryl group is preferably 6–20.

$R_2$ is preferably a —$COR_3$ in which $R_3$ is an alkyl group or an aryl group, or a —$CONHR_3$ group in which $R_3$ is an aryl group. a, b and c are each a value representing the weight of the repeating unit in mole %; a is preferably 40–86 mole %, b is 0–30 mole % and c is 0–60 mole % provided that a+b+c is 100 mole %. Particularly preferable a is 50–86 mole %, b is 5–25 mole % and c is 0–40 mole %. The repeating units each have the constitution ratios of a, b and c, respectively, and each may be constituted of the same units only or differing units.

Commonly known polyurethane resins such as polyester-poly urethane, polyether-polyurethane, polyether-polyester-polyurethane and polyester-polycarbonate polyurethane are employable in this invention. Regarding the above polyurethane resin, it is preferable to introduce one or more polar groups by copolymerization or addition reaction as appropriate. The polar group may be selected from a —COOM group, an —$SO_3M$ group, an —$OSO_3M$ group, a —P═O$(OM)_2$ group, an —O—P═O$(OM)_2$ group, in which M is an hydrogen atom or an alkali metal atom, an —$N(R_4)_2$ group, an —$N^+(R_4)_3$ group, in which $R_4$ is a hydrocarbon group and plural $R_4$ may be the same or different, an epoxy group, an —SH group and a —CN group. The amount of the polar group is typically $10^{-1}$–$10^{-8}$ moles/g, but preferably $10^{-2}$–$10^{-6}$ moles/g. The polyurethane preferably has two or more OH groups at both terminals of the molecule, in addition to the polar groups. It is preferable that the molecule has many OH groups since the OH groups form a three dimensional network structure by crosslinking with polyisocyanate as a hardener. Specifically, the presence of the OH group at the terminal of the molecule is preferable since such an OH group exhibits higher reactivity with the hardener. The polyurethane preferably has three or more OH groups at the terminal of the molecule, but particularly preferable are four or more OH groups. When a polyurethane is employed, preferable is one having a Tg of 70–105° C., a rupturing elongation of 100–2,000% and a rupturing stress of 0.5–100 N/mm.

In this invention, the polymer compounds represented by Formula V can be synthesized by common methods such as those described in I. Sakurada, "Vinyl Acetate Resin", Koubunshi Kankoukai, 1962.

These polymer compounds serving as a binder may be employed singly or in combination of two or more kinds thereof. In the light-sensitive silver salt-incorporating layer, but preferably in the light-sensitive layer, the above-described polymer is employed as the principal binder. The principal binder is one accounting for at least 50% by weight of the entire binder in the light-sensitive silver salt-incorporating layer. Accordingly, another binder may be blended in the range of less than 50% by weight. The polymer is not specifically limited as long as the polymer is soluble in polymer in which the polymer of this invention can be dissolved, of which poly(vinyl acetate), polyacryl resin and urethane resin are preferred.

Various crosslinking agents, usually employed for silver salt photographic material, are for example, an aldehyde type, an epoxy type, an ethyleneimine type, a vinylsulfon type, a sulfonate type, an acryloyl type, a carbdiimide type and a silane compound crosslinking agents described in JP-A 50-96216, may be employed as the crosslinking agent in this invention. Preferable ones are either of the following isocyanate type compounds, silane compound epoxy compounds or acid anhydrides.

Described below is one of the preferable crosslinking agents, being either the isocyanate type or the thioisocyanate type crosslinking agent represented by following formula IC.

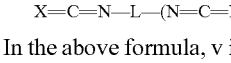

$$X{=}C{=}N{-}L{-}(N{=}C{=}N)_v \qquad \text{Formula IC}$$

In the above formula, v is an integer of 1 or 2, L is an alkyl group, an alkenyl group, an aryl group or an alkylaryl group functioning as a v+1 valent bonding group, while X is an oxygen atom or a sulfur atom.

In the compounds represented by Formula IC, the aryl ring of the aryl group may have a substituent. A preferable substituent is selected from, for example, a halogen atom such as a bromine atom, a hydroxyl group, an amino group, a carboxyl group, an alkyl group or an alkoxy group.

The isocyanate type crosslinking agent is an isocyanate compound having at least two isocyanate groups and adducts thereof, specifically aliphatic diisocyanates, aliphatic diisocyanates exhibiting a cyclic group, bebzenediisocyanates, naphthalenediisocyanates, biphenyldisocyanates, diphenylmethanediisocyantes, triphenylmethanediisocyanates, triisocyanates, tetraisocyanates, adducts of these isocyanates and adducts of the isocyanate and di- or tri-valent polyalcohol.

Specifically, employable are the isocyanate compounds described in JP-A 56-5535, p. 10 and 11.

The adduct of the isocyanate and the polyalcohol has high capability to improve the adhesion between the layers and to prevent peeling of the layers, slippage of the image and formation of bubbles. The isocyanate compound may be added at any layer of the silver salt photothermal photographic imaging material. For example, the compound may be added to the support, specifically, when the support is paper, the compound may be incorporated in the sizing composition, or optional layers coated on the light-sensitive layer side of the support such as a light-sensitive layer, a surface protective layer, an intermediate layer, an antihalation and an undercoating layer. The compound may be added to one or more layer of the above layers.

Thioisocyanate type crosslinking agents, each having a thioisocyanate structure corresponding to the foregoing isocyanate type compounds are also beneficial in this invention.

The amount of the foregoing crosslinking agent usable in this invention is typically 0.001–2 moles per mole of silver, but is preferably 0.005–0.5 moles.

In this invention, the isocyanate compounds and the thioisocyanate compounds to be added to the imaging material are preferably a compound capable of functioning as a crosslinking agent. However, good results can also be obtained by a compound represented by the foregoing formula in which v is 0, featuring only one functional group.

Examples of the silane compound employable as the crosslinking agent are ones represented by Formula 1 or 2 described in JP-A 2002-22203.

In these formulas, $R^1$–$R^8$ are each a straight chain or branched chain alkyl group having 1–30 carbon atoms such as a methyl group, an ethyl group, a butyl group, a dodecyl group and a cycloalkyl group; an alkenyl group such as a propenyl group, a butenyl group and a nonenyl group; an alkynyl group such as an acetylene group, a bisacetylene group and a phenylacetylene group; an aryl group or a heterocyclic group such as a phenyl group, a naphthyl group, a tetrahydropyrane group, a pyridyl group, a furyl group, a thiophenyl group, an imidazolyl group, a thiazolyl group, a thiadiazolyl group and an oxadiazolyl group. The above groups each may have a substituent, which may be an electron-withdrawing group or an electron donating-substituent.

At least one of the groups represented by $R^1$–$R^8$ is preferably an anti-diffusion group or an adsorption group, and it is particularly preferable that $R^2$ is the anti-diffusion group or the adsorption group.

The anti-diffusion group, also known as the ballast group, is preferably an aryl group having an aliphatic group containing at least 6 carbon atoms, or an alkyl group containing at least 3 carbon atoms. Though the anti-diffusion capability of the compound differs depending on the binder or the used amount of the crosslinking agent, the moving distance of the molecule at the ambient room temperature is reduced so that the reaction during the storage tends to be inhibited.

An epoxy compound employable as the crosslinking agent may be a compound having one or more epoxy groups, the number of the epoxy group nor the molecular weight are specifically limited. The epoxy group is preferably incorporated in the molecule via an ether bond or an imino bond in the form of a glycidyl group. The epoxy compound may be a monomer, an oligomer or a polymer, and the number of epoxy groups in the molecule is typically 1–10, but preferably 2–4. When the epoxy compound is a polymer, it may be a homopolymer or a copolymer, while preferable number average molecular weight Mn is 2,000–20,000.

The epoxy compounds represented by following formula EP are preferable.

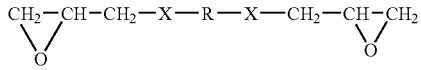

Formula EP

In formula EP, the substituent of the alkylene group represented by R is preferably a halogen atom, a hydroxyl group, a hydroxyalkyl group or an amino group. The bonding group represented by R preferably has an amido bonding portion, an ether bonding portion or a thioether bonding portion. The di-valent linking group represented by X is preferably an —$SO_2$— group, an —$SO_2NH$— group, an —S— atom, an —O— atom or an —$NR_1$— group, in which $R_1$ is commonly a mono-valent group but preferably an electron-withdrawing group.

The epoxy compound may be used singly or in combination of two or more kinds thereof. Though the added amount of the epoxy compound is not limited, the amount is preferably within the range of $1\times10^{6}$–$1\times10^{-2}$ moles/m$^2$, but more preferably $1\times10^{-5}$–$1\times10^{-3}$ moles/m$^2$.

The epoxy compound may be added to an optional layer coated on the light-sensitive layer side of the support such as the light-sensitive layer, the surface protective layer, the intermediate layer, the anti-halation layer or the undercoat layer. The compound may be added to one or more of the above layers. The epoxy compound may be further added to an optional layer coated on the side of the support opposite to the light-sensitive layer. When the imaging material has light sensitive layers on both sides of the support, the epoxy compound may be added to any layer.

Acid anhydride is a compound having at least one acid anhydride group represented by the following structural formula.

—CO—O—CO—

Though the acid anhydride compound features one or more acid anhydride groups, the number of the group and molecular weight are not limited, while compounds represented by following formula SA are preferable.

Formula SA

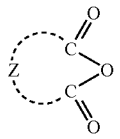

In formula SA, Z is a group of atoms essential to form a single ring or a condensed ring. These rings may be an unsaturated or saturated ring. Examples of the substituent include an alkyl group such as a methyl group, an ethyl group or a hexyl group; an alkoxy group such as a methoxy group, an ethoxy group or an octyloxy group; an aryl group such as a phenyl group, a naphthyl group or a tolyl group; a hydroxyl group; an aryloxy group such as such as a phenoxy group; an alkylthio group such as a methylthio group or a butylthio group; an arylthio group such as a phenylthio group; an acyl group such as an acetyl group, a propionyl group or a butylyl group; a sulfonyl group such as a methylsulfonyl group or a phenylsulfonyl group; an acylamino group; a sulfonylamino group; an acyloxyl group such as an acetoxy group or a benzoxy group; a carboxyl group; a cyano group and an amino group. Further, substituents incorporating no halogen atom are preferred.

The acid anhydride compound may be used singly or in combination of two or more kinds. Though the added amount of the acid anhydride compound is not specifically limited, the amount is preferably within the range of $1\times10^{6}$–$1\times10^{-2}$ moles/m$^2$, but more preferably $1\times10^{-5}$–$1\times10^{-3}$.

The epoxy compound may be added into an optional layer coated on the light-sensitive layer side of the support such as the light-sensitive layer, surface protective layer, intermediate layer, anti-halation layer or undercoating layer. The compound may be added to one or more of the above layers. The acid anhydride compound may be added to the same layer to which the epoxy compound is added.

Tone Control

The tone of the image obtained by thermally developing the imaging material is described below.

Regarding the tone of the output image for medical diagnosis such as the common X-ray photographic film, it is said that a more precise diagnosis can be easily obtained by the image reader when the image has cold tone. A "cold image tone" means that the color of the image is neutral black or a bluish black while "warm image tone" means that the color of the image is brownish black. In the following, the tone is described based on the expression method recommended by the International Commission on Illumination (CIE) for specific quantitive discussion.

The terms of "colder tone" and "warmer tone" regarding the color can be represented by minimum density $D_{min}$ and hue angle $h_{ab}$ at an optical density of 1.0. Hue angle $h_{ab}$ can be determined by the following equation using a color specification a*b* of a color space L*a*b* having approximately the same rate which is recommended by the International Commission on Illumination (CIE) in 1976.

$$h_{ab}=\tan^{-1}(b^*/a^*)$$

As a result of investigations applying the expression method via hue angle, it is understood that the tone of the image after development of the silver salt photothermal photographic dry imaging material is preferably within the range of hue angle $h_{ab}$ of 180°–270°, more preferably 200°–270°, but most preferably 220°–260°. Such ranges are disclosed in JP-A 2002-6463.

Up to now, it has been common knowledge to those versed in the art that a diagnostic image exhibiting desirable appearance tone can be obtained by controlling the u*, v* in the CIE 1976 (L*u*v*) color space, or a*, b* in the (L*a*b*) color space to specific values, such as described in JP-A 2002-29164.

As a result of further investigation regarding the silver salt photothermal photographic dry imaging material related to this invention, it was found that the imaging material has a higher diagnosis suitability than that of the usual wet processed silver salt photographic material when the linear regression line is controlled to be within a specific range; the regression line is prepared by plotting u* and v* or a* and b* at various image densities on a graph in which u* or a* is plotted on the abscissa while v* or b* is plotted on the ordinate in the (L*u*v*) color space, or the (L*a*b*) color space of CIE 1976. Such conditions will be described below.

The determination coefficient (being the multiple determination) $R^2$ of the linear regression line is 0.998–1.000 when the a* and b* of the image material are determined at an optical density of 0.5, 1.0, and 1.5 and the minimum density, and plotted on a two dimensional coordinate in which a* is measured on the abscissa and b* is plotted on the ordinate in the (L*a*b*) color space of CIE 1976.

Moreover, the value of b* at the crossing point of the linear regression line with the ordinate is −5 to 5 and the tangent of the line (b*/a*) is 0.7–2.5.

It is also preferable that the determination coefficient (the multiple determination) $R^2$ prepared by plotting the u* and v* at the above optical densities is 0.998–1.000, the value of b* at the crossing point of the linear regression line with the abscissa is −5 to 5 and the tangent of the line (b*/a*) is 0.7–2.5.

The preparation method of the linear regression line or the determination method of the u*, v* and a*, b* will be described below.

A four step wedge image including an unexposed area and images each having an optical density of 0.5, 1.0 and 1.5, respectively, is prepared by using a thermal developing apparatus. Each density portion of the thus prepared wedge was measured via a spectral colorimeter such as CM-3600d, manufactured by Minolta Co., Ltd., and u*, v* and a*, b* are calculated. The measurement was performed in transmission measuring mode with a visual field angle of 10° by employing an F7 light source. The determined u*, v* or a*, b* are plotted on the graph in which u* or a* is measured on the abscissa and v* or b* plotted on the ordinate, after which the linear regression line is drawn and the determination coefficient (multiple determination) $R^2$, segment and tangent are determined.

The specific method for obtaining the linear regression line exhibiting the above properties will be described below.

In this invention, the preferable tone can be obtained by optimizing the form of developed silver by controlling the added amount of a compound, directly or indirectly participating in the developing process such as the tone controlling agent, developing agent, silver halide grains and silver aliphatic carboxylate. For example, the tone tends to be bluish when making the shape of developed silver similar to dendrite, and tends to be brownish when making the shape of developed silver similar to filaments. The tone can be controlled by considering such factors as the tendency of the shape of developed silver.

Up to now, phthaladinone or phthaladine and phthalic acids, as well as a phthalic anhydride are usually employed as the toning agent. Examples of useful toning agents are described in RD 17029, and U.S. Pat. Nos. 4,123,282, 3,994,732, 3,846,136 and 4,021,249.

Other than the toning agent, the tone is preferably controlled by the couplers disclosed in JP-A 11-288057 and EP 1134611A2, and the leuco dye will be described below.

Further, variation of the tone during storage of the silver image can be inhibited by the use of silver halide grains capable of being converted to an interior latent image type, after the thermal developing process.

Leuco Dye

A leuco dye is employed in the silver salt photo-thermal photographic imaging material of this invention.

The leuco dye is preferably a colorless or slightly colored compound capable of changing to a colored form via oxidation and heating at 80–200° C. for 0.5–30 seconds. Any leuco dye forms a dye by oxidation by a silver ion. A specific useful compound is one which has pH sensitiveness and is capable of being oxidized to a colored form.

Though there is no specific limitation as to the typical leuco dyes suitable in this invention, examples of employable lueco dyes include a biphenyl leuco dye, a phenol leuco dye, an indoaniline leuco dye, an acrylated-azine leuco dye, a phenoxazine leuco dye, a phenodizine leuco dye and a phenothiazine leuco dye. The leuco dyes disclosed in U.S. Pat. Nos. 3,445,234, 3,846,136, 3,994,732, 4,021,349, 4,021,250, 4,022,617, 4,123,282, 4,368,247 and 4,461,681, JP-A 50-36110 and 59-206831, JP-A 5-204087, 11-231460, 2002-169249 and 2002-236334 are also employable.

To control the tone to a designated value, it is preferable to employ various colored leuco dyes alone or in combination of plural kinds thereof. In this invention, the leuco dye forming a cyan color is preferably employed for preventing the excessive reddish coloring of the image in high density regions, namely a density of at least 2.0, and a leuco dye forming a yellow color and another leuco dye forming a cyan color are preferably employed in combination for precise tone adjustment.

It is preferable that the density by the color formation is suitably controlled considering the relationship with the tone of the silver image itself. In this invention, the leuco dye is a specifically formed color so that the sum of the maximum density at the maximum absorption wavelength of the dye image formed by the leuco dye to contral the tone is usually 0.01–0.30, is preferably 0.02–0.20, is particularly preferable 0.02–0.10 so as to be within the preferable range described later.

Yellow Color Forming Leuco Dye

In this invention, a color image forming agent represented by the following Formula YL is preferably employed as the yellow color forming leuco dye which via oxidation increased light absorbancy of 360–450 nm.

Formula YL

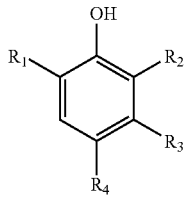

The compounds represented by Formula YL are detailed below.

In Formula YL, $R_1$ is preferably an alkyl group having 1–30 carbon atoms, which may have a substituent. Specifically preferable are a methyl group, an ethyl group, a butyl group, an octyl group, an i-propyl group, a t-butyl group, a t-octyl group, a t-pentyl group, a sec-butyl group, a cyclohexyl group and a 1-methyl-hexyl group, and more preferable are a sterically larger group than the i-propyl group such as an i-propyl group, an nonyl group, a t-butyl group, a t-amyl group, a t-octyl group, a cyclohexyl group, a 1-methyl-cyclohexyl group and an adamantyl group. Of these, a secondary or tertiary alkyl group is preferable, but a tertiary alkyl group such as a t-butyl group, a t-octyl group or a t-pentyl group is particularly preferred. Examples of substituent for the group represented by $R_1$ include a halogen atom, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group and a phosphoryl group.

$R_2$ is a hydrogen atom, a substituted or unsubstituted alkyl group, or a substituted or unsubstituted acylamino group. The alkyl group represented by $R_2$ is an alkyl group having 1–30 carbon atoms, while the acylamino group represented by $R_2$ is an acylamino group having 1–30 carbon atoms. Further, the alkyl group is the same as that in $R_1$.

The acylamino group represented by $R_2$ may be a substituted or unsubstituted one such as an acetylamino group, an alkoxyacetylamino group or an aryloxyacetylamino group. $R_2$ is preferably a hydrogen atom, or an unsubstituted alkyl group having 1–24 carbon atoms, however specifically prefreed is a methyl group, an i-propyl group or a t-butyl group, provided that $R_1$ and $R_2$ are not to be 2-hydroxyphenylmethyl group.

$R_3$ is a hydrogen atom or a substituted or unsubstituted alkyl group, which is preferably one having 1–30 carbon atoms, and the description of the alkyl group is the same as that of above $R_1$. $R_3$ is preferably one having 1–24 carbon atoms such as a methyl group, an i-propyl group or a t-butyl group. Further, either $R_{12}$ or $R_{13}$ is preferably a hydrogen atom.

$R_4$ is a group capable of substituting on the benzene ring, which is, for example, the same as that in the description of $R_4$ in above Formula RED. $R_4$ is preferably a substituted or unsubstituted alkyl group having 1–30 carbon atoms or a carboxyl group having 2–30 carbon atoms, but is further preferably an alkyl group having 1–24 carbon atoms. As an applicable substituent of the alkyl group, may be an aryl group, an amino group, an alkoxy group, an oxycarbonyl group, an acylamino group, an acyloxy group, an imido group and a ureido group, however more preferable is an aryl group, an amino group, an oxycarbonyl group or an alkoxyl group. The alkyl group may be substituted for the above substituents.

Among the compounds represented by Formula YL, compounds (bisphenol compounds) particularly preferably employed in this invention are represented by the following formula.

Formula YL'

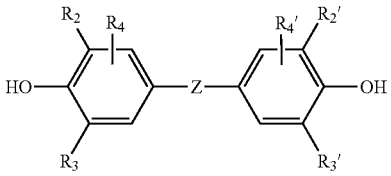

In the formula, Z is an —S— atom or a —C($R_1$)($R_1$')— group in which $R_1$ and $R_2$ are each a hydrogen atom or a substituent. As the substituent represented by $R_1$ or $R_1$', the same groups as those represented by $R_1$ of Formula RED are applicable, further $R_1$ and $R_1$' are preferably each a hydrogen atom or an alkyl group.

$R_2$, $R_3$, $R_2$' and $R_3$' are each a substituent, to which the same as those represented by $R_2$ and $R_3$ of Formula RED are applicable.

$R_2$, $R_3$, $R_2$' and $R_3$' are preferably an alkyl group, an alkenyl group, an alkynyl group, an aryl group or a heterocyclic group, of which the alkyl group is more preferable. As the substituent on the alkyl group, the same as those in the description of Formula RED are applicable.

$R_2$, $R_3$, $R_2$' and $R_3$' are more preferably a tertiary alkyl group such as a t-butyl group, a t-pentyl group, a t-octyl group or a 1-methyl-cyclohexyl group.

$R_4$ and $R_4$' are each a hydrogen atom or a substituent, to which the same as those in the description of $R_4$ of Formula RED are further applicable.

As the compounds represented by Formula YL, for example, Compounds II-1-II-40 described in paragraphs 0032–0038 of JP-A 2002-169249, Compounds IST-1-IST-12 described in paragraph 0026 of EP 1,211,093 are cited.

Specific examples of the compound represented by Formula YL are shown, however this invention is not limited to these compounds.

(YL-1)

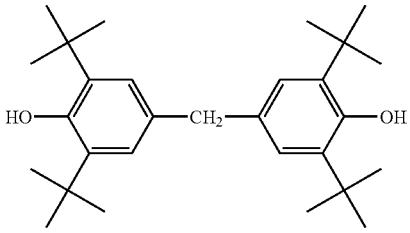

-continued (YL-2)

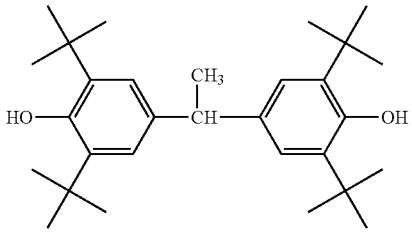

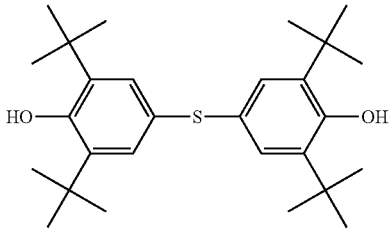

(YL-4)

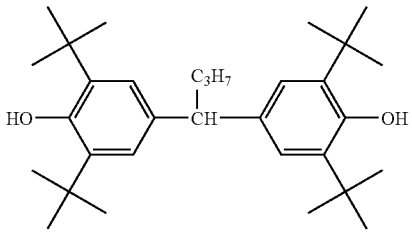

(YL-5)

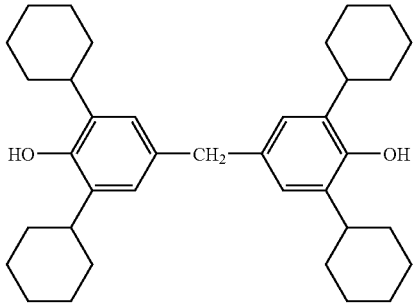

(YL-6)

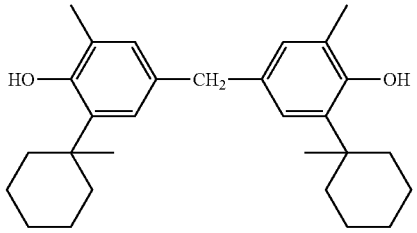

(YL-7)

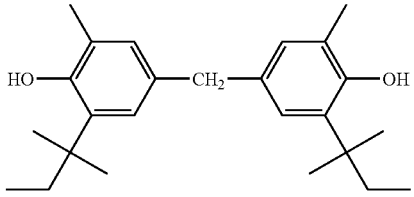

-continued (YL-8)

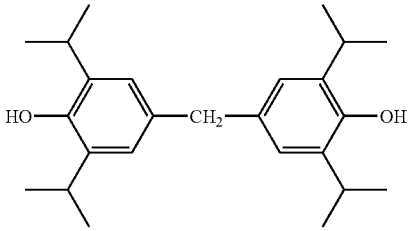

(YL-9)

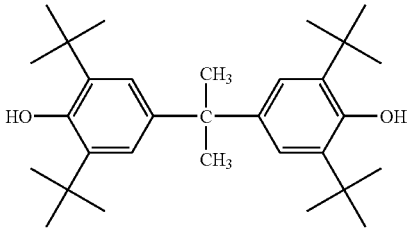

(YL-10)

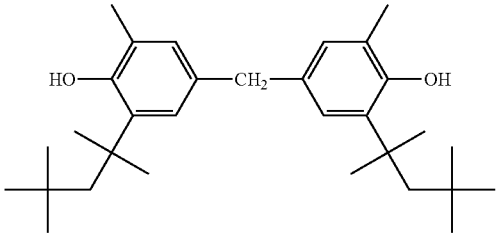

(YL-11)

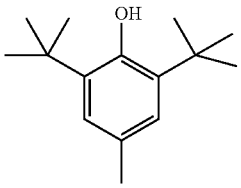

(YL-12)

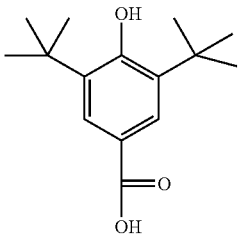

(YL-13)

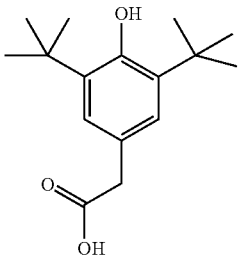

-continued (YL-14)

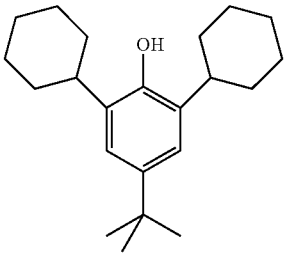

(YL-15)

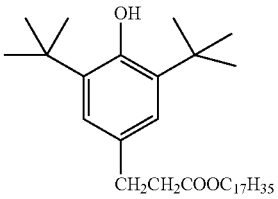

The added amount of the compound represented by Formula YL is usually 0.00001–0.01 moles per mole of silver, preferably 0.005–0.01 moles, and more preferably 0.001–0.008 moles.

Cyan Color Forming Leuco Dye

The cyan color forming leuco dye will now be described below. In this invention, a color image forming agent which increases in light absorbancy to 600–700 nm by oxidation is preferably employed as the cyan color forming leuco dye. Examples of the cyan color forming leuco dye are compounds having a $\lambda_{max}$ within the range of 600–700 nm described in JP-A 59-206831, compounds represented by Formulas I–IV (specifically, Compounds 1–18 described in paragraphs 0032–0037) of JP-A 5-204087, and compounds represented by Formulas 4–7 (specifically, Compounds 1–79 described in paragraph 0105) of JP-A 11-231460.

Specifically preferable cyan color forming leuco dyes employed in this invention are represented by following Formula CL.

Formula CL

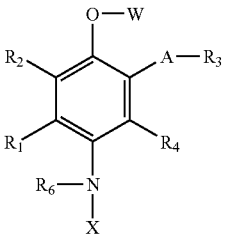

In this formula, $R_1$ and $R_2$ are each a hydrogen atom, a halogen atom, a substituted or unsubstituted alkyl group, a substituted or unsubstituted alkenyl group, a substituted or unsubstituted alkoxy group, an —$NHCOR_{10}$ group in which $R_{10}$ is an alkyl group, an aryl group or a heterocyclic group, and further $R_1$ and $R_2$ may form an aliphatic hydrocarbon ring, an aromatic hydrocarbon ring or a heterocyclic ring by bonding with each other. "A" is an —NHCO— group, a —CONH— group or an —NHCONH— group, while $R_3$ is a substituted or unsubstituted alkyl group or aryl group, a heterocyclic group, or —A—$R_3$ is a hydrogen atom. W is a hydrogen atom, a —CONH—$R_5$ group, a —CO—$R_5$ group or a —CO—O—$R_5$ group, in each of which $R_5$ is an alkyl group, an aryl group or a heterocyclic group each of which may have a substituent. $R_4$ is a hydrogen atom, a halogen atom, a substituted or unsubstituted alkyl group, an alkoxy group, a carbamoyl group or a nitrile group. $R_6$ is a —CONH—$R_7$ group, a —CO—$R_7$— group or a —CO—O—$R_7$— group in which $R_7$ is a substituted or unsubstituted alkyl group, an aryl group or a heterocyclic group. X is a substituted or unsubstituted aryl group or a heterocyclic group.

In above Formula CL, the halogen atom is a fluorine atom, a bromine atom or a chlorine atom; the alkyl group is an alkyl group having 20 or less carbon atoms such as a methyl group, an ethyl group, a butyl group or a dodecyl group; the alkenyl group is an alkenyl group having 20 or less carbon atoms such as a vinyl group, an allyl group, a butenyl group, a hexenyl group, a hexadienyl group, an ethenyl-2-propenyl group, a 3-butenyl group, a 1-methyl-3-propenyl group, a 3-pentenyl group and a 1-methyl-3-butenyl group; the alkoxy group is one having 20 or less carbon atoms such as a methoxy group and an ethoxy group; the aryl group is an aryl group having 6–20 carbon atoms such as a phenyl group, a naphthyl group and a thienyl group; while the heterocyclic group is a thienyl group, a furyl group, an imidazolyl group, a pyrazolyl group or a pyrrolyl group. "A" is an —NHCO— group, a —CONH— group or an —NH-CONH— group, while $R_3$ is a substituted or unsubstituted alkyl group, preferably an alkyl group having 20 or less carbon atoms such as a methyl group, an ethyl group, a butyl group or a dodecyl group; an aryl group, preferably having 6–20 carbon atoms such as a phenyl group, a naphthyl group or a thienyl group, or a heterocyclic group such as a thienyl group, a furyl group, an imidazolyl group, a pyrazolyl group or a pyrrolyl group, or —A—$R_3$ is a hydrogen atom. W is a hydrogen atom, a —CONH—$R_5$ group, a —CO—$R_5$ group or a —CO—O—$R_5$ group, in which $R_5$ is a substituted or unsubstituted alkyl group, preferably an alkyl group having 20 or less carbon atoms such as a methyl group, an ethyl group, a butyl group or a dodecyl group; an aryl group, preferably having 6–20 carbon atoms such as a phenyl group, a naphthyl group or a thienyl group, or a heterocyclic group such as a thienyl group, a furyl group, an imidazolyl group, a pyrazolyl group and a pyrrolyl group. $R_4$ is preferably a hydrogen atom, a halogen atom such as a fluorine group; a chlorine atom, a bromine atom or an iodine atom; a substituted or unsubstituted alkyl group such as a methyl group, a butyl group, a dodecyl group or a cyclohexyl group; an alkoxy group such as a methoxy group, a butoxy group and a tetradecyloxy group; a carbamoyl group such as a diethylcarbamoyl group or a phenylcarbamoyl group, or a nitrile group. Of these, the hydrogen atom and the alkyl group are more preferable. $R_1$ and $R_2$, or $R_3$ and $R_4$, each may be bonded to form a ring structure. The above groups may each have one or more substituents; examples of the typical substituents which can be introduced to the aryl group include a halogen atom such as a fluorine atom, a chlorine atom and a bromine atom, an alkyl group such as a methyl group, an ethyl group, a propyl group, a butyl group and dodecyl group; a hydroxyl group, a cyano group, a nitro group, an alkoxy group such as a methoxy group or an ethoxy group; an alkylsulfonamide group such as a methylsulfonamido group or an octylsulfonamido group; an arylsulfonamido group such as a phenylsulfonamido group or a naphthylsulfonamido group; an alkylsulfamoyl group such as a butylsulfamoyl group; an arylsulfamoyl group such as a phenylsulfamoyl group; an alkyloxycarbonyl group such as a methoxycarbonyl group; an aryloxycarbonyl group such as a phenyloxycarbonyl group, an aminosulfonamido group, an acylamino group, a carbamoyl group, a sulfonyl group, a sulfinyl group, a sulfoxy group, a sulfo group, an aryloxy group, an alkoxy group, an alkylcarbonyl group, an arylcarbonyl group or an aminocarbonyl group. $R_{10}$ and $R_{85}$ are each preferably a phenyl group, but more preferably a phenyl group having plural substituents including a halogen atom and a cyano group.

$R_6$ is a —CONH—$R_7$ group, a —CO—$R_7$ group or a —CO—O—$R_7$ group in which $R_7$ is a substituted or unsubstituted alkyl group, preferably one having 20 or less carbon atoms such as a methyl group, an ethyl group, a butyl group or a dodecyl group; an aryl group, preferably one having 6–20 carbon atoms such as a phenyl group, a naphthyl group or a thienyl group; or a heterocyclic group such as a thiophen group, a furyl group, an imidazolyl group, a pyrazolyl group or a pyrrolyl group. As a substituent of the alkyl group represented by $R_7$, the same ones as those for $R_1$–$R_4$ are applicable. X is a substituted or unsubstituted aryl group or heterocyclic group. The aryl group is one having 6–20 carbon atoms such as a phenyl group, a naphthyl group or a thienyl group, while the heterocyclic group is one of such as a thienyl group, a furyl group, an imidazolyl group, a pyrazole group or a pyrrolyl group. As groups capable of being the substituent represented by X, the same ones as those of $R_1$–$R_4$ are applicable. The group represented by X is preferably an aryl group substituted by an alkylamino group such as a diethylamino group at the para position, or a heterocyclic group. These groups may incorporate a photographically effective group.

Specific examples of the cyan color forming leuco dyes are listed below, however the leuco dye is not limited to them.

(CL-1)

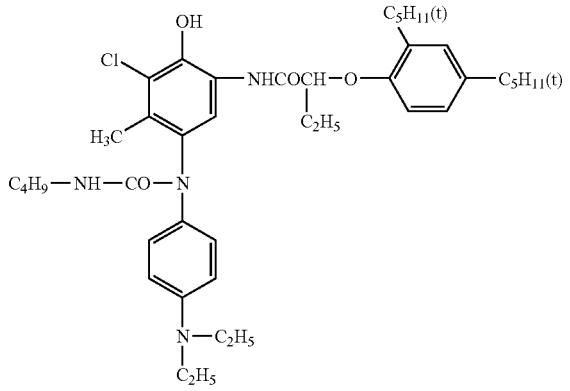

(CL-2)

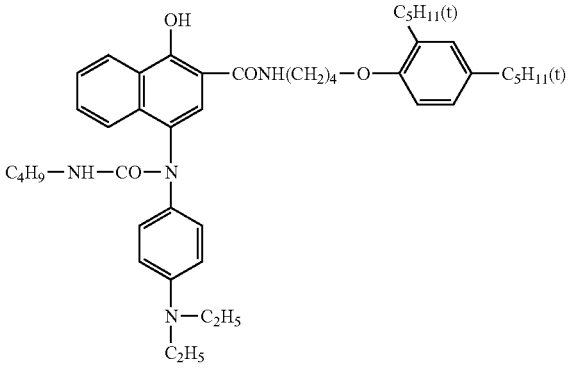

-continued
(CL-3)
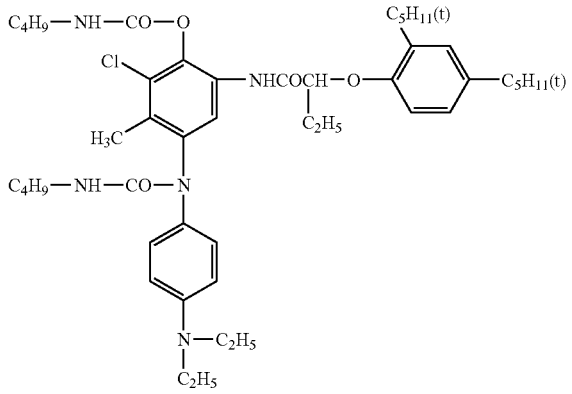
(CL-4)
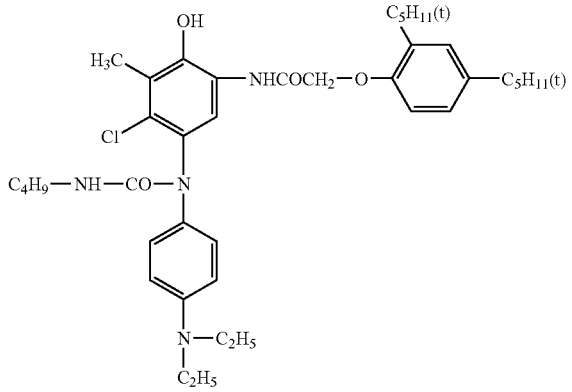
(CL-5)
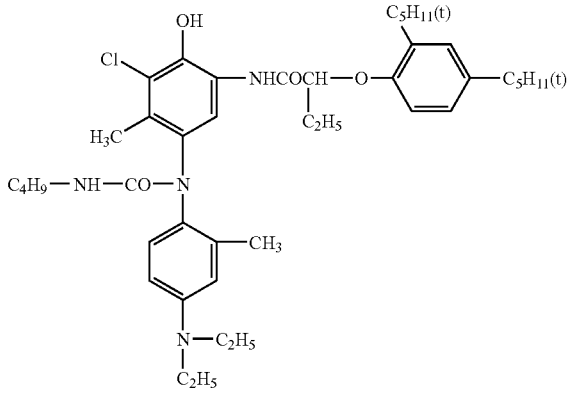
(CL-6)
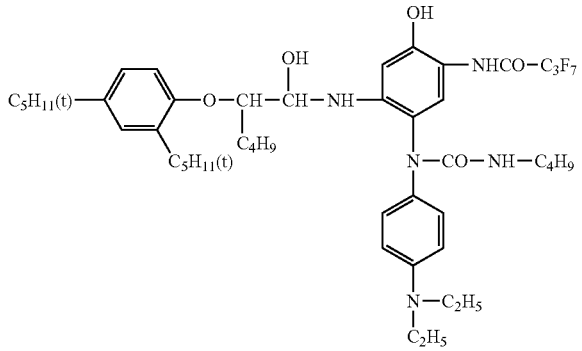
-continued
(CL-7)
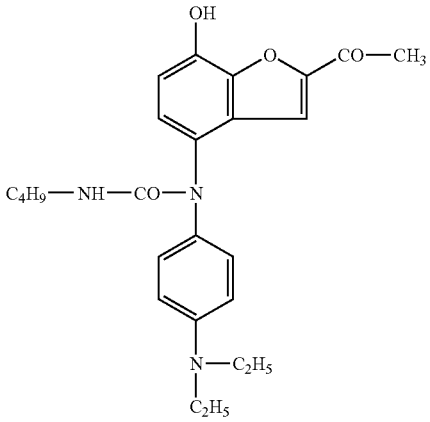
(CL-8)
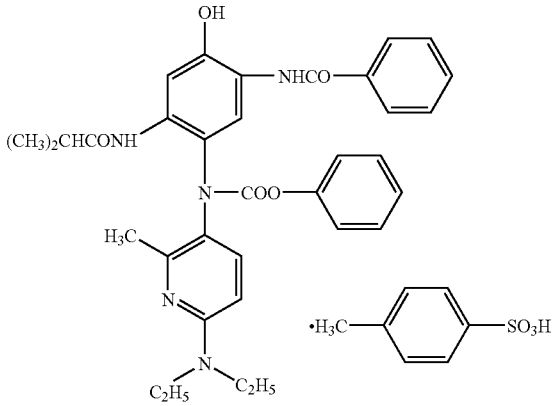
(CL-9)
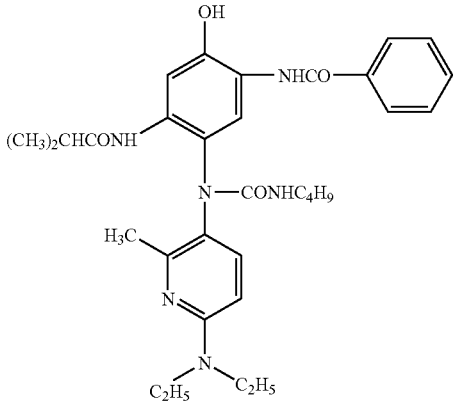

-continued (CL-10)

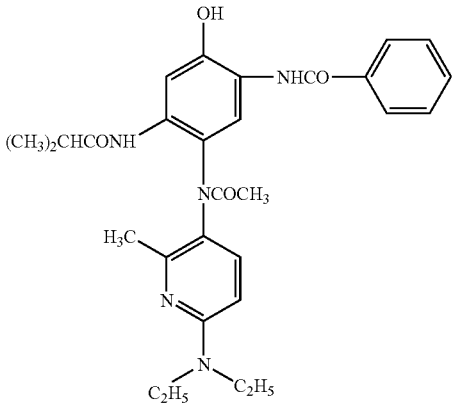

(CL-11)

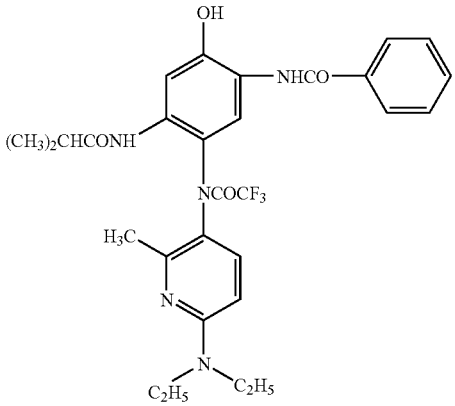

(CL-12)

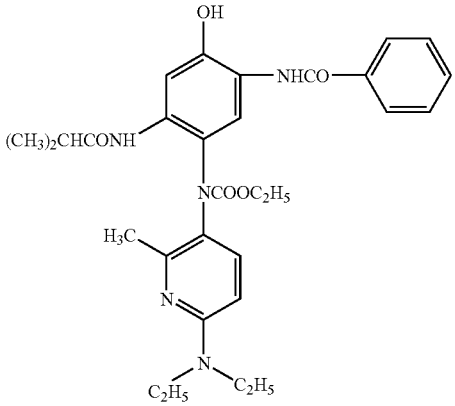

The added amount of the cyan color forming leuco dye is usually 0.00001–0.05 moles per mole of silver, preferably 0.0005–0.02 moles, but more preferably 0.001–0.01 moles.

The compound represented by Formula YL and the cyan color forming leuco dye may be added by the same methods as that for the reducing agents represented by Formula RED, and they may be added to the coating composition in the form of a solution, an emulsion or a solid microscopic particle dispersion, so as to be incorporated in the light sensitive material.

Though the compound represented by Formula YL and the cyan color forming leuco dye are preferably incorporated in an image forming layer incorporating the organic silver salt, it is acceptable that one of them is incorporated in the image forming layer while the other is incorporated in a non-image forming layer adjacent to the image forming layer, or that both of them are incorporated in the non-image forming layer, however they may be separately added to the image forming layers when the image forming layer is constituted of plural layers.

Other Matters

Employable as material of the support employed in the silver salt photothermal photographic dry imaging material, are various kinds of polymer materials, glass, wool or cotton cloth and paper, and metal such as aluminum. Ones capable of being formed as an elastic sheet or a roll are preferable in terms of handling as the information recording material. Accordingly, plastic film such as cellulose acetate film, polyester film, poly(ethylene terephthalate) film, poly(ethylene naphthalate) film, polyamide film, polyimide film, cellulose triacetate film and polycarbonate film is preferable, and two-axis elongated poly(ethylene terephthalate) film is particularly preferred. The thickness of the support is typically about 50–300 μm, and preferably 70–180 μm.

In this invention, a metal oxide and/or an electroconductive polymer may be contained in a structural layer to improve the anti-static property. Though the foregoing may be contained in any layer, they are preferably in the undercoating layer, the backing layer or a layer provided between the light-sensitive layer and the undercoating layer. The electroconductive compounds, described in U.S. Pat. No. 5,244,773, columns 14–20, are preferably employed in this invention.

The silver salt photothermal photographic dry imaging material has at least one light-sensitive layer deposited on a support. Though only the light-sensitive layer may be formed on the support, it is preferable to provide at least one non-light sensitive layer on the light-sensitive layer. For example, it is preferable that a protective layer to protect the light-sensitive layer is provided on the light-sensitive layer and a backing layer, to prevent adhesion in the wound up imaging material, is provided on the opposite side of the support. As a binder, employed in the protective layer and the backing layer, a polymer having a higher glass transition point than the thermal developable layer, as well as high resistance to scratching, such as cellulose acetate and cellulose acetate butylate is preferred for the foregoing binders. In this invention, it is preferable that the light-sensitive layer is constituted of two or more layers to control gradation. For example, it is acceptable that two or more layers are provided on one side, or one or more layers are provided on both sides of the support.

In the silver salt photo-thermal photographic imaging material of this invention, it is preferable that a filter layer is provided on the light-sensitive side or opposite side of the support, or that a dye or a pigment is contained in the light-sensitive layer to control the amount, or the wavelength distribution, of light passing through the light-sensitive layer.

For the dye, compounds known to absorb various ranges of wavelength are employable, based on the spectral sensitivity of the light-sensitive material.

For example, when the silver salt photo-thermal photographic dry imaging material is produced as an image recording material via infrared rays, preferably employed are a squalilium dye having a thiopyrylium nucleus, hereinafter referred to as a thiosqualiliumpyrylium dye, or a squalilium dye having a pyrylium nucleus, hereinafter referred to as a pyryliumsqualilium dye, disclosed in JP-A 11-255557, and a thiopyryliumchroconium dye similar to the squalilium dye, or a pyrylionchroconium dye.

The compound having a squalilium nucleus is one having 1-cyclobutene-2-hydroxy-4-one, while the compound having a chroconium nucleus is a compound having 1-cyclopentene-2-hydroxy-4,5-dinone in the molecular structure. In these compounds, the hydroxyl group may be dissociative. Hereinafter, for convenience these dyes are collectively referred to as squalilium dyes.

The compounds described in JP-A 8-201959 are also preferable as the dye.

Layer Constitution and Coating Conditions

The silver salt photo-thermal photographic dry imaging material of this invention may be prepared by preparing a coating composition for each of the constituting layers by dissolving or dispersing the raw materials for each layer, and by coating the coating compositions on the support, after which it is subjected to a heat treatment. The water content in the coating composition which forms the light-sensitive layer is preferably at least 30%, and more preferably at least 50%. Though there is no upper limit to the water content, the amount of the solvent is preferably less from the view point of loading on the environment, and further it is preferable that the entire solvent is water. In this invention, it is preferable that plural coating compositions are simultaneously applied to form laminated layers and then subjecting them to heat treatment. "simultaneously coating" is a process to form laminated layers in which the coating compositions for each of the constituting layers, such as a light-sensitive layer or a protective layer are individually prepared but the coating compositions are simultaneously coated and dried; specifically, the laminated layers are not formed by repeated separate coating and drying of each of the coating compositions. In the simultaneous coating process, the successive layer is provided before the remaining amount of the solvent in the previous layer reachs less than 70% by weight.

The method for simultaneously coating the plural constituting layers is not specifically limited, and known methods such as a bar coater method, a curtain coating method, a dipping method, an air-knife method, a hopper coating method, and an extrusion coating method are all applicable. Among these, a pre-measuring coating method of the so-called extrusion method is more preferable, since this method is suitable for high precision coating and coating of organic solvent coating composition since evaporation of the solvent from the slide face is not generated. Though the coating method is described for coating on the light-sensitive layer side, the same method may be applied for simultaneous coating of a backing layer and an undercoating layer.

In this invention, the coating amount of silver is preferably 0.5–2.0 g/m$^2$, but more preferably 1.0–1.5 g/m$^2$.

Further, the content of the silver halide grains having a diameter of 0.030 μm–0.055 μm in the silver halide emulsion is preferably 3–15% in terms of silver in the above coated silver halide emulsion of 0.5–1.5 g/m$^2$.

In the coating amount of silver, the silver amount originated in the silver halide is preferably 2–18% of the total silver content, and more preferably 3–15%.

In this invention, the coated density of the silver halide grains, each having a diameter (or a sphere equivalent diameter) of at least 0.01 μm is preferably $1\times10^{14}$–$1\times10^{18}$ grains/m$^2$, but more preferably $1\times10^{15}$–$1\times10^{17}$ grains/m$^2$.

Further, the coated density of the silver aliphatic carboxylate of this invention is $10^{-17}$–$10^{-15}$ g, but more preferably $10^{-16}$–$10^{-14}$ g, per silver halide grain at a diameter (or at sphere equivalent diameter) of not less than 0.01 μm.

Good results can be obtained from the viewpoint of the optical density of the silver image per unit amount of the coated silver, or of the covering power of silver, as well as of the tone of the silver image.

Image Recording Method

In this invention, the developing conditions typically include a process for heating the image exposed silver salt photothermal photographic dry imaging material at a suitably high temperature even though conditions vary depending on the device, apparatus or means. The latent image formed via exposure to light can be developed by heating the silver salt photo-thermal photographic dry imaging material at a moderately high temperature, such as about 80–200° C. but preferably about 100–200° C., for an adequate time, generally about 1–120 seconds.

When the heating temperature is at most 80° C., sufficient density can not obtained during a short duration while when the temperature is at least 200° C., adverse influences result not only to the image but also to the conveying property and the developing device due to melting of the binder and transferring of the molten binder onto the rollers. The silver image is formed via a redox reaction between the organic silver salt functioning as an oxidant and the reducing agent under application of heat. The reaction process progresses without any external treating liquid, such as water.

Heating may be performed via any typical heating means such as a hot plate, an iron bar, a hot roller or a heat generator using carbon or white titanium. It is more preferable from the viewpoint of uniform heating, thermal efficiency and working ease that the heating treatment is performed by direct contact of the heating means, the surface of the protective layer side of the silver salt photothermal photographic dry imaging material carrying the protective layer, specifically the development is preferably performed by conveying the imaging material while contacting the surface of the heated rollers.

It is desirable, when exposing the imaging material, to use a suitable light source matching the spectral sensitivity of the silver salt photo-thermal photographic dry imaging material. For example, when the imaging material is infrared sensitive, an infrared semiconductor laser (780 nm or 820 nm) is preferably employed since the output of such device is high and the light-sensitive material may be transparent, even: though any light source can be employed as long as it emits light within in the infrared region.

In this invention, exposure is preferably carried out by scanning, for which various exposing methods are applicable. For example, a method using a laser scanning exposure apparatus is applicable as the most preferable method, in which the scanning laser light beam meets the surface of the light-sensitive material at an almost right angle. The term "almost a right angle" means that the angle is preferably 55°–88°, more preferably 60°–86°, further preferably 65°–84°, but most preferably 70°–82°.

The diameter of the laser light beam on the exposed surface is preferably a maximum of 200 μm, but more preferably a maximum of 100 μm when the silver salt photo-thermal photographic dry imaging material is scanned by the laser light. A smaller spot is preferable since the angle of the incident laser beam from the right angle can be reduced. The lower limit of the spot diameter of the laser beam is 10 μm. By the use of such a laser scanning exposure, degradation in image quality relating to light reflection, such as occurrence of interference fringe-like density unevenness, can be reduced.

Preferable as the second method is exposure employing a laser scanning exposing apparatus generating longitudinal multiple laser light beams. Degradation in image quality caused by interference fringe-like density unevenness is reduce when compared to scanning by vertical single-mode laser light.

To produce the longitudinal multiple light beams, methods by synthesizing waves applied to returned light, and overlapping high frequency waves are suitable. "Longitudinal multiple" means that the wavelength of the exposing light is not unified, and the distribution of the wavelength of the exposing light is preferably at least 5 nm, but more preferably at least 10 nm. The upper limit of the wavelength distribution of the exposing light is usually about 60 nm, even though the upper limit of the wavelength distribution is not specifically limited.

As the third method, it is preferable to form the image by scanning via two or more laser beams.

The image recording method using plural laser beams is an image writing technique typically applied for laser printers and digital copying machines in which plural lines of the image are written in a single scan in response to requirements of high resolution and high speed, an example of such a method is shown in JP-A 60-166916. In the method, laser light emitted from a light source is deflected by a polygon mirror and focused on the light sensitive material via an fθ lens. Such laser scanning optical apparatus operates on the same principle as a laser imager.

In the writing means for laser printers and digital copying machines, a laser beam is focused at a position away from the focusing position of the preceding beam for writing plural lines in one scan. Specifically, the two beams are spaced at a distance of several tens of micrometer on the imaging face in the sub-scanning direction, in which the pitch of the two beams is 63.5 μm when the printing density is 400 dpi (dpi, dot per inch, Or 2.54 cm), and 42.3 μm when the printing density is 600 dpi. In this invention, in different forms of the above method, two or more light beams are focused at the same point each at a different incident angle to form the image. In this method, when the image is commonly written via single laser beam at a wavelength of λ nm and the energy at the exposing face is E, the entire energy of N beams is preferably within the range of $0.9\times E \leqq En\times N \leqq 1.1\times E$ when the wavelength (λ nm) and the exposing energy (En) are the same as those of exposure by the single beam. Via exposure under the above conditions, the energy amount at the exposing face can be ensured, however the reflection of each of the beams on the image forming layer is reduced because the exposing energy of the laser beam is reduced whereby interference fringes are inhibited.

In the above case, plural laser beams having the same wavelength are employed. However, beams of different wavelength from each other may also be employed. In such a case, the range of the wavelength is preferably within $(\lambda-30)<\lambda_1, \lambda_2, \ldots \leqq(\lambda+30)$ in terms of λ nm.

In the foregoing 1st–3rd embodiments of the image forming method, examples of well known lasers are: a solid laser such as a ruby laser, a YAG laser and a glass laser; a gas laser such as a He—Ne laser, an Ar laser, a Kr laser, a $CO_2$ laser, a CO laser, a He—Cd laser, an $N_2$ laser and an excimer laser; a semiconductor laser such as an InGaP laser, an AlGaAs laser, a GaAsP laser, an InGaAs laser, an InAsP laser, a $CdSnP_2$ laser and a GaSb laser; a chemical laser; as well as a dye laser. Among these, a semiconductor laser, emitting light at a wavelength of 600–1200 nm is preferably employed from the viewpoint of maintenance and size of the light source. In laser imagers and laser image setters, the spot diameter of the laser beam on the light-sensitive material is 5–75 μm in the minor axis and 5–100 μm in the major axis. The scanning rate by the laser beam can be set to be suitable for individual light-sensitive materials based on the specific sensitivity to the wavelength of the light emitted from the laser and the output power of the laser.

In this invention, the silver salt photo-thermal photographic dry imaging material preferably contains 5–1,000 $mg/m^2$ of a solvent during development, however the content of the solvent is more preferably 100–500 mg, since by such content the above material results in high sensitivity, low fogging and high density.

The solvent in this invention may, for example be, a ketone such as acetone, methyl ethyl ketone or isophorone; an alcohol such as methyl alcohol, ethyl alcohol, iso-propyl alcohol, cyclohexanol or benzyl alcohol; a glycol such as ethylene glycol, diethylene glycol, triethylene glycol, propylene glycol or hexylene glycol; an etheralcohol such as ethylene glycol monomethyl ether and diethylene glycol monoethyl ether, an ester such as ethyl acetate or butyl acetate; a chloride such as methylene chloride or dichlorobenzene; or a hydrocarbon. Other than the above, water, formamide, dimethylformamide, toluidine, tetrahydrofuran or acetic acid are also employable. The solvent is not limited to the above, and further solvents may be employed singly or in combination of plural kinds thereof.

The content of the solvent in the light-sensitive material can be controlled, for example, by varying the thermal condition during the drying process after coating. Further, the content of the solvent can be measured via gas chromatography under conditions suitable for detecting the added solvent.

EXAMPLES

This invention is specifically described below referring to examples, but this invention is not limited to these examples.

Example 1

Preparation of Photographic Support

The surface of a blue tinted poly(ethylene terephthalate) film base, exhibiting an optical density of 0.170 and a thickness of 175 μm was subjected to corona discharge of 0.5 $kV\cdot A\cdot min/m^2$, after which undercoating layer A was applied onto the base surface using following undercoating composition A-1, for a dry thickness of undercoating layer A of 0.2 μm. After that, the other surface of the base was subjected to corona discharge of 0.5 $kV\cdot A\cdot min/m^2$, undercoating layers B and A were each applied using the following undercoating compositions B-1 and A-1, respectively, for a dry thickness of each of the coated layers of 0.1 and 0.2 μm respectively. Then the film base was heated at 130° C. for 15 minutes in a heat treatment oven incorporating a film conveying apparatus.cc Undercoating Composition A-1

Mixed were 270 grams of a latex (solid content of 30%) of a copolymer of 40 weight-% of butyl acrylate, 10 weight-% of t-butyl acrylate, 25 weight-% of 2-hydroxyethyl acrylate, 0.6 g of Compound UL-1 and 1 g of methyl cellulose. Further, the resultant mixture was added to a dispersion prepared by dispersing 1.3 g of silica particle Syloid 350, manufactured by Fuji Sylicia Co., Ltd., to 100 g of water for 30 minutes via an ultrasonic dispersing machine Ultrasonic Generator, manufactured by Alex Corp., at a frequency of 24 kHz and an output of 600 W, and brought to a final volume of 1,000 ml by water to prepare Undercoating Liquid A-1.

UL-1

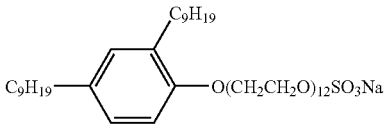

Undercoating Composition B-1

Undercoating Composition B-1 was prepared by the following procedure: 37.5 g of the following dispersion of colloidal tin oxide, 3.7 g of latex (at a solid content of 30%) of a copolymer of 10 weight % of n-butyl acrylate, 35 weight % of t-butyl acrylate, 27 weight % of styrene and 28 weight % of 2-hydroxyethyl acrylate, 14.8 g of latex (at a solid content of 30%) of a copolymer of 40 weight % of n-butyl acrylate, 20 weight % of styrene and 40 weight % of glycidyl methacrylate, 0.1 g of Surfactant UL-1 as a coating aid were mixed and brought to 1,000 ml by addition of water.

Preparation of Colloidal Tin Oxide Dispersion

A uniform solution was obtained by dissolving 65 g of tin (IV) chloride hydrate in 2,000 ml of a water/ethanol mixted solution, after which the solution was boiled to obtain a co-precipitate. The precipitate was retrieved by decantation and repeatedly washed with distiled water. After confirmation of absence of any chlorine ions in the distiled water used for the washing, by drops of a silver nitrate solution, pure water was added to the washed precipitates to reach a total volume of 2,000 ml. Further, 40 ml of 30% ammonia solution was added and heated, and then the resultant mixture was concentrated to 470 ml to obtain Colloidal Tin Oxide Dispersion.

Coating of Backing Layer

Preparation of Backing Layer Coating Composition

Into 700 g of methyl ethyl ketone, from now on referred to as MEK, 84 g of cellulose butylate•acetate CAB 381-20, manufactured by Eastman Chemical Co., Ltd., and 4.5 g of polyester resin, Vitel PE200B, manufactured by Bostic Co., Ltd., were added and dissolved. To the resultant solution, 4.4 g of a fluorosurfactant (being Compound FS-1), and 1.79 g of a fluorosurfactant, EF-105, both manufactured by Tochem Products Co., Ltd., were added and stirred for total dissolution. Finally, 57 g of silica particle, Syloid SY450, manufactured by Fuji Silysia Co., Ltd., dispersed in MEK at a concentration of 2% by weight, via a dissolver type homogenizer, was added to the above solution and the total weight of the mixture was brought to 1,000 g via MEK to prepare Backing Layer Coating Composition 101.

Backing Layer Coating Compositions 102–115 were obtained in the same manner as Backing Layer Coating Composition 101 except that the matting agent particle was changed as listed in Table 1.

The compounds relating to this invention listed in Table 1, were each employed in a previously prepared dispersion by dispersing 2.0 g of the compound and 2.0 g of the surfactant listed in Table 1 in an ultrasonic dispersing machine, Ultrasonic Generator, manufactured by Alex Corp., at a frequency of 25 kHz and an output of 600 W in 100 g of MEK, in which 3 g of cellulose acetate•butylate CAB381-20, manufactured by Eastman Chemical Co., Ltd., was previously dissolved. Each of the dispersions was added as that described in Table 1.

Thus prepared backing layer coating compositions were each coated via an extrusion coater so as the dry thickness was 3.5 μm and dried at 100° C. over 5 minutes via blown air exhibiting a dew point of 10° C., to prepare backing coated Samples 101–115.

The details of each of the additives listed in abbreviated names in Table 1 are as follows.

Matting Particle 1: Syloid SY450 (Fuji Silysia Co., Ltd.)

Matting Particle 2: Sunsphere H-51 (Asahi Glass Co., Ltd.)

Comparative 1: Carnauba Wax

Comparative 2: $C_6H_{13}CH(OH)C_{10}H_{20}COOC_{40}H_{81}$

Compound FS-1

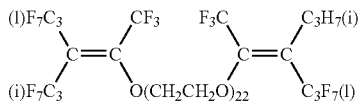

Evaluation of Samples

Measurement of Dynamic Frictional Coefficient

The dynamic frictional coefficient of the backcoating surface against stainless steel was measured by a surface properties measuring apparatus HEIDON-14, manufactured by Shinto Kagaku Co., Ltd., while heated at. 110° C. via a hot plate.

Measurement of Haze

Haze was measured by a turbidimeter, Model T-2600DA, manufactured by Tokyo Denshoku Co., Ltd. The haze is shown in percent.

Measurement of Matting Degree

Each of the samples was subjected to thermal developing treatment at 123° C. for 13.5 seconds via an automatic developing apparatus having a heating drum in the state that the surface of the sample opposite to the backing surface was in contact with a heated drum, and then conditioned for 3 hours under at 23±2° C. and 55% RH. After that the suction force on the backing surface of the sample was measured before and after development under the same conditions via Smoostar, manufactured by Toei Denshi Kogyo Co, Ltd. The measured values are shown in kPa.

Results obtained via the above measurements are listed in Table 1.

TABLE 1

| Sample No. | Matting particle Kind | Matting particle Average particle diameter (μm) | Matting particle Adding amount (mg/m$^2$) | Compound relating to the invention Kind | Compound relating to the invention Average particle diameter (μm) | Compound relating to the invention Added amount (mg/m$^2$) | Surfactant | Dynamic friction co-efficient (μk) | Haze | Matting degree (kPa) Before thermal devel-opment | Matting degree (kPa) After thermal devel-opment | Remarks |
|---|---|---|---|---|---|---|---|---|---|---|---|---|
| 101 | Matting particle 1 | 10.5 | 50 | — | — | — | FS-1/EF-105 | 0.39 | 9.5 | 24.6 | 24.7 | Comp. |
| 102 | Boron nitride | 5.6 | 50 | — | — | — | FS-1/EF-105 | 0.35 | 10.5 | 9.8 | 9.6 | Comp. |
| 103 | — | — | — | OW-8 | 5.2 | 50 | FS-1/EF-105 | 0.29 | 8.4 | 8.4 | 6.1 | Inv. |
| 104 | — | — | — | OW-27 | 7.8 | 50 | FS-1/EF-105 | 0.23 | 7.9 | 16.6 | 16.8 | Inv. |
| 105 | — | — | — | OW-29 | 6.9 | 50 | FS-1/EF-105 | 0.25 | 8.5 | 15.3 | 15.2 | Inv. |
| 106 | — | — | — | OW-35 | 8.5 | 50 | FS-1/EF-105 | 0.27 | 8.3 | 17.8 | 18.0 | Inv. |
| 107 | — | — | — | OW-51 | 6.5 | 50 | FS-1/EF-105 | 0.26 | 8.6 | 14.0 | 13.7 | Inv. |
| 108 | — | — | — | PW-1 | 3.6 | 50 | FS-1/EF-105 | 0.32 | 9.4 | 6.0 | 6.1 | Inv. |
| 109 | — | — | — | PW-4 | 10.3 | 50 | FS-1/EF-105 | 0.26 | 8.7 | 21.9 | 18.0 | Inv. |
| 110 | — | — | — | OW-27 | 7.8 | 50 | EF-105 | 0.30 | 9.6 | 19.3 | 19.8 | Inv. |
| 111 | Matting particle 1 | 10.5 | 10 | OW-27 | 7.8 | 60 | FS-1/EF-105 | 0.27 | 8.7 | 24.6 | 24.9 | Inv. |
| 112 | Matting particle 2 | 5.8 | 25 | OW-27 | 7.8 | 60 | FS-1/EF-105 | 0.25 | 8.4 | 25.3 | 25.4 | Inv. |
| 113 | — | — | — | Comparative 1 | 4.7 | 50 | FS-1/EF-105 | 0.32 | 9.1 | 8.6 | 3.1 | Comp. |
| 114 | — | — | — | Comparative 2 | 0.21 | 50 | FS-1/EF-105 | 0.39 | 7.7 | 0.40 | 0.27 | Comp. |
| 115 | Matting particle 2 | 5.8 | 50 | — | — | — | FS-1/EF-105 | 0.41 | 8.7 | 14.0 | 14.0 | Comp. |

Comp.: Comparative sample
Inv.: This invention

As is shown in Table 1, each sample having the backing layer of this invention exhibits a lower dynamic friction coefficient as well as haze and suitable matting degree, compared to the comparative samples.

Example 2

Preparation of Additives

Preparation of Light-Sensitive Silver Halide Emulsion A-1

In 900 ml of water, 7.5 g of ossein gelatin at an average molecular weight of 100,000, and 10 mg of potassium bromide, were dissolved. The resultant solution was brought to a temperature of 35° C. and a pH of 3.0, and then added were 370 ml of an aqueous solution containing 74 g of silver nitrate, an aqueous solution containing the equivalent moles to the silver of potassium bromide and potassium iodide at a mole ratio of 98:2 and a solution containing $1\times10^{-4}$ moles per mole of silver of iridium chloride over 10 minutes via a controlled double jet method while maintaining pAg at 7.7. After that, 0.3 g of 4-hydroxy-6-methyl-1,3,3a,7-terazaindene was added and the pH was adjusted to 5.0. Thus cubic silver iodobromide grains at an average grain size of 0.06 μm, a variation coefficient and a [100] face ratio of 87% were obtained. The resultant emulsion was coagulated and precipitated via a coagulating agent for desalination. Following that, to obtain Light-sensitive Silver Halide Emulsion A-1, 0.1 g of phenoxyethanol was added and the pH and pAg were each adjusted to 5.9 and 7.5, respectively.

Preparation of Organic Silver Salt Powder A-1

In 9450 ml of purified water, 324 g of behenic acid, 99 g of arachidic acid and 56 g of stearic acid were dissolved at 80° C. Then 980 ml of a 1.5 moles/liter aqueous solution of sodium hydroxide was added while stirring vigorously. Next, the resultant solution was cooled to 55° C. after addition of 9.3 ml of concentrated nitric acid and stirred for 30 minutes. After this the foregoing light-sensitive silver halide emulsion A-1 containing 0.9 moles of silver and 1,400 g of water was added over 5 seconds and stirred for 5 minutes. Thereafter, 1470 ml of a 1 mole/liter silver nitrate solution was added over 2 minutes and the resultant liquid was stirred for 20 minutes and filtered to remove water soluble salts. After that, the precipitate was repeatedly washed with deionized water and filtered until the electroconductance of the filtrate become 2 μS/cm, and the precipitate was then subjected to centrifugation. The separated matter was dried via 37° C. warmed air until the weight was stable during drying to obtain Organic Silver Salt Powder A-1.

Preparation of Light-Sensitive Emulsion Dispersion A-1

In 1457 g of methyl ethyl ketone, 14.75 g of poly(vinyl butyral) powder was dissolved and 500 g of organic silver salt powder A-1 was gradually added while stirring via a dissolver type homogenizer and thoroughly mixed. After that, the resultant mixture was treated by amedia type dispersing machine, manufactured by Gettamann Co., Ltd., which machine was filled with 1 mm Zr beads of 80%, at a circumference speed of 13 m/sec and remained in the mill for 3 minutes to obtain Light-sensitive Emulsion Dispersion A-1.

Preparation of Infrared Sensitizing Dye Solution

An infrared solution was prepared by dissolving 350 mg of infrared sensitizing dye 1, 13.96 g of 2-chloro-benzoic acid and 2.14 g of 5-methyl-2-mercaptobenzimidazole in 73.4 ml of methanol, under darkened condition.

Preparation of Stabilizer Solution

A stabilizer solution was prepared by dissolving 1.0 g of Stabilizer 1 and 0.5 g of potassium acetate in 8.5 g of methanol.

Preparation of Developing Agent Solution

A developing agent solution was prepared by dissolving 17.74 g of Developing Agent 1 in MEK and brought to 100 ml with water.

Preparation of Antifoggant Solution

An antifoggant solution was prepared by dissolving 5.81 g of Antifoggant 2 in MEK and brought to 100 ml with water.

| | |
|---|---|
| Phthalazine | 305 mg |
| Tetrachlorophthalic acid | 102 g |
| 4-Methylphthalic acid | 137 mg |
| After stirring for 15 minutes | |
| Antifoggant solution (foregoing) | 5.47 ml |
| Developing agent solution (foregoing) | 14.06 ml |

The above additives were successively added and stirred to obtain Image Forming Layer Coating Composition 201. Image Forming Layer Coating Composition 202 was prepared in the same manner as in Image Forming Layer Coating Composition 201 except that the development accelerating agent 3, described in Table 2, was added.

Infrared sensitizing dye 1

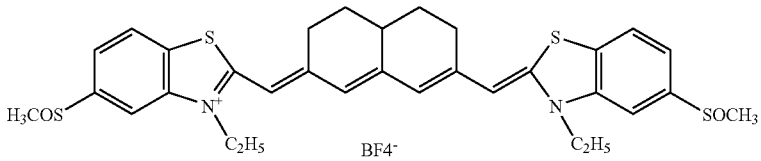

Stabilizer 1

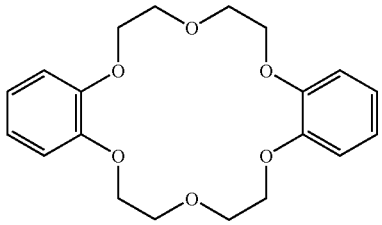

Developing agent 1

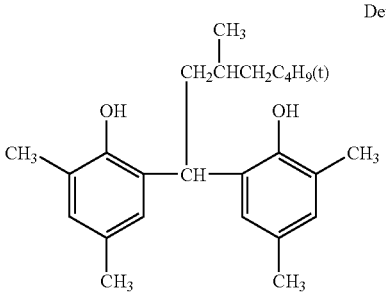

Antifoggant 1

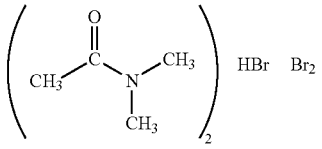

Antifoggant 2

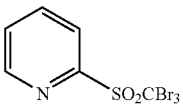

Preparation of Image Forming Layer Coating Composition

Fifty grams of the foregoing light-sensitive emulsion dispersion A-1 and 15.11 g of MEK were mixed and kept at 21° C. while stirring and 390 μl of 10% methanol solution of Antifoggant 1 was added and stirred for 1 hour. Furthermore, 889 μl of a 10% methanol solution of calcium bromide was added and stirred for 30 minutes. Then 1.416 ml of the infrared sensitizing dye solution and 667 μl of the stabilizer solution were mixed and stirred for 1 hour. The resultant liquid was cooled to 13° C. and further stirred for 30 minutes. While maintaining the liquid at 13° C., 13.31 g of poly(vinyl butyral) powder BL-5, manufactured by Sekisui Kagaku Co., Ltd., was added and stirred for 30 minutes. The following additives were added at an interval of 15 minutes under continued stiring.

Preparation of Surface Protective Layer Coating Composition

Surface Protective Layer Coating Compositions 201–211 were prepared, each having the following compositions.

Dispersion of Particles

To 96 g of MEK, 1 g of cellulose butylate•acetate CAB171-15, manufactured by Eastman Chemical Co., Ltd., was added while stirring, and further stirred until completely dissolved via a dissolver type stirrer. To the resultant solution, 2.9 g of silica particles Syloid 320, manufactured by Fuji Silysia Co., Ltd., was added and then dispersed over 45 minutes at 8,000 rpm.

Surface Protective Layer Coating Composition

To 750 g of MEK, 15 g of poly(methyl acrylate) Paraloid A21, manufactured by Rhom & Haas Co., Ltd., was added and stirred for 10 minutes. After that, 100 g of cellulose butylate•acetate CAB171-15, manufactured by Eastman Chemical Co., Ltd., was separately added in 4 steps and further stirred for 1 hour. Further, 8.9 g of phthalazine, 1.5 g of vinylsulfon compound HD-1, 0.1 g of triazine, 1.7 g of fluorosurfactant FS-1, and 2.0 g of fluorosurfactant EF-105, manufactured by Tokem Products Co., Ltd., were added and stirred for 30 minutes. To the resultant liquid, 85 g. of the foregoing particle dispersion liquid was added and thoroughly stirred and brought to 1,000 g with MEK to obtain Surface Protective Layer Coating Composition 201.

Surface Protective Layer Coating Compositions 202–211 were prepared in the same manner as in Surface Protective Layer Coating Composition 201 except that the combination of the kinds of matting agent, addition of the isocyanate compound and the surfactant were varied as shown in Table 2.

The compounds of this invention, listed in Table 2 were each employed in the form of a dispersion prepared by dispersing 2.0 g of compound in 100 g of MEK in which 2.0 g of the surfactant described in Table 2, and 2 g of cellulose butylate•acetate CAB171-15, manufactured by Eastman Chemical Co., Ltd., were dissolved via the ultrasonic dispersing apparatus, Ultrasonic Generator, manufactured by Alex Corp., at a frequency of 25 kHz and an output of 600 W. The dispersion was added to the coating composition so that the amount of the compound is the amount shown in Table 2.

Matting agent 3 described in Table 2 was Syloid 320, manufactured by Fuji Silysia CO., Ltd.

Vinylsulfon compound HD-1

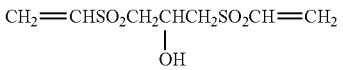

Coating on Image Forming Layer Side

Image Forming Layer Coating Composition and Surface Protecting Layer Coating Composition coated on the opposite side by a slide coater in the combination listed in Table 2 through the backing layer coated side of Sample 101 prepared in Example 1. The both of the coating compositions were uniformly coated as a double-layer at a rate of 35 m/minute so that the coated amount of silver of the image forming layer coating composition was 1.5 g/m$^2$. After that, the coated layers were dried for 5 minutes in 50° C. air having a dew point of 5° C., and further dried for 15 minutes in 55° C. air having a dew point of 10° C. Thus Samples 201–212 were obtained.

TABLE 2

| | Composition of Surface Protective Layer Coating Composition | | | | | | | Image forming layer coating composition | | |
|---|---|---|---|---|---|---|---|---|---|---|
| | | Compound relating to the invention | | Matting agent particle | | | | | | |
| Sample No. | Coating Composition No. | Kind | Adding amount (mg/m$^2$) | Kind | Added amount (mg/m$^2$) | Isocyanate Compound*1 (mg/m$^2$) | Surfactant | Coating Composition No. | Development accelerating agent*2 Adding amount (mg/m$^2$) | Remarks |
| 201 | 201 | — | — | Matting particle-3 | 40 | — | FS-1/EF-105 | 201 | — | Comp. |
| 202 | 202 | OW-8 | 40 | — | — | — | FS-1/EF-105 | 201 | — | Inv. |
| 203 | 203 | OW-8 | 40 | — | — | — | EF-105 | 202 | — | Inv. |
| 204 | 202 | OW-8 | 40 | — | — | — | FS-1/EF-105 | 201 | 50 | Inv. |
| 205 | 204 | PW-4 | 40 | — | — | — | FS-1/EF-105 | 201 | — | Inv. |
| 206 | 205 | OW-8 | 30 | Matting particle-3 | 10 | — | FS-1/EF-105 | 201 | — | Inv. |
| 207 | 206 | OW-51 | 30 | — | — | — | FS-1/EF-105 | 201 | — | Inv. |
| 208 | 207 | OW-51 | 30 | — | — | 100 | FS-1/EF-105 | 201 | — | Inv. |
| 209 | 208 | — | — | Matting particle-3 | 40 | — | FS-1/EF-105 | 201 | — | Comp. |
| 210 | 209 | Comparative-1 | 40 | — | — | — | FS-1/EF-105 | 201 | — | Comp. |
| 211 | 210 | — | — | Matting particle-3 | 40 | 100 | FS-1/EF-105 | 201 | — | Comp. |

*1Desmodule N3300
*2Development accelerating agent-3

Thermal Development and Evaluation

Exposure and Thermal Development

The above prepared samples were each exposed to laser beam scanning by an exposing apparatus featuring a light source of a longitudinal multiple semiconductor laser, emitting light at 800–820 nm by high frequency overlapping. The angle between the exposing face and the laser beam was 75°, to form images. Smoothsurfaced images and unexpectedly high sharpness were obtained compared to when the angle was 90°.

Each of the samples was subjected to 13.5 seconds of thermal developing treatment via an automatic developing machine featuring a 123° C. heating drum in the state that the surface of the sample opposite the backing surface was in contact with the heating drum. Exposure and development were carried out in an environment of 23° C. and 50% RH.

Measurement of Haze

Haze was measured via the turbidimeter Model T-2600DA, manufactured by Tokyo Denshoku Co., Ltd., and shown as a percentage.

Evaluation of Conveying Suitability

One hundred identical sized sheets of the sample were continuously subjected to the above thermal development, and the number of unsuitably conveyed sheet was recorded.

Evaluation of Scratch Resistance

The hardness of the surface was measured just after the thermal development via a common pencil hardness measuring method based on JIS K 5200.

Evaluation of Silver Image Tone

Samples exposed and developed so that the density after development was 1.1±0.05 were prepared to evaluate the silver image tone. The sample was irradiated for 100 hours by light at a color temperature of 7700 Kelvin and an illuminance of 11,600 lux, after which the silver image tone was evaluated employing the following norms. The rank satisfying the guarantee of quality was 4 or more.

5: Pure black, yellowish color was not at all noted.

4: Not pure black, but yellowish color was almost not existent.

3: Slight yellowish color was partially perceived on the image.

2: Slight yellowish color was perceived over the entire image.

1: Yellowish color was immediate perceived.

Evaluation of Resistivity to Development Unevenness

Samples for this evaluation were prepared by exposure to white light for about 20 seconds and then thermally developed. Any surface unevenness of the sample was visually observed and resistance to development unevenness was evaluated by the following criteria.

5: The surface was smooth and no problem were noted.

4: Slight irregularity was observed but not to cause problems in practical use.

3: Partial irregularity was observed, and posed a little problem in practical use.

2: Obvious irregularity was observed over the entire surface.

1: Severe irregularity was observed over the entire surface.

Results of the above evaluations are listed in Table 3.

TABLE 3

| Sample No. | Haze (%) | Conveying suitability | Resistance to scratching | Resistance to development unevenness | Silver image tone After 10 hours | Silver image tone After 100 hours | Remarks |
|---|---|---|---|---|---|---|---|
| 201 | 24.7 | 11 | 2B | 2 | 4 | 2 | Comp. |
| 202 | 21.0 | 0 | B | 4 | 4 | 4 | Inv. |
| 203 | 22.6 | 0 | B | 5 | 5 | 4 | Inv. |
| 204 | 21.9 | 0 | B | 4 | 5 | 4 | Inv. |
| 205 | 23.2 | 1 | B | 5 | 5 | 4 | Inv. |
| 206 | 23.4 | 0 | B | 5 | 5 | 5 | Inv. |
| 207 | 23.5 | 0 | HB | 5 | 5 | 5 | Inv. |
| 208 | 24.3 | 0 | HB | 5 | 5 | 4 | Inv. |
| 209 | 25.9 | 11 | 3B | 3 | 4 | 2 | Comp. |
| 210 | 23.3 | 4 | 3B | 3 | 4 | 2 | Comp. |
| 211 | 28.3 | 13 | B | 2 | 4 | 2 | Comp. |

As is shown in Table 3, the samples of silver salt photothermal photographic dry imaging material of this invention are lowered in haze, excellent in conveyance suitability and resistance to scratching, inhibited in uneven development and inhibited in variation of silver image tone during light irradiation over a long duration.

What is claimed is:

1. A silver salt photothermographic dry imaging material comprising a support provided thereon a light-sensitive layer containing an organic silver salt, light-sensitive silver halide particles and a reducing agent, wherein the dry imaging material contains organic solid lubricant particles having an average particle diameter of 1 to 30 μm, and wherein a melting point of the organic solid lubricant particles is not less than 110° C. and not more than 200° C.

2. A silver salt photothermographic dry imaging material comprising a support provided thereon a light-sensitive layer containing an organic silver salt, light-sensitive silver halide particles and a reducing agent, wherein at least one layer on a support contains a compound represented by following Formula (1):

$$(R_1)_p—X_1—L—X_2—(R_2)_q \qquad \text{Formula (1)}$$

wherein, $R_1$ and $R_2$ are each a substituted or unsubstituted alkyl group, alkenyl group, aralkyl group or aryl group, having 6 to 60 carbon atoms, and a plural number of $R_1$ and $R_2$ may be same or different from each other when p or q is an integer of 2 or more, $X_1$ and $X_2$ are each a divalent connecting group containing a nitrogen atom, and L is an unsubstituted alkyl group, alkenyl group aralkyl group or aryl group, having a valence of p plus q.

3. The silver salt photothermographic dry imaging material of claim 2, wherein the melting point of the compound represented by Formula (1) is not less than 80° C. and not more than 200° C.

4. The silver salt photothermographic dry imaging material of claim 2, wherein the compound represented by Formula (1) has a solubility in a solvent of not more than 0.5 weight % and the compound represented by Formula (1) forms particles having an average particle diameter of 1 to 30 μm.

5. The silver salt photothermographic dry imaging material of claim 2, wherein at least one layer provided on a support contains a nonionic fluorine-containing surfactant and an anionic fluorine-containing surfactant in addition to the compound represented by Formula (1).

6. The silver salt photothermographic dry imaging material of claim 1, further comprising a non-light-sensitive layer, wherein the light-sensitive layer is obtained by coating with a composition containing an organic silver salt, a light-sensitive emulsion containing light-sensitive silver halide particles and a solvent, a reducing agent and a binder, and the light-sensitive layer or the non-light-sensitive layer contains a silver saving agent.

7. The silver salt photothermographic dry imaging material of claim 1, wherein the silver salt photothermographic dry imaging material contains at least two kinds of compounds, one of the compound generating a reactive active species capable of oxidizing silver, or one of the compounds generating a reaction active species capable of inactivating the reducing agent to be made unable to reduce silver ion of the organic silver salt into silver by radiation of UV light or visible light.

8. A method of image recording comprising-the steps of:

(1) exposing the silver salt photothermographic dry imaging material of claim 1; and (2) thermally developing the exposed silver salt photothermographic dry imaging material, wherein the step (1) is conducted by employing a laser light scanning exposure device having double beams of laser scanning light.

9. The method of image recording of claim 8, wherein the step (1) is conducted by employing a laser scanning exposure device having a longitudinal multiple light of scanning laser light.

10. The silver salt photothermographic dry imaging material of claim 1, wherein a hue angle $h_{ab}$ (defined by JIS Z 8729 standard) of the dry imaging material after thermal development satisfies the relations of $180° < h_{ab} < 270°$.

11. The silver salt photothermographic dry imaging material of claim 1, wherein the light-sensitive layer is formed by employing a coating composition to form the light-sensitive layer containing water not less than 30 weight %.

* * * * *